US010950394B2

(12) United States Patent
Liao et al.

(10) Patent No.: US 10,950,394 B2
(45) Date of Patent: Mar. 16, 2021

(54) KEY SWITCH WITH NOISE REDUCTION CAPABILITY

(71) Applicant: DARFON ELECTRONICS CORP., Taoyuan (TW)

(72) Inventors: Pen-Hui Liao, Taoyuan (TW); Chin-Hung Lin, Taoyuan (TW); Yen-Hsiao Lin, Taoyuan (TW); Hsin-Hung Liu, Taoyuan (TW); Chia-Fu Cheng, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/442,531

(22) Filed: Jun. 16, 2019

(65) Prior Publication Data

US 2019/0304717 A1 Oct. 3, 2019

Related U.S. Application Data

(63) Continuation-in-part of application No. 15/993,628, filed on May 31, 2018, now Pat. No. 10,373,779.

(30) Foreign Application Priority Data

Jun. 1, 2017 (TW) ..... 106118061
Oct. 13, 2017 (TW) ..... 106135063
(Continued)

(51) Int. Cl.
*H01H 13/14* (2006.01)

(52) U.S. Cl.
CPC ..... *H01H 13/14* (2013.01); *H01H 2205/002* (2013.01)

(58) Field of Classification Search
CPC .. H01H 3/125; H01H 13/705; H01H 13/7073; H01H 13/7065; H01H 13/704; H01H 13/85; H01H 2221/062
See application file for complete search history.

(56) References Cited

U.S. PATENT DOCUMENTS 5,823,325 A 10/1998 Lin
5,950,810 A 9/1999 Pan
(Continued)

FOREIGN PATENT DOCUMENTS

CN 2877016 Y 3/2007
CN 103137363 B 3/2015
(Continued)

*Primary Examiner* — Vanessa Girardi
(74) *Attorney, Agent, or Firm* — Winston Hsu

(57) ABSTRACT

A key switch includes a base, a key cap, a supporting mechanism, a link bar and a buffer member. The key cap is disposed above the base. The supporting mechanism is connected to the key cap and the base to allow the key cap to move relative to the base upwardly and downwardly. The link bar includes a lower linking end. The buffer member and the base are two independent components. The buffer member is disposed on the base and made of material softer than material of the base. A restraining structure is formed on the buffer member. The lower linking end movably passes through the restraining structure. When the key cap moves relative to the base upwardly and downwardly, the lower linking end is driven to move within the restraining structure correspondingly, so as to reduce noise during movement of the lower linking end relative to the base.

27 Claims, 47 Drawing Sheets

(30) Foreign Application Priority Data

Feb. 14, 2018 (TW) ..... 107105465
Apr. 16, 2018 (TW) ..... 107112904

(56) References Cited

U.S. PATENT DOCUMENTS

| | | | | |
|---|---|---|---|---|
| 6,057,522 | A | 5/2000 | Chao | |
| 6,613,996 | B2 | 9/2003 | Lee | |
| 8,957,332 | B2 | 2/2015 | Yamada | |
| 9,959,992 | B1 * | 5/2018 | Chen | H01H 13/705 |
| 2018/0053606 | A1 | 2/2018 | Liao | |

FOREIGN PATENT DOCUMENTS

| | | | |
|---|---|---|---|
| CN | 104409259 | A | 3/2015 |
| CN | 204360974 | U | 5/2015 |
| CN | 104766744 | A | 7/2015 |
| CN | 205016434 | U | 2/2016 |
| CN | 106024472 | A | 10/2016 |
| CN | 206628388 | U | 11/2017 |
| CN | 105719875 | B | 3/2018 |
| CN | 107768166 | A | 3/2018 |
| TW | 247954 | | 5/1995 |
| TW | M341887 | | 10/2008 |
| TW | M351400 | | 2/2009 |
| TW | M351402 | | 2/2009 |
| TW | M381115 | U1 | 5/2010 |
| TW | M411653 | U1 | 9/2011 |
| TW | M416133 | U1 | 11/2011 |
| TW | M419145 | U1 | 12/2011 |
| TW | M455197 | U1 | 6/2013 |
| TW | M511669 | U | 11/2015 |
| TW | 201705167 | A | 2/2017 |
| TW | M539093 | U | 4/2017 |
| TW | 201903804 | A | 1/2019 |
| TW | 201916080 | A | 4/2019 |

* cited by examiner

KEY SWITCH WITH NOISE REDUCTION CAPABILITY

CROSS REFERENCE TO RELATED APPLICATIONS

This is a continuation-in-part application of U.S. patent application Ser. No. 15/993,628, filed on May 31, 2018, the contents of which are incorporated herein by reference.

BACKGROUND OF THE INVENTION

1. Field of the Invention

The present invention relates to a key switch, and more particularly, to a key switch with noise reduction capability.

2. Description of the Prior Art

Generally, a keyboard is equipped with a plurality of key switches capable of generating different input signals, so that a user can input characters, numbers or symbols by pressing the corresponding key switches. Some key switches, such as a Caps Lock key and a Shift key, may have link bars to keep balanced movements of the key caps relative to bases. However, the link bar and the base are usually connected by a shaft and a hole, and there is a clearance fit between the shaft and the hole. Therefore, the shaft and a wall of the hole may collide with each other to make noise when the key cap is pressed to move relative to the base.

SUMMARY OF THE INVENTION

Therefore, it is an objective of the present invention to provide a key switch with noise reduction capability for solving the aforementioned problems.

In order to achieve the aforementioned objective, the present invention discloses a key switch with noise reduction capability. The key switch includes a base, a circuit board, a key cap, a supporting mechanism, a link bar and a buffer member. The circuit board is disposed on the base. The key cap is disposed above the base. The supporting mechanism is disposed between the base and the key cap. An upper end and a lower end of the supporting mechanism are connected to the key cap and the base respectively to allow the key cap to move relative to the base upwardly and downwardly. The link bar includes a lower linking end. The buffer member is disposed on the base. The buffer member and the base are two independent components. A restraining structure is formed on the buffer member. The lower linking end movably passes through the restraining structure. The buffer member is made of material softer than material of the base. When the key cap moves relative to the base upwardly and downwardly, the lower linking end is driven to move within the restraining structure correspondingly, so as to reduce noise during movement of the lower linking end relative to the base.

In summary, the present invention utilizes the buffer member for reducing the operational noise of the key switch. In the present invention, the lower linking end of the link bar is driven to move within the restraining structure formed on the buffer member when the key cap moves relative to the base upwardly and downwardly. Since the buffer member is made of the material softer than the material of the base, the buffer member of the present invention facilitates to reduce the noise of the movement of the lower linking end of the link bar relative to the base.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back, " etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
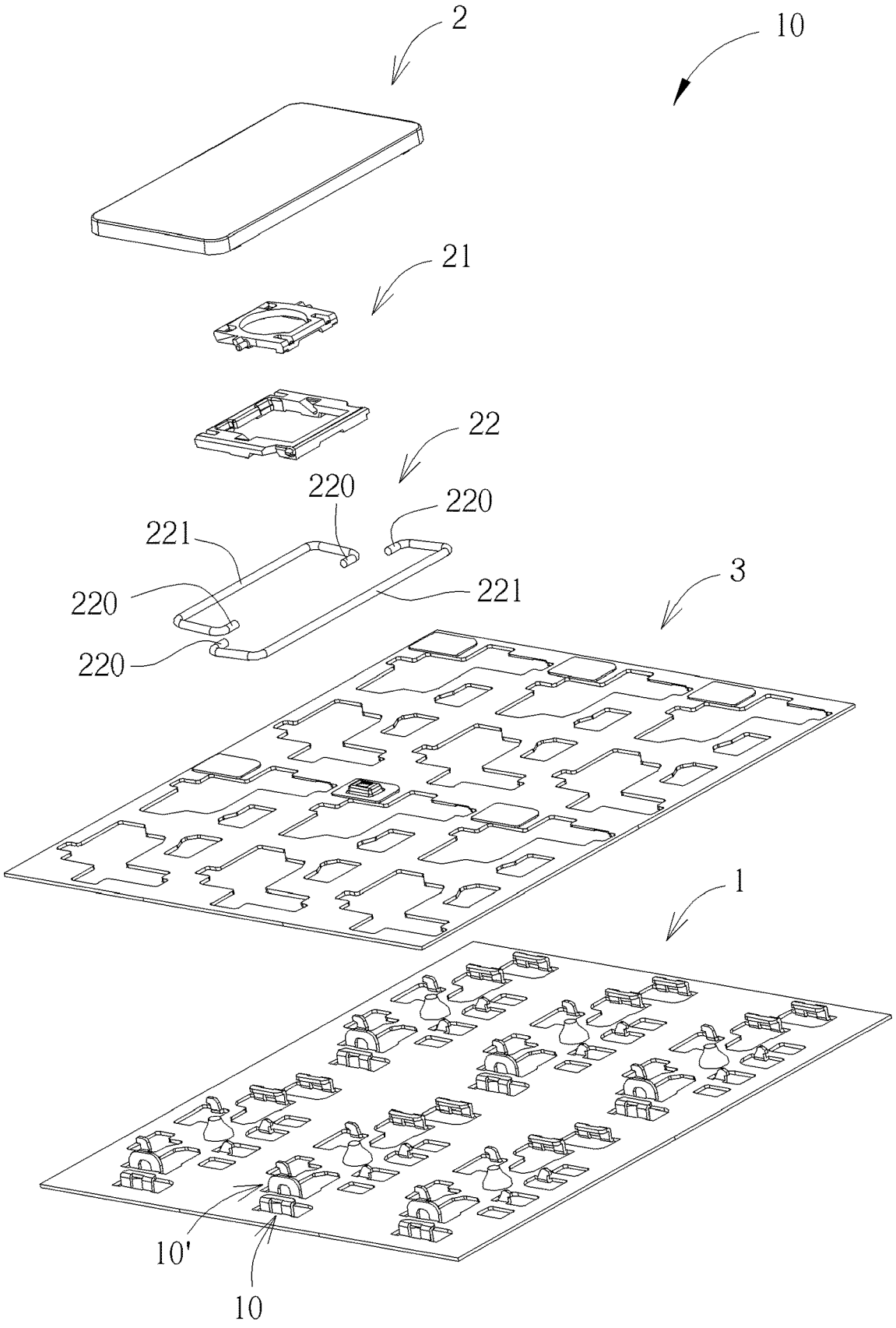
FIG. 1 is a schematic diagram of a keyboard according to a first embodiment of the present invention.

Please refer to FIG. 1. FIG. 1 is a schematic diagram of a keyboard 1000 according to a first embodiment of the present invention. As shown in FIG. 1, the keyboard 1000 includes a base 1 and a plurality of key switches 2 whose widths are much greater than their lengths. For example, the key switch 2 can be a Caps Lock key, a Shift key, or an Enter key on a standard keyboard. The plurality of key switches 2 are disposed on the base 1 for executing input commands, such as inputting characteristics, numbers or symbols.

Figure 2:
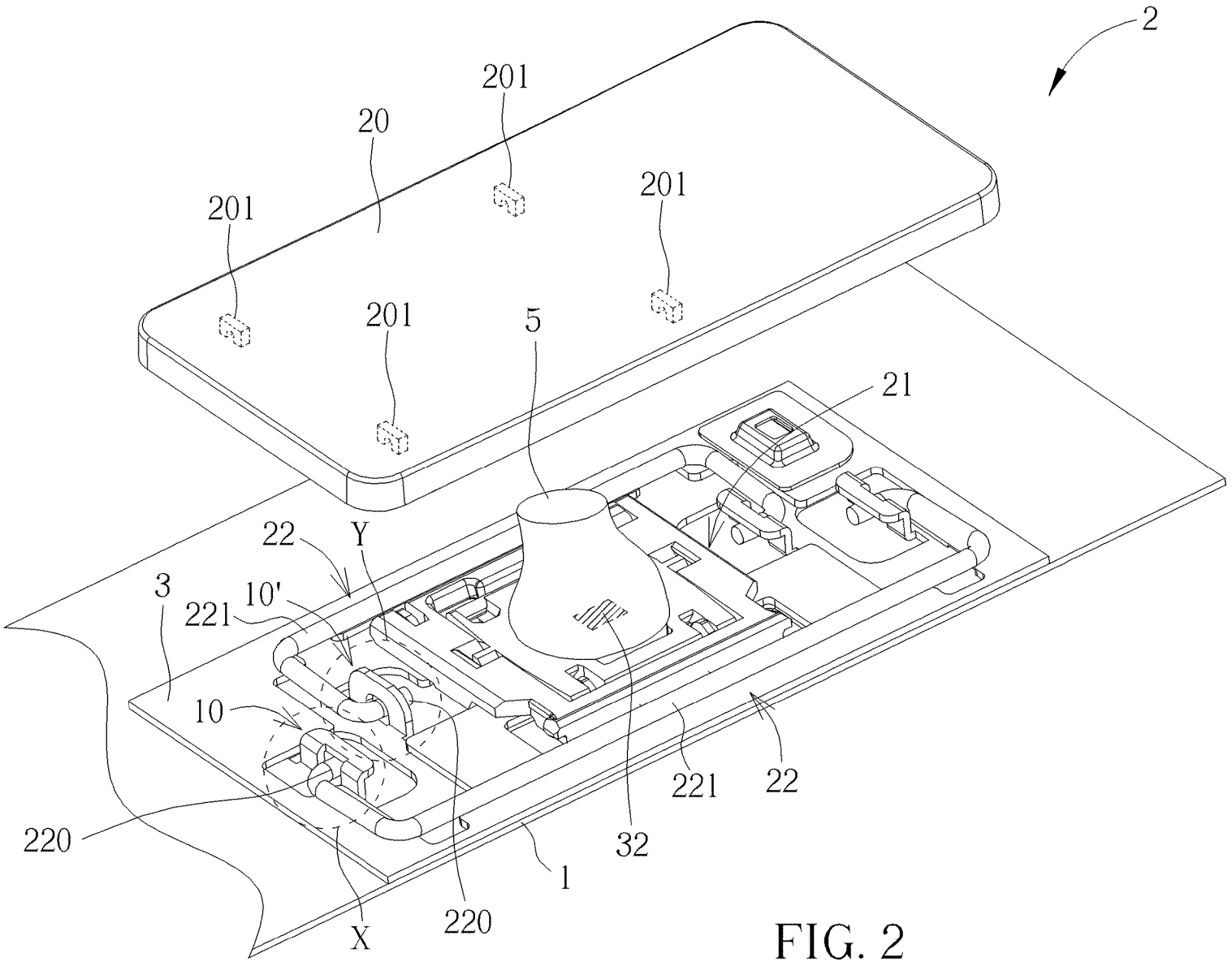
FIG. 2 is a partial exploded diagram of a key switch according to the first embodiment of the present invention.

Please refer to FIG. 2. FIG. 2 is a partial exploded diagram of the key switch 2 according to the first embodiment of the present invention. As shown in FIG. 2, the base 1 includes an engaging structure 10, and the key switch 2 includes a circuit board 3, a resilient member 5, a key cap 20, a supporting mechanism 21 and a link bar 22. The key cap 20 is disposed above the base 1. The supporting mechanism 21 is disposed between the base 1 and the key cap 20. An upper end and a lower end of the supporting mechanism 21 are connected to the key cap 20 and the base 1 respectively to allow the key cap 20 to move relative to the base 1 upwardly and downwardly. The circuit board 3 is disposed on the base 1 and includes a switch 32. The switch 32 can be activated selectively according to upward and downward movement of the key cap 20 relative to the base 1 to execute the input commands when the key cap 20 of the key switch 2 is pressed. The resilient member 5 can be disposed on the circuit board 3 and located under the key cap 20 for resiliently recovering the key cap 20 upwardly. The link bar 22 includes two lower linking ends 220 and a middle bar 221, i.e., an upper linking end. The two lower linking ends 220 are located at two opposite sides of the middle bar 221. The key cap 20 includes a pivoting structure 201. The link bar 22 is connected with the key cap 20 by rotatably pivoting the middle bar 221 to the pivoting structure 201.

Figure 3:
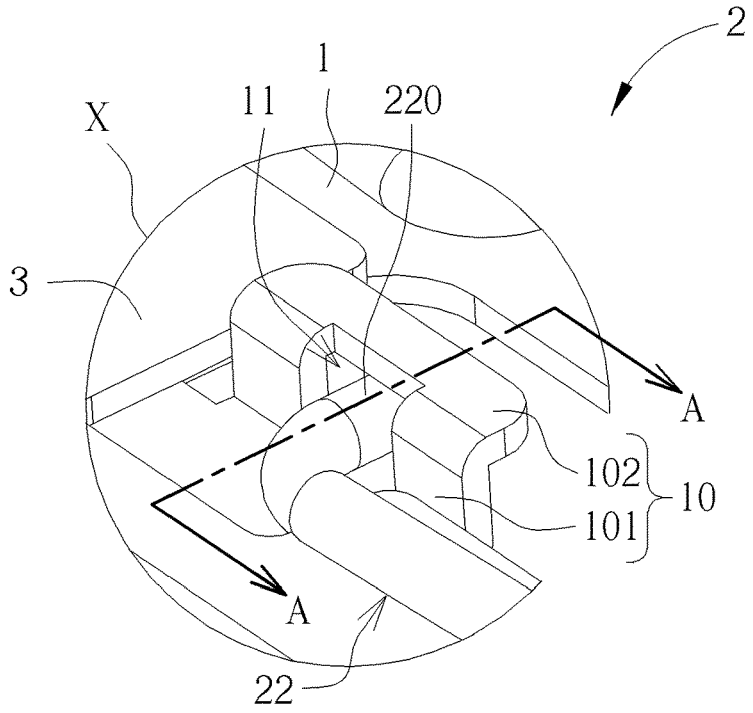
FIG. 3 is an enlarged diagram of an X portion of the key switch shown in FIG. 2 according to the first embodiment of the present invention.
Figure 4:
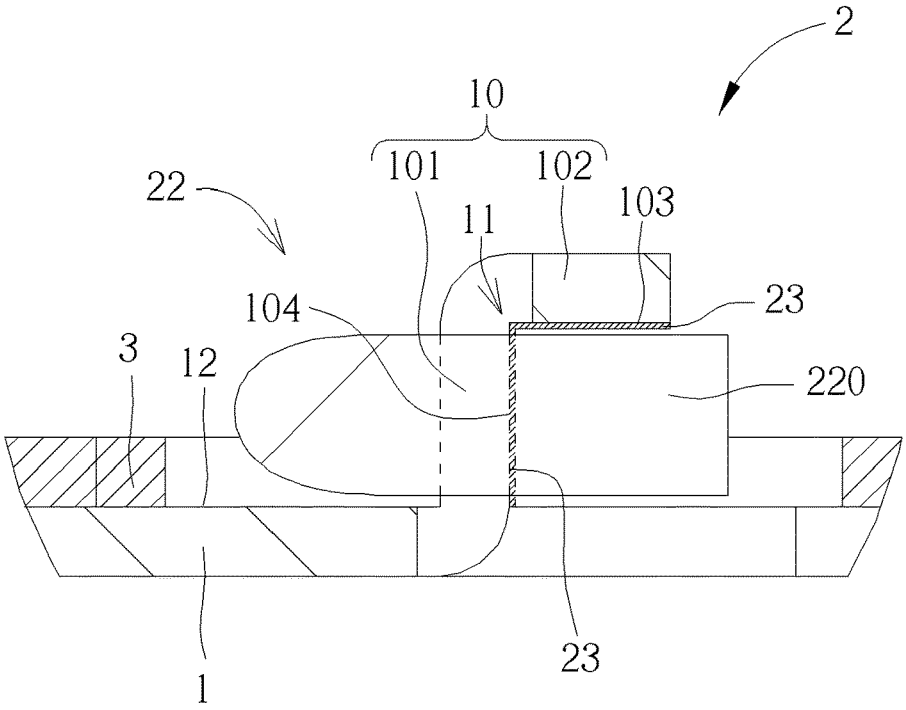
FIG. 4 is a sectional diagram of the key switch along an A-A line shown in FIG. 3 according to the first embodiment of the present invention.

Please refer to FIG. 2 to FIG. 4. FIG. 3 is an enlarged diagram of an X portion of the key switch 2 shown in FIG. 2 according to the first embodiment of the present invention. FIG. 4 is a sectional diagram of the key switch 2 along an A-A line shown in FIG. 3 according to the first embodiment of the present invention. As shown in FIG. 2 to FIG. 4, an engaging hole 11 is formed on the engaging structure 10 of the base 1. The lower linking end 220 of the link bar 22 movably passes through the engaging hole 11. The link bar 22 is connected to the key cap 20 and the base 1 by the middle bar 221 and the lower linking end 220 respectively. In such a way, during the upward and downward movement of the key cap 20, the link bar 22 and the supporting mechanism 21 can maintain operational stability of the key cap 20 cooperatively. The key switch 2 further includes a buffer layer 23. The buffer layer 23 is disposed on the engaging structure 10 and contacts with the lower linking end 220 of the link bar 22 substantially.

In this embodiment, the engaging structure 10 can be a double bending structure. That is, as shown in FIG. 3 and FIG. 4, the base 1 includes an upper surface 12 facing toward the key cap 20. The double bending structure, i.e., the engaging structure 10, includes a first bending portion 101 and a second bending portion 102. The first bending portion 101 protrudes from the upper surface 12 of the base 1. The second bending portion 102 is connected to the first bending portion 101 and is substantially parallel to the upper surface 12 of the base 1. The engaging hole 11 of the engaging structure 10 is formed on the first bending portion 101. Therefore, when it is desired to install the link bar 22 on the base 1, the lower linking end 220 of the link bar 22 can pass through the first bending portion 101 via the engaging hole 11 to be located under the second bending portion 102. Furthermore, the second bending portion 102 includes a bottom side 103 facing toward the upper surface 12 of the base 1. The first bending portion 101 includes a lateral side 104 connected to the bottom side 103 of the second bending portion 102.

In this embodiment, the buffer layer 23 can be disposed on the bottom side 103 of the second bending portion 102 and the lateral side 104 of the first bending portion 101. In such a way, when the key cap 20 moves relative to the base 1 upwardly and downwardly, the lower linking end 220 of the link bar 22 can move within the engaging hole 11 of the engaging structure 10 correspondingly, which may lead the lower linking end 220 to collide with an inner surface of the engaging hole 11. At this moment, the buffer layer 23 disposed on the bottom side 103 of the second bending portion 102 and the lateral side 104 of the first bending portion 101 can substantially contact with the lower linking end 220 to prevent the collision of the lower linking end 220 and a wall of the engaging hole 11. Therefore, it reduces noise due to collision of the lower linking end 220 and the engaging structure 10. In this embodiment, the buffer layer 23 can be a grease layer or a tape layer. Furthermore, the buffer layer 23 can be selectively disposed on the lateral side 104 of the first bending portion 101. In other words, the buffer layer 23 can be disposed on the bottom side 103 of the second bending portion 102 only and not disposed on the lateral side 104 of the first bending portion 101. It depends on practical demands.

Figure 5:
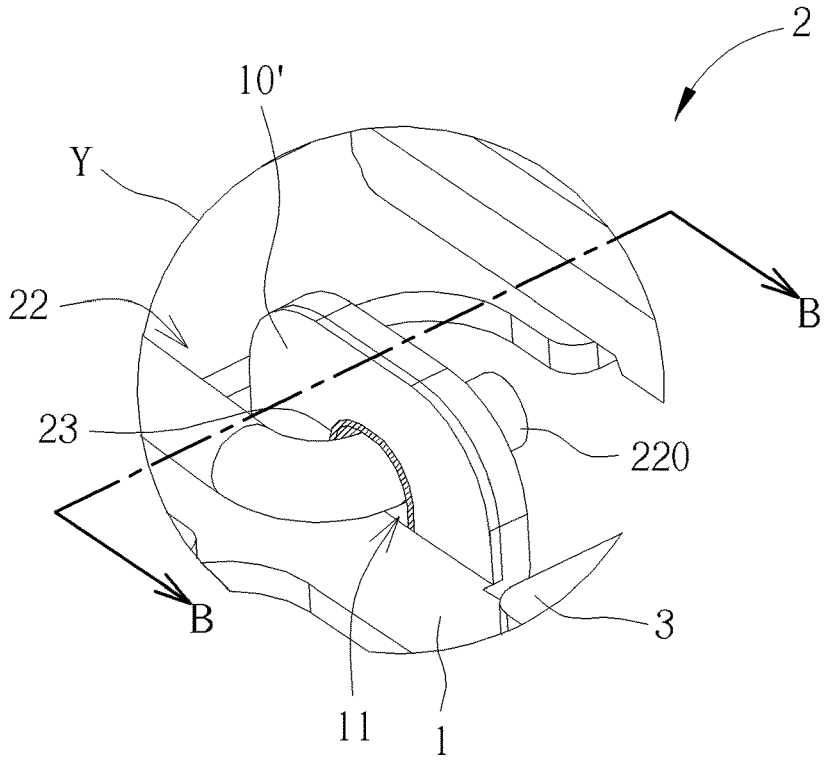
FIG. 5 is an enlarged diagram of a Y portion of the key switch shown in FIG. 2 according to the first embodiment of the present invention.
Figure 6:
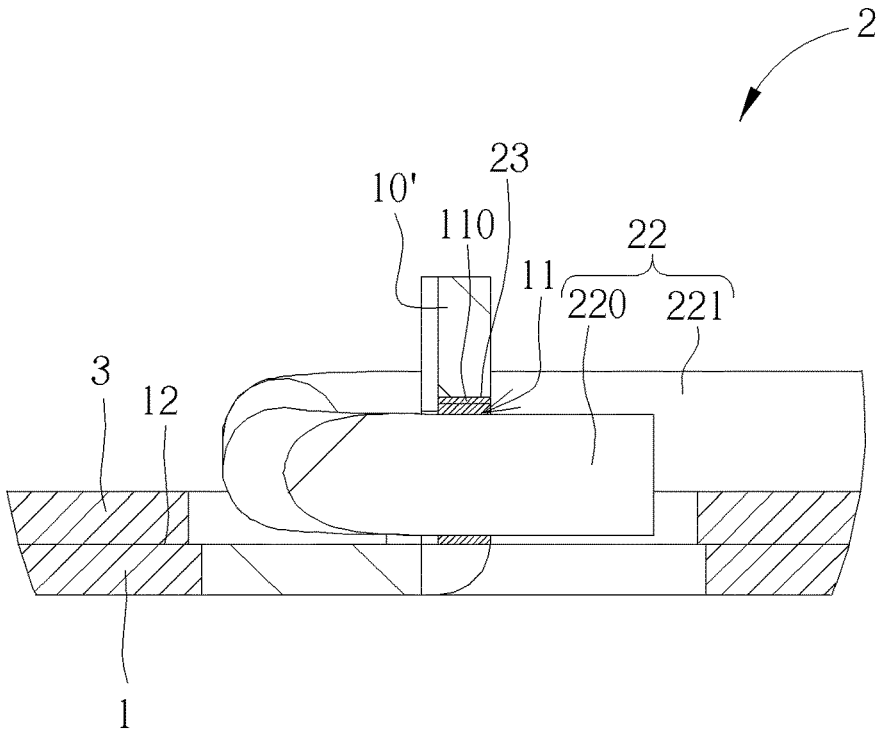
FIG. 6 is a sectional diagram of the key switch along a B-B line shown in FIG. 5 according to the first embodiment of the present invention.

Please refer to FIG. 5 and FIG. 6. FIG. 5 is an enlarged diagram of a Y portion of the key switch 2 shown in FIG. 2 according to the first embodiment of the present invention. FIG. 6 is a sectional diagram of the key switch 2 along a B-B line shown in FIG. 5 according to the first embodiment of the present invention. As shown in FIG. 5 and FIG. 6, the key switch 2 further includes an engaging structure 10'. Different from the engaging structure 10, the engaging structure 10' can be a single bending structure and protrudes from the upper surface 12 of the base 1. The engaging hole 11 is formed on the single bending structure. The buffer layer 23 is disposed on a wall 110 of the engaging hole 11. In such a way, when the key cap 20 moves relative to the base 1 upwardly and downwardly, the lower linking end 220 of the link bar 22 can move within the engaging hole 11 of the engaging structure 10' correspondingly, which may lead the lower linking end 220 to collide with the wall 110 of the engaging hole 11. At this moment, the buffer layer 23 disposed on the wall 110 of the engaging hole 11 can substantially contacts with the lower linking end 220 to prevent the collision of the lower linking end 220 and the wall 110 of the engaging hole 11, which reduces noise due to collision of the lower linking end 220 and the engaging structure 10'.

Figure 7:
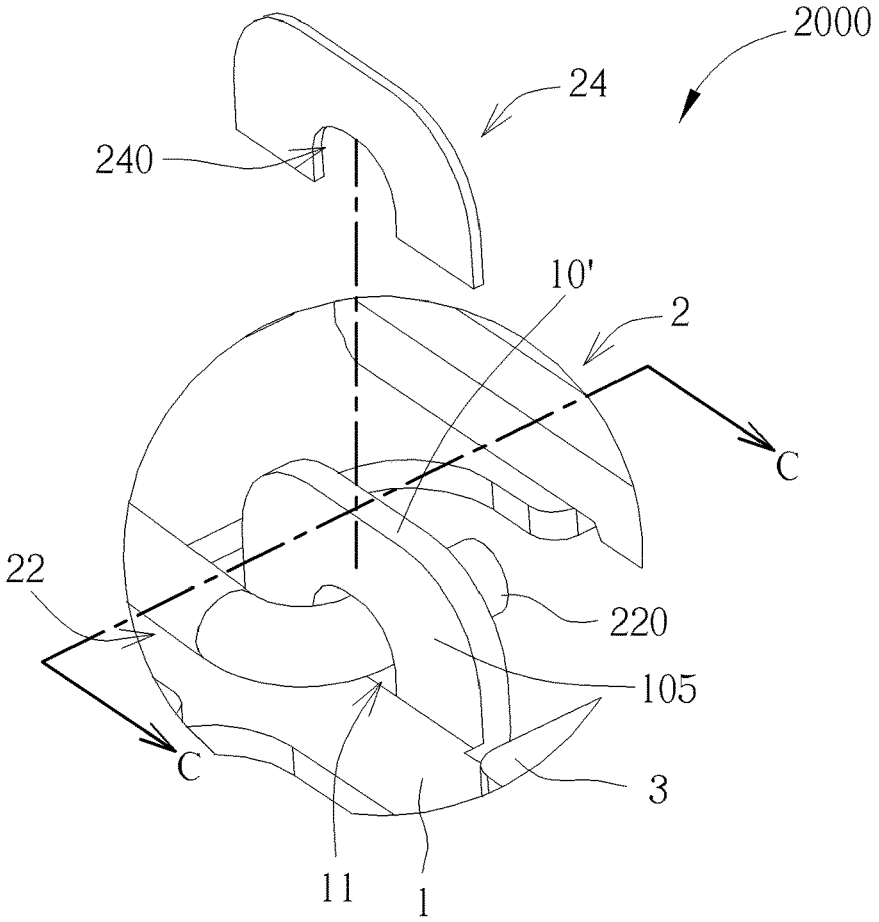
FIG. 7 is a partial enlarged diagram of a keyboard according to a second embodiment of the present invention.
Figure 8:
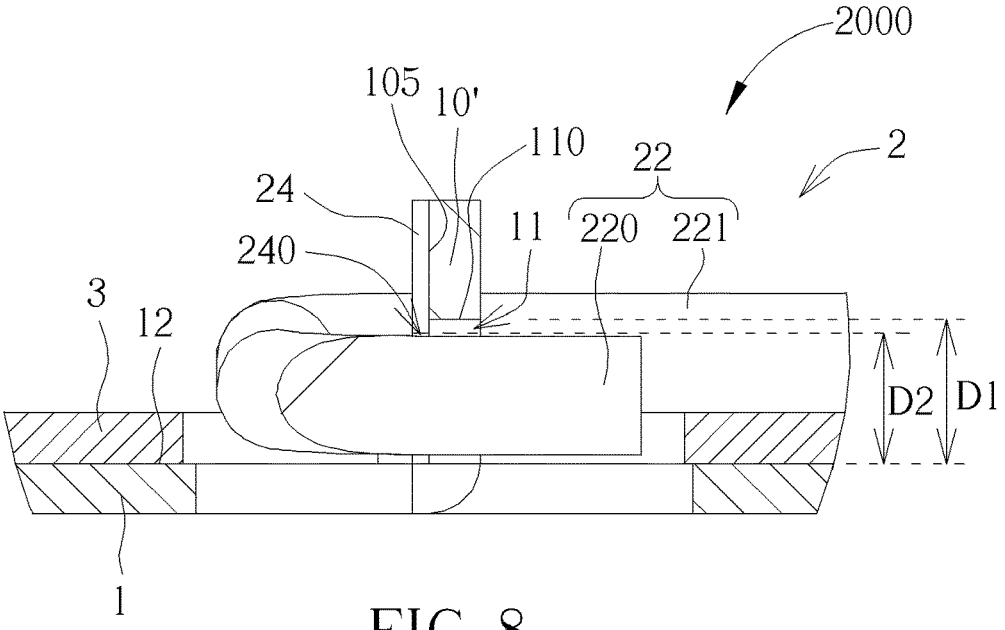
FIG. 8 is a sectional diagram of the keyboard along a C-C line shown in FIG. 7 according to the second embodiment of the present invention.

Please refer to FIG. 7 and FIG. 8. FIG. 7 is a partial enlarged diagram of a keyboard 2000 according to a second embodiment of the present invention. FIG. 8 is a sectional diagram of the keyboard 2000 along a C-C line shown in FIG. 7 according to the second embodiment of the present invention. As shown in FIG. 7 and FIG. 8, different from the keyboard 1000, the keyboard 2000 includes a buffer plate 24 to replace the buffer layer 23 of the keyboard 1000 for reducing the noise. The base 1 includes the upper surface 12. The engaging structure 10' of the keyboard 2000 can be a single bending structure and protrudes from the upper surface 12 of the base 1. The single bending structure, i.e., the engaging structure 10', includes a single bending lateral surface 105 connected to the upper surface 12 of the base 1. The buffer plate 24 is attached onto the single bending lateral surface 105 to be disposed on the engaging structure 10'. A restraining hole 240 is formed on the buffer plate 24 and corresponding to the engaging hole 11 on the engaging structure 10'. The lower linking end 220 of the link bar 22 movably passes through the engaging hole 11 and the restraining hole 240.

In this embodiment, the base 1 can be made of metal material. The engaging structure 10' can be the single bending structure stamped from the base 1 upwardly. The buffer plate 24 can be made of plastic material. For example, the buffer plate 24 can be a Mylar sheet. Therefore, the buffer plate 24 made of the plastic material is softer than the engaging structure 10' made of the metal material. Furthermore, a diameter D2 of the restraining hole 240 on the buffer plate 24 is less than a diameter D1 of the engaging hole 11 on the engaging structure 10'. When the key cap 20 moves relative to the base 1 upwardly and downwardly, the lower linking end 220 of the link bar 22 can move within the engaging hole 11 and the restraining hole 240 correspondingly. At this moment, the structural design that the diameter D2 of the restraining hole 240 is less than the diameter D1 of the engaging hole 11 allows the lower linking end 220 to abut against the buffer plate 24 firstly to prevent collision of the lower linking end 220 and the engaging structure 10', which reduces the noise due to collision of the lower linking end 220 and the engaging structure 10'. Elements that have the same structures and functions as that illustrated in the aforementioned embodiment are provided with the same item numbers in this embodiment. For simplicity, detailed description is omitted herein.

Figure 9:
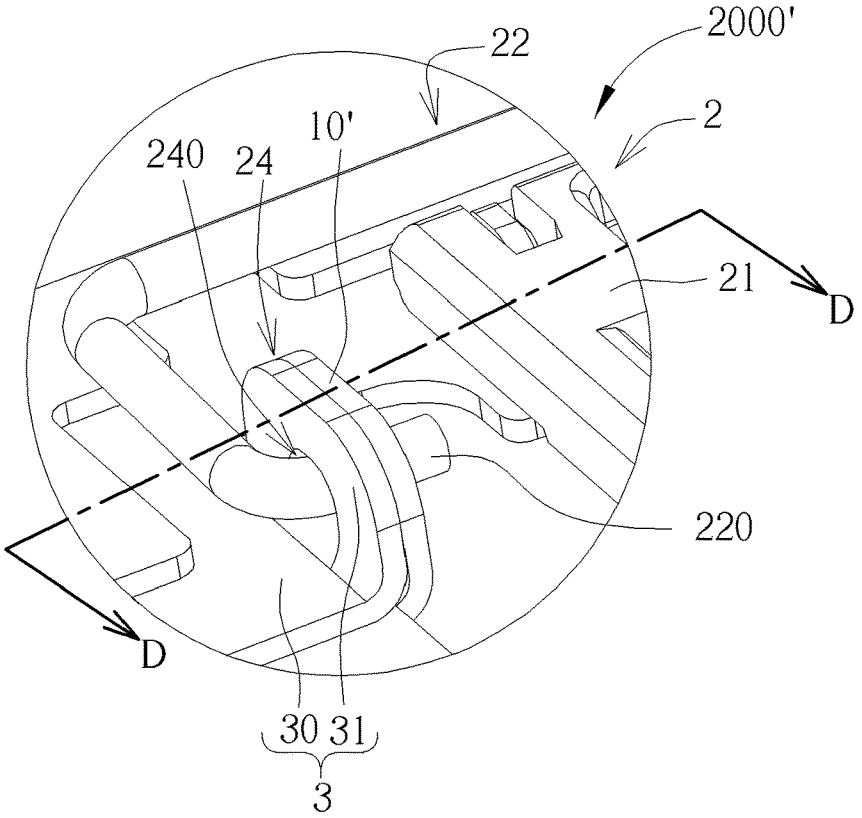
FIG. 9 is a partial enlarged diagram of a keyboard according to a third embodiment of the present invention.
Figure 10:
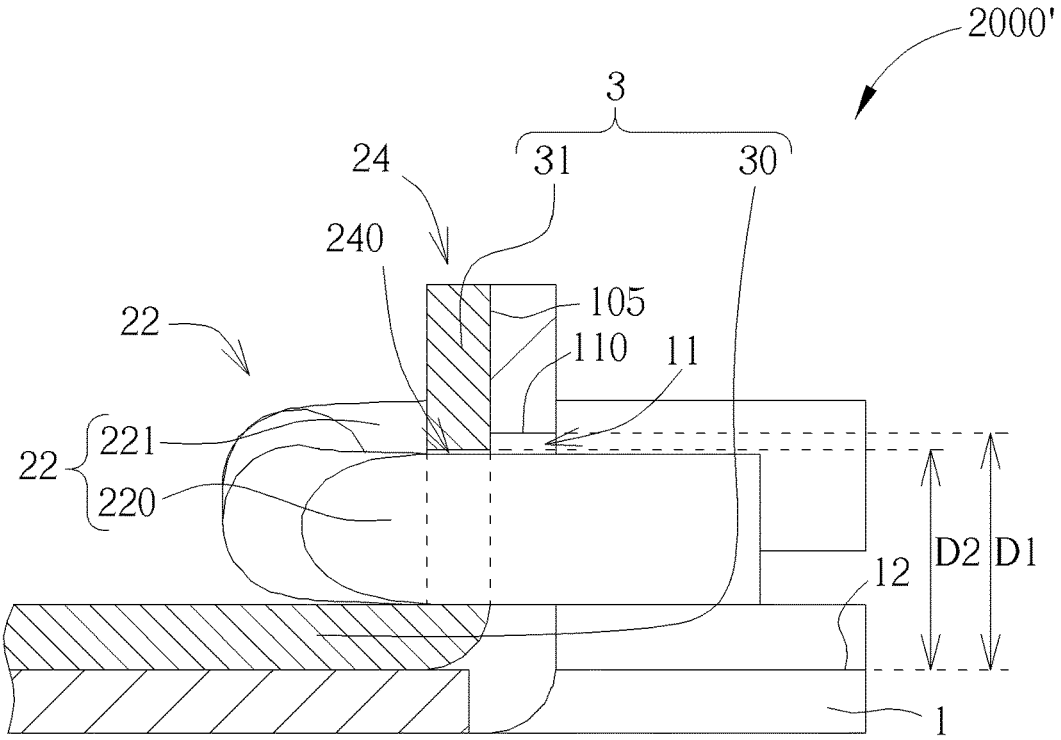
FIG. 10 is a sectional diagram of the keyboard along a D-D line shown in FIG. 9 according to the third embodiment of the present invention.

Please refer to FIG. 9 and FIG. 10. FIG. 9 is a partial enlarged diagram of a keyboard 2000' according to a third embodiment of the present invention. FIG. 10 is a sectional diagram of the keyboard 2000' along a D-D line shown in FIG. 9 according to the third embodiment of the present invention. As shown in FIG. 9 and FIG. 10, different from the aforementioned keyboard 2000, the circuit board 3 of the keyboard 2000' of this embodiment includes a horizontal portion 30 and a vertical portion 31. The horizontal portion 30 is disposed on the base 1 and extends along a horizontal direction. Please further refer to FIG. 2. The horizontal portion 30 includes a switch 32 located under the key cap 20. The key cap 20 can be pressed to activate the switch 32. Furthermore, a lower end of the vertical portion 31 is connected to the horizontal portion 30 and extends upwardly. An upper end of the vertical portion 31 forms the buffer plate 24. That is, the buffer plate 24 of the keyboard 2000' is formed by a part of the circuit board 3, i.e., the vertical portion 31 which is bent upwardly from the horizontal portion 30. Elements that have the same structures and functions as that illustrated in the aforementioned embodiment are provided with the same item numbers in this embodiment. Detailed description is omitted herein for simplicity.

Figure 11:
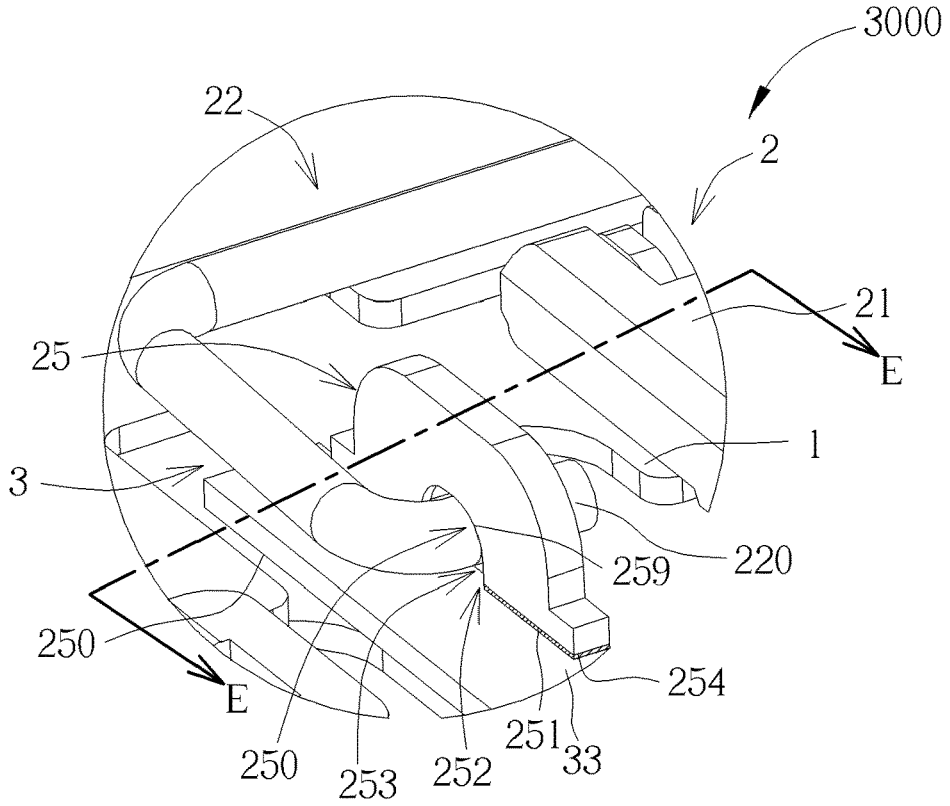
FIG. 11 is a partial enlarged diagram of a keyboard according to a fourth embodiment of the present invention.
Figure 12:
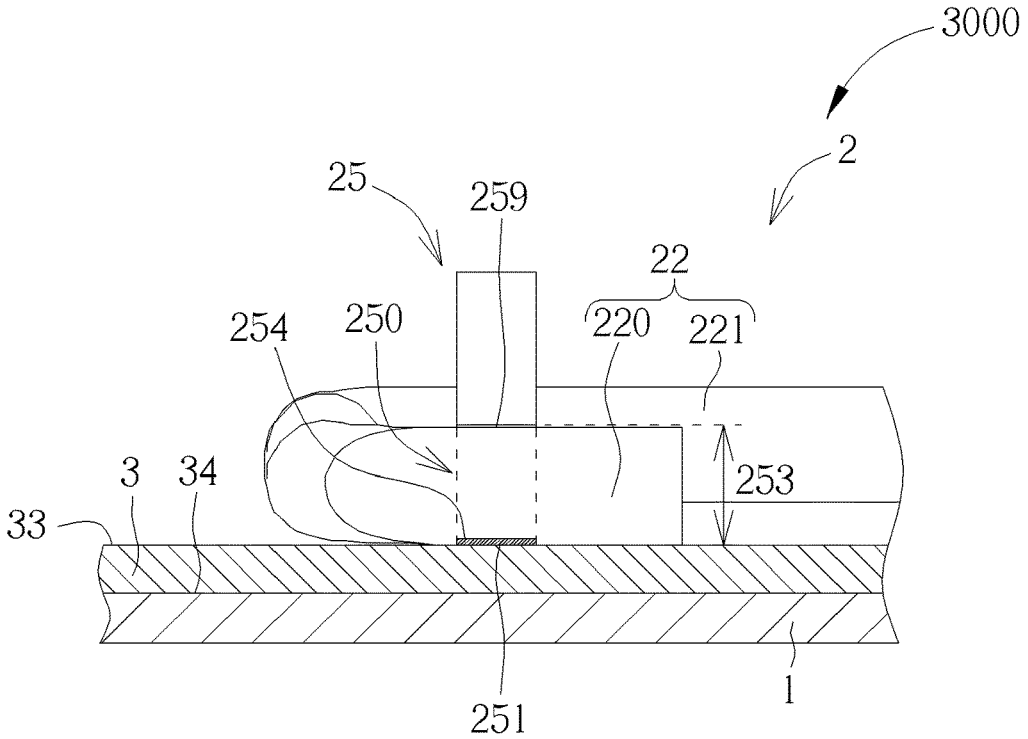
FIG. 12 is a sectional diagram of the keyboard along an E-E line shown in FIG. 11 according to the fourth embodiment of the present invention.

Please refer to FIG. 11 and FIG. 12. FIG. 11 is a partial enlarged diagram of a keyboard 3000 according to a fourth embodiment of the present invention. FIG. 12 is a sectional diagram of the keyboard 3000 along an E-E line shown in FIG. 11 according to the fourth embodiment of the present invention. As shown in FIG. 11 and FIG. 12, different from the aforementioned keyboard 2000, the keyboard 3000 further includes a buffer member 25 to replace the engaging structure 10' of the base 1 of the keyboard 2000. That is, the base 1 of the keyboard 3000 is not bent upwardly to form the engaging structure 10'. In this embodiment, the buffer member 25 can be disposed on the circuit board 3, and the buffer member 25 and the circuit board 3 are two independent members. A restraining hole 250 is formed on the buffer member 25 and penetrates through the buffer member 25 horizontally. The lower linking end 220 of the link bar 22 movably passes through the restraining hole 250.

Furthermore, the circuit board 3 includes an upper surface 33 facing toward the key cap 20. The buffer member 25 includes a bottom surface 254 and a combining surface 251 located at the bottom surface 254. The buffer member 25 can be attached onto the circuit board 3 by attachment of the combining surface 251 and the upper surface 33 of the circuit board 3. In this embodiment, a double-sided tape or an adhesive layer can be disposed on the combining surface 251. Moreover, an opening 252 can be formed on the combining surface 251 and communicated with the restraining hole 250, so that the buffer member 25 can be a C-shaped structure with the downward opening 252. Therefore, when the combining surface 251 is attached onto the upper surface 33 of the circuit board 3, the upper surface 33 of the circuit board 3 seals the opening 252, so that a wall of the restraining hole 250 and the upper surface 33 of the circuit board 3 define an accommodating space 253 cooperatively, which allows the lower linking end 220 of the link bar 22 to be accommodated within the accommodating space 253 and to movably pass through the restraining hole 250.

In this embodiment, the buffer member 25 can be made of material softer than material of the base 1. For example, the buffer member 25 can be made of plastic material or rubber material, and the base 1 can be made of metal material. Therefore, when the key cap 20 moves relative to the base 1 upwardly and downwardly, the lower linking end 220 of the link bar 22 moves within the restraining hole 250 on the buffer member 25 correspondingly. Compared to the engaging structure 10' upwardly bent from the base 1, the buffer member 25 is made of material softer than the material of the base 1, and therefore, it reduces the noise during movement of the lower linking end 220 relative to the base 1. Elements that have the same structures and functions as that illustrated in the aforementioned embodiment are provided with the same item numbers in this embodiment. Detailed description is omitted herein for simplicity.

Figure 13:
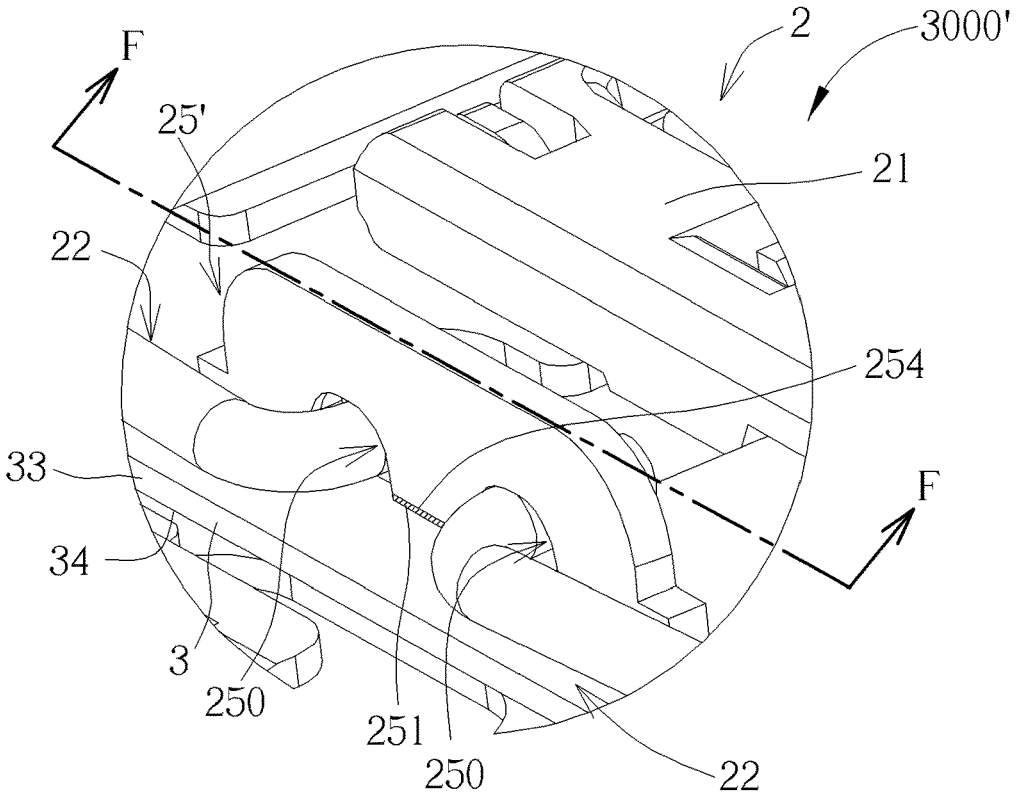
FIG. 13 is a partial enlarged diagram of a keyboard according to a fifth embodiment of the present invention.
Figure 14:
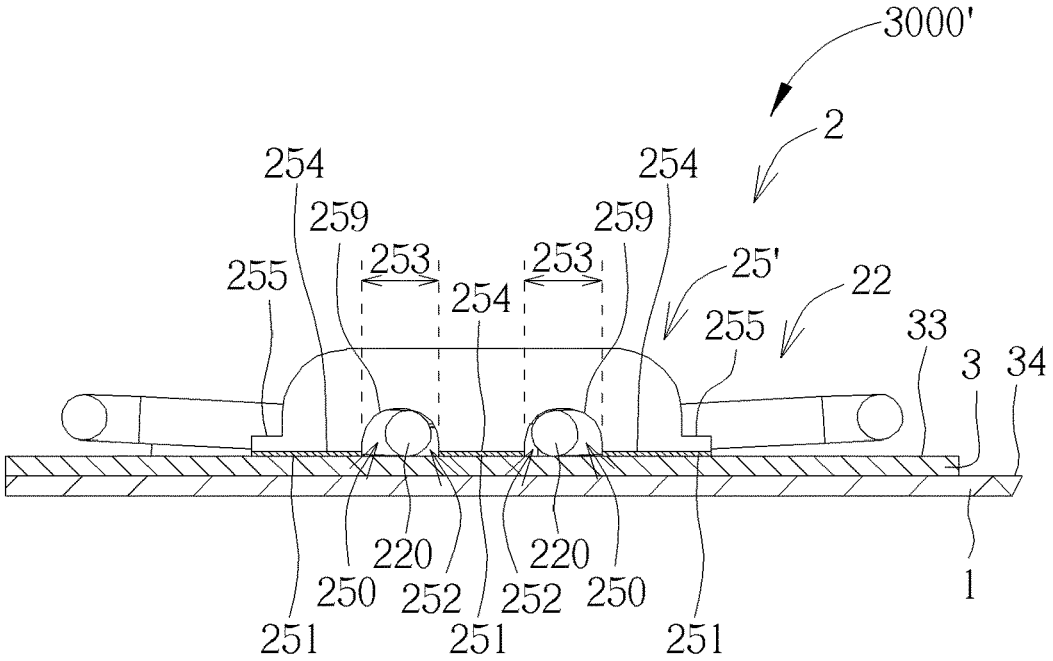
FIG. 14 is a sectional diagram of the keyboard along an F-F line shown in FIG. 13 according to the fifth embodiment of the present invention.

It should be noticed that the numbers of the combining surface 251 of the buffer member 25 and the restraining hole 250 are not limited to the figures illustrated in this embodiment. For example, please refer to FIG. 13 and FIG. 14. FIG. 13 is a partial enlarged diagram of a keyboard 3000' according to a fifth embodiment of the present invention. FIG. 14 is a sectional diagram of the keyboard 3000' along an F-F line shown in FIG. 13 according to the fifth embodiment of the present invention. As shown in FIG. 13 and FIG. 14, different from the aforementioned keyboard 3000, two restraining holes 250 are formed on a buffer member 25' of the keyboard 3000' of this embodiment for accommodating the lower linking ends 220 of the two link bars 22. Furthermore, the buffer member 25' includes a plurality of combining surfaces 251. Each combining surface 251 is located at the bottom surface 254 of the buffer member 25' and disposed beside the corresponding restraining hole 250. Elements that have the same structures and functions as that illustrated in the aforementioned embodiment are provided with the same item numbers in this embodiment. Detailed description is omitted herein for simplicity.

Figure 15A:
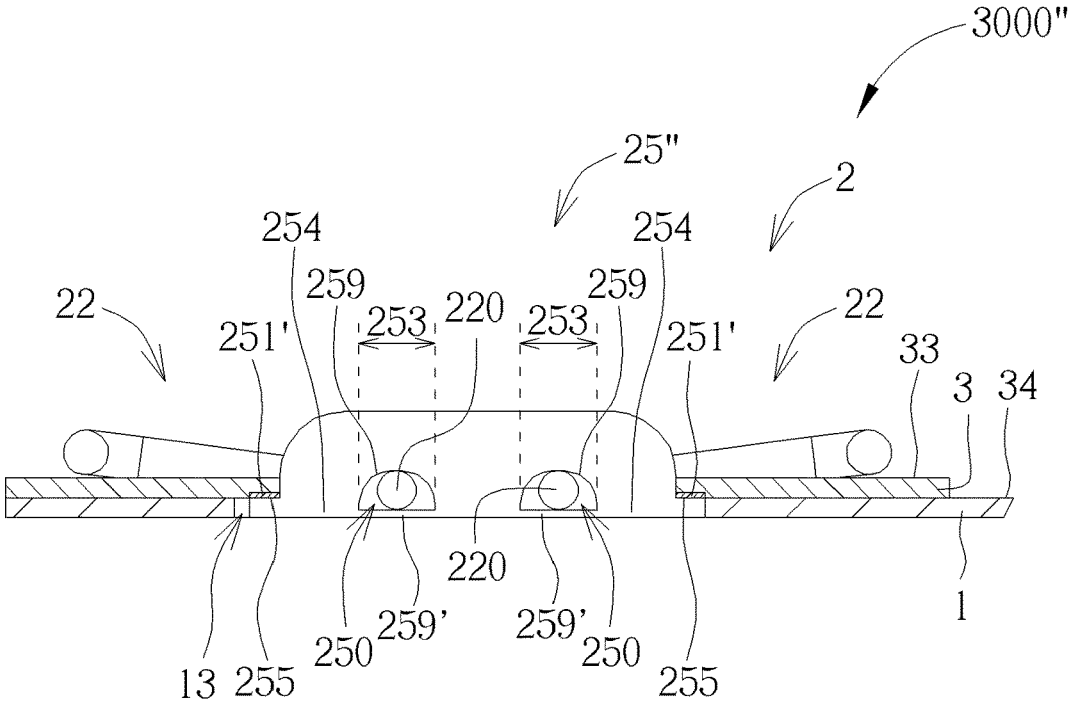
FIG. 15A is a sectional diagram of a keyboard according to a sixth embodiment of the present invention.
Figure 15B:
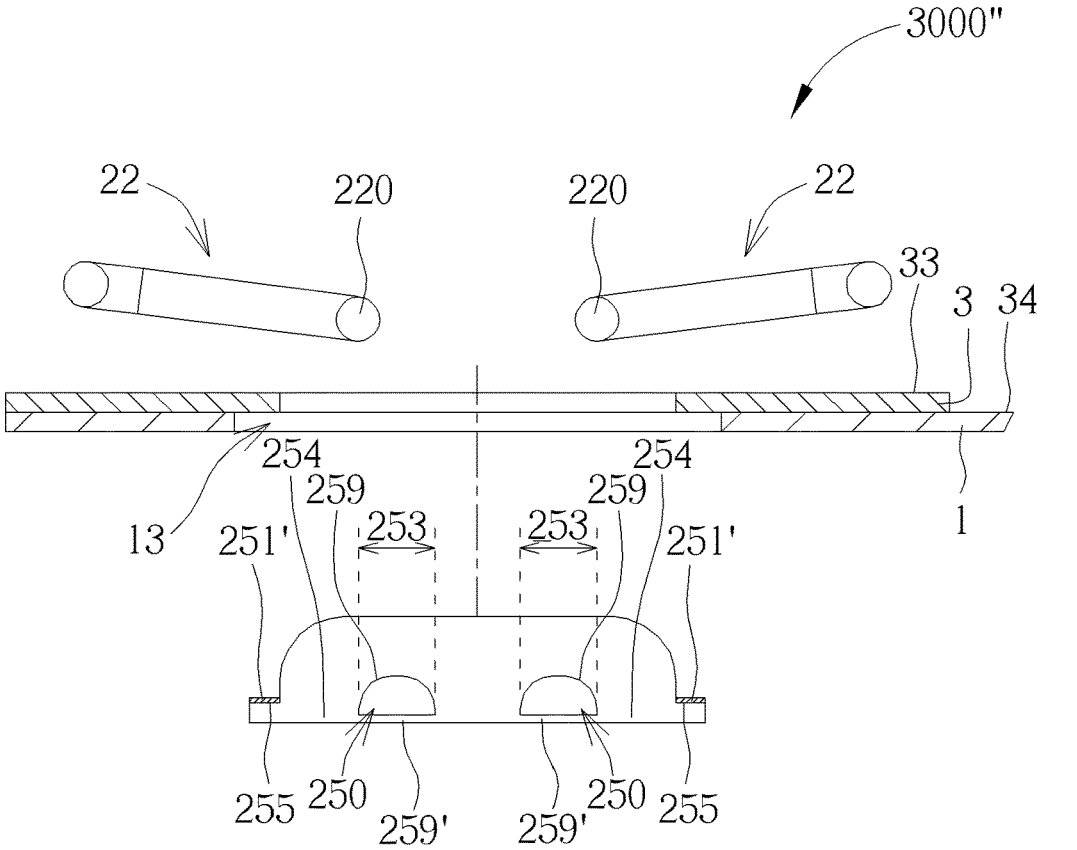
FIG. 15B is an exploded diagram of the keyboard shown in FIG. 15A according to the sixth embodiment of the present invention.

Please refer to FIG. 15A and FIG. 15B. FIG. 15A is a sectional diagram of a keyboard 3000" according to a sixth embodiment of the present invention. FIG. 15B is an exploded diagram of the keyboard 3000" shown in FIG. 15A according to the sixth embodiment of the present invention. As shown in FIG. 15A and FIG. 15B, different from the aforementioned keyboard 3000', the circuit board 3 of the keyboard 3000" includes the upper surface 33 and a lower surface 34 opposite to the upper surface 33. A buffer member 25" of the keyboard 3000" includes a plurality of combining surface 251', the bottom surface 254 and a top surface 255 opposite to the bottom surface 254. The plurality of combining surfaces 251' are located at the top surface 255 of the buffer member 25" and disposed on two opposite sides of the restraining hole 250. The plurality of combining surfaces 251' are attached onto the lower surface 34 of the circuit board 3. Furthermore, an accommodating slot 13 is further formed on the base 1 of the keyboard 3000" and disposed under the buffer member 25". When the plurality of combining surfaces 251' are attached onto the lower surface 34 of the circuit board 3, the buffer member 25" is partially accommodated within the accommodating slot 13, so that the plurality of combining surfaces 251' and the buffer member 25" can smoothly align with the lower surface 34 of the circuit board 3, which prevents the upper surface 33 of the circuit board 3 from protruding upwardly which results in reduction of mechanical space above the upper surface 34 of the circuit board 3. Besides, the buffer member 25" further includes a lower wall 259'. The lower wall 259' and the wall of the restraining hole 250 define the accommodating space 253 cooperatively for accommodating the lower linking end 220 of the link bar 22. Elements that have the same structures and functions as that illustrated in the aforementioned embodiment are provided with the same item numbers in this embodiment. Detailed description is omitted herein for simplicity.

Figure 16:
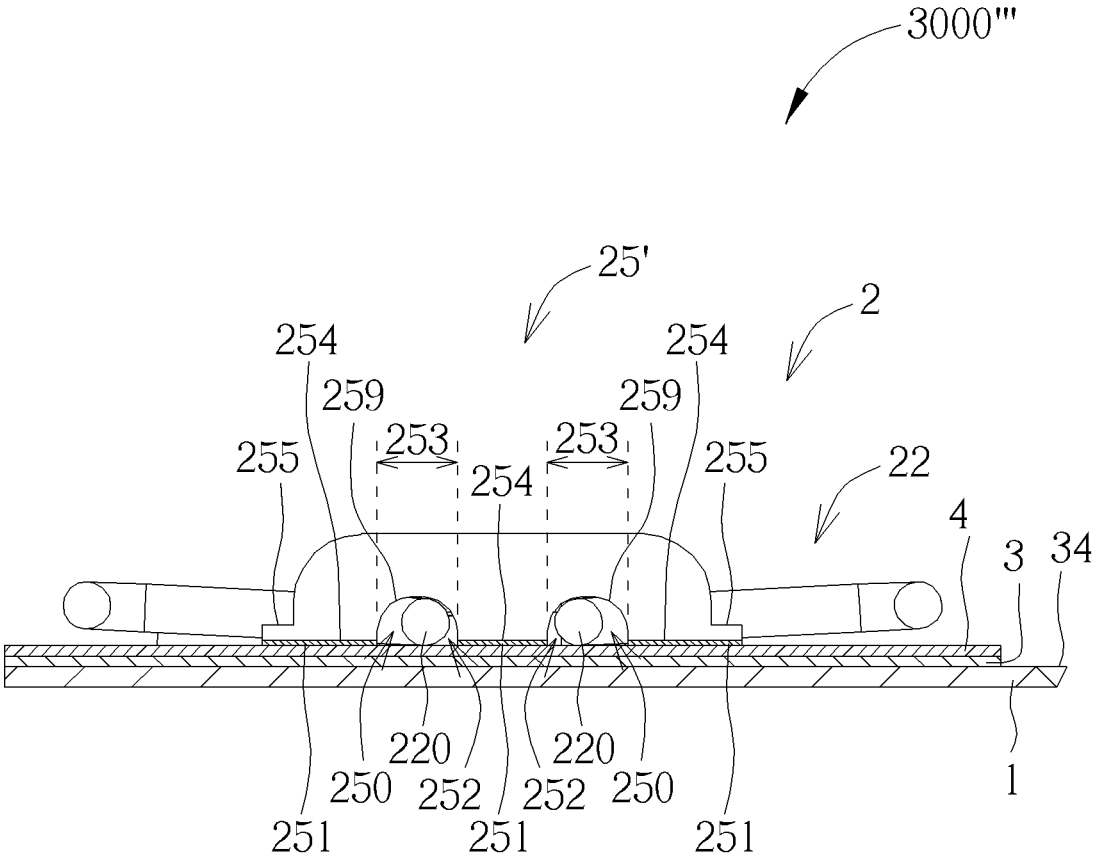
FIG. 16 is a sectional diagram of a keyboard according to a seventh embodiment of the present invention.

Please refer to FIG. 16. FIG. 16 is a sectional diagram of a keyboard 3000'" according to a seventh embodiment of the present invention. As shown in FIG. 16, different from the aforementioned keyboard 3000', the keyboard 3000'" of this embodiment further includes a connecting layer 4 disposed on the circuit board 3. Please further refer to FIG. 1 and FIG. 2. A plurality of resilient members 5 can be disposed on the connecting layer 4 in advance for simplifying assembly operation of the resilient members 5. In this embodiment, the buffer member 25' of the keyboard 3000'" can be combined with the connecting layer 4 by glue or hot-melt adhesive firstly and then be stacked on the circuit board 3. Elements that have the same structures and functions as that illustrated in the aforementioned embodiment are provided with the same item numbers in this embodiment. Detailed description is omitted herein for simplicity.

Figure 17:
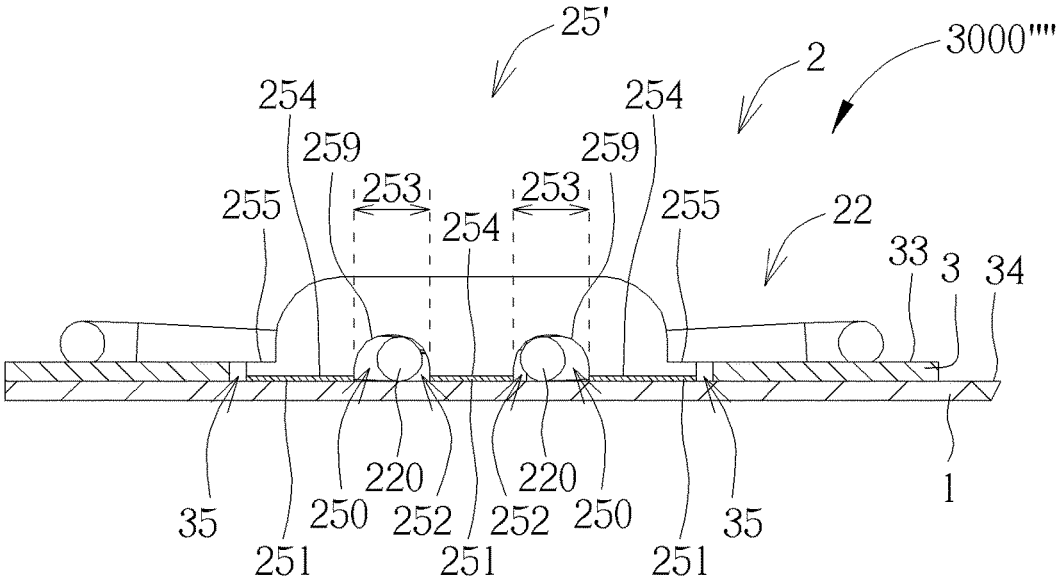
FIG. 17 is a sectional diagram of a keyboard according to an eighth embodiment of the present invention.

Please refer to FIG. 17. FIG. 17 is a sectional diagram of a keyboard 3000"" according to an eighth embodiment of the present invention. As shown in FIG. 17, different from the aforementioned keyboard 3000', the combining surface 251 of the buffer member 25' of the keyboard 3000"" of this embodiment disposed on the bottom surface 254 of the buffer member 25' is fixed onto the upper surface 12 of the base 1 by glue or hot-melt adhesive, so that the buffer member 25' can be disposed on the base 1. That is, the buffer member 25' of the keyboard 3000"" can be fixed onto the base 1 by glue or hot-melt adhesive. Furthermore, a through slot 35 is formed on the circuit board 3 of the keyboard 3000"". When the combining surface 251 of the buffer member 25' is combined with the upper surface 12 of the base 1, a main body portion of the buffer member 25' can protrude from the upper surface 33 of the circuit board 3 via the through slot 35 for assembly of the lower linking end 220 of the link bar 22. Elements that have the same structures and functions as that illustrated in the aforementioned embodiment are provided with the same item numbers in this embodiment. Detailed description is omitted herein for simplicity.

Figure 18:
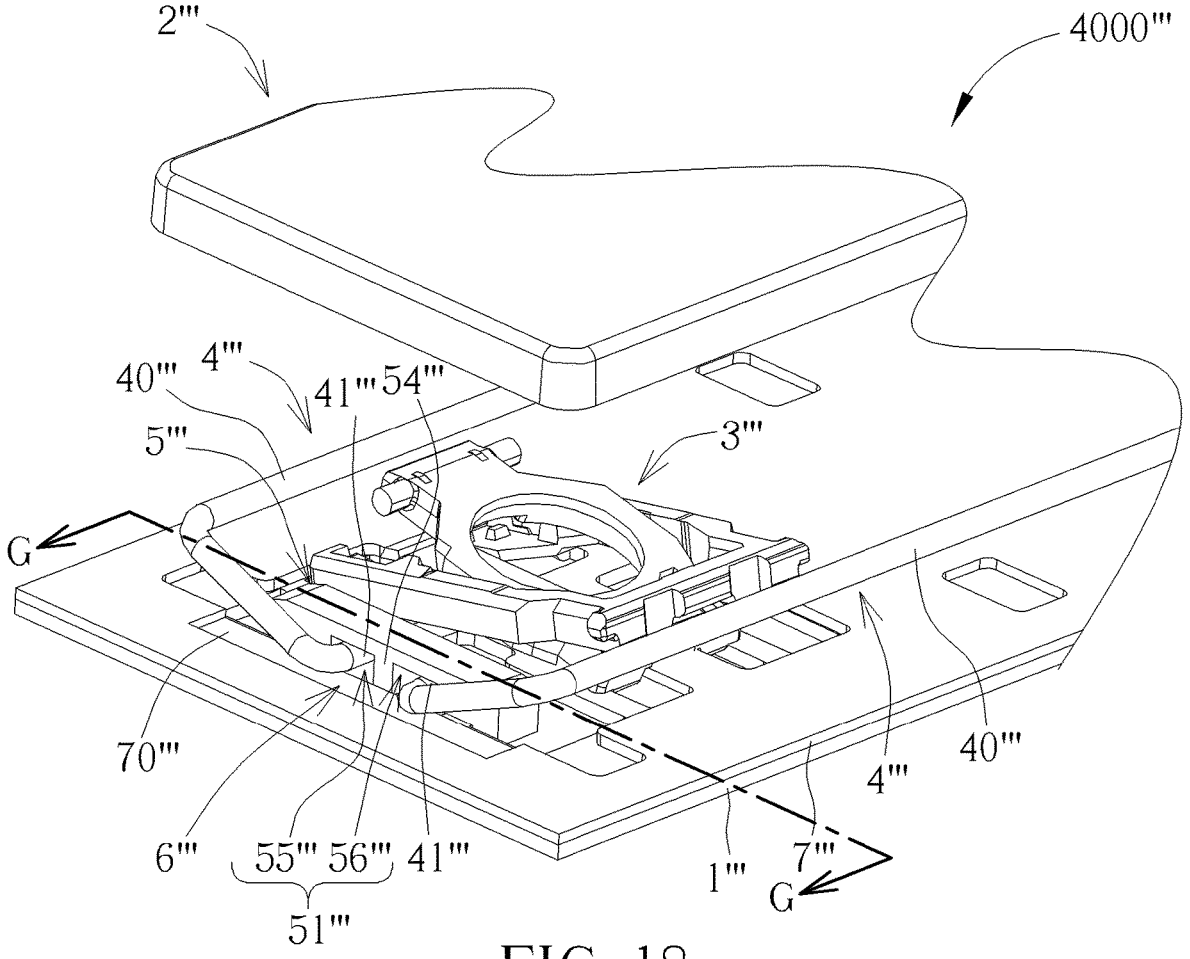
FIG. 18 is a partial exploded diagram of a keyboard according to a ninth embodiment of the present invention.
Figure 19:
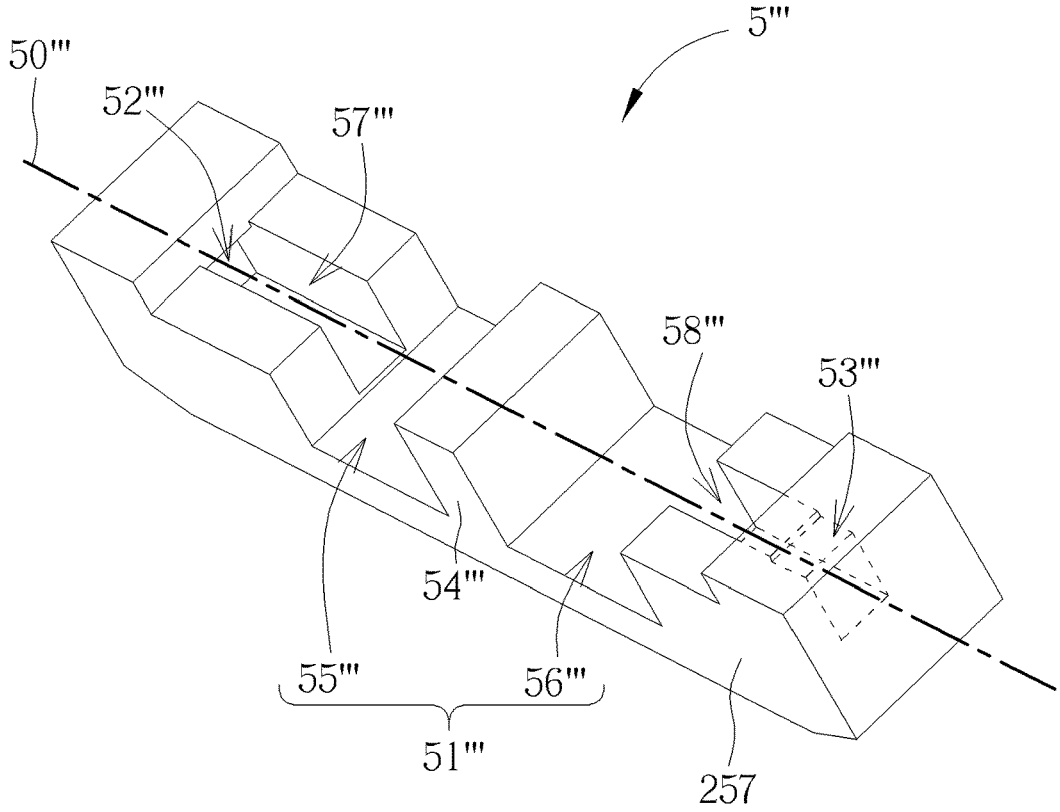
FIG. 19 is a diagram of a buffer member at another view according to the ninth embodiment of the present invention.
Figure 20:
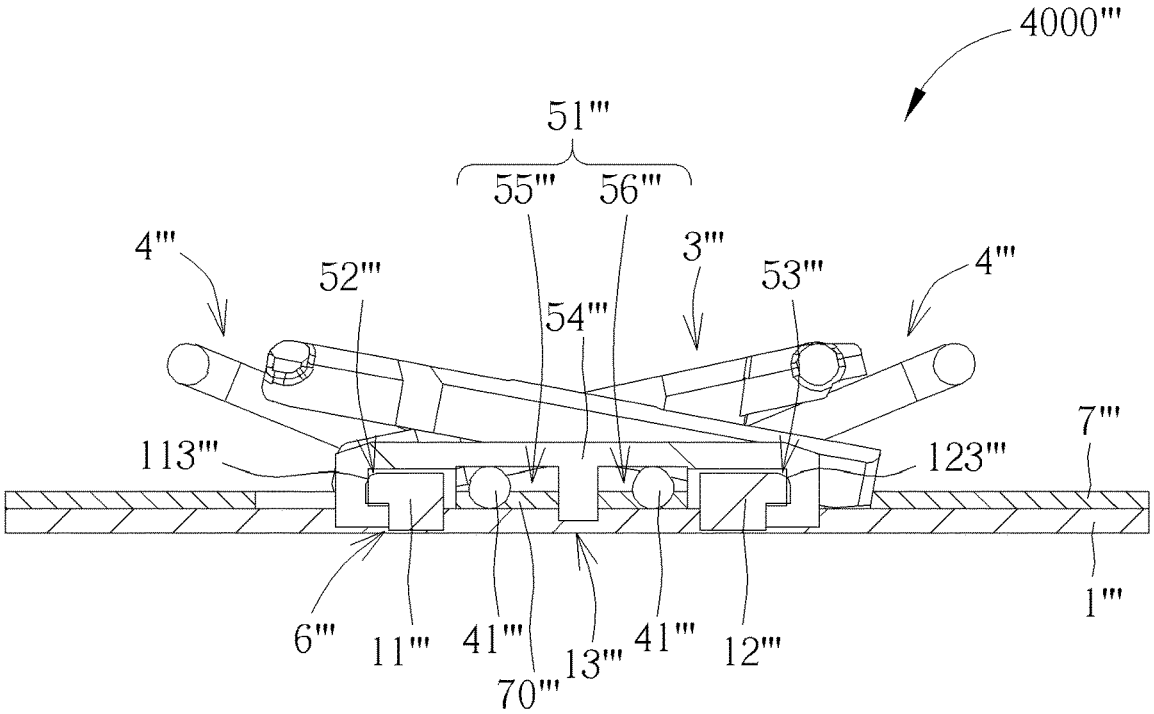
FIG. 20 is a sectional diagram of the keyboard along a G-G line shown in FIG. 18 according to the ninth embodiment of the present invention.
Figure 21:
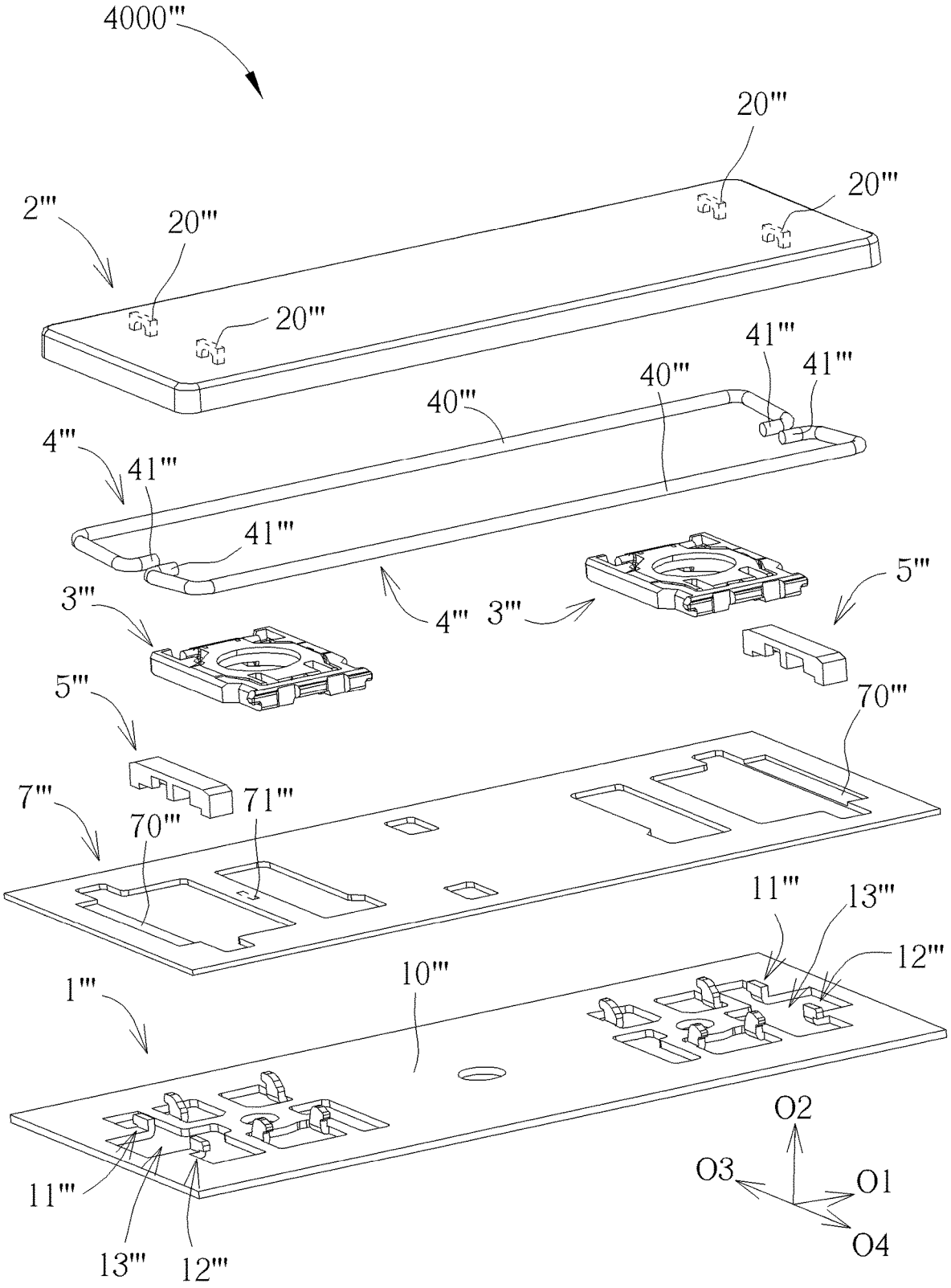
FIG. 21 is another partial exploded diagram of the keyboard according to the ninth embodiment of the present invention.
Figure 22:
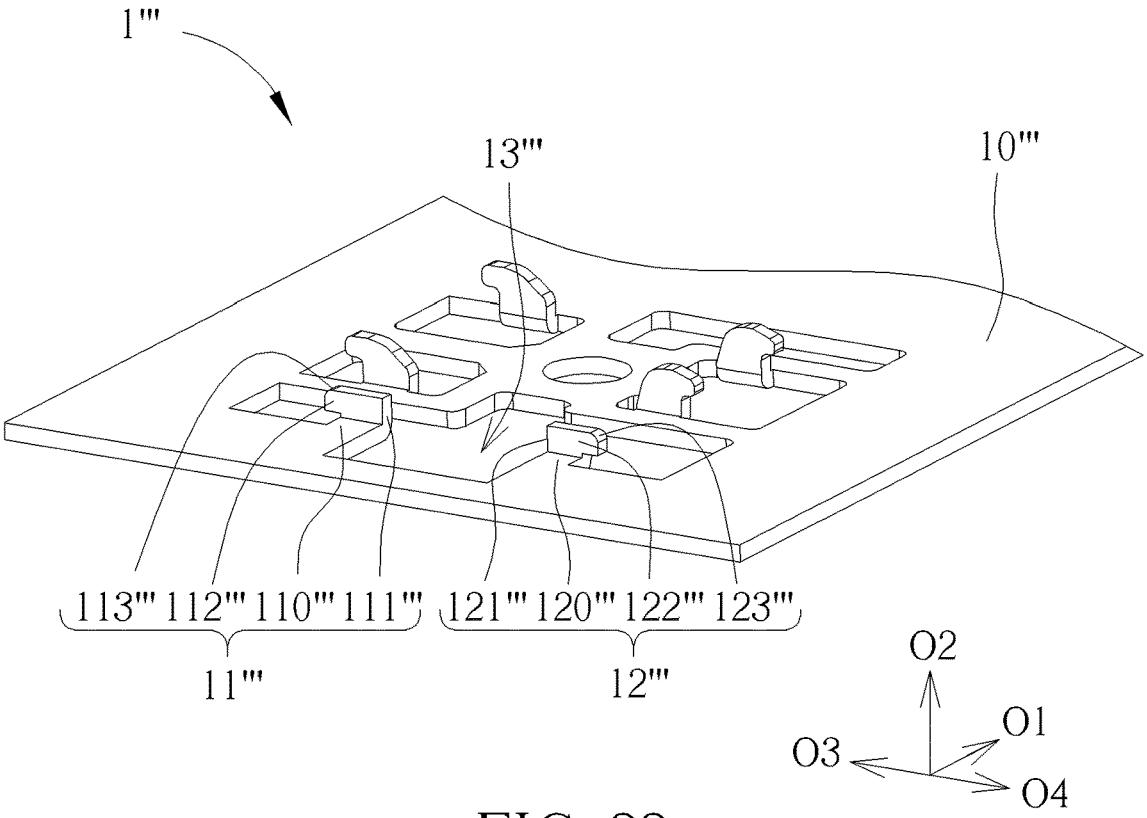
FIG. 22 and FIG. 23 are partial exploded diagrams of a base according to the ninth embodiment of the present invention.
Figure 23:
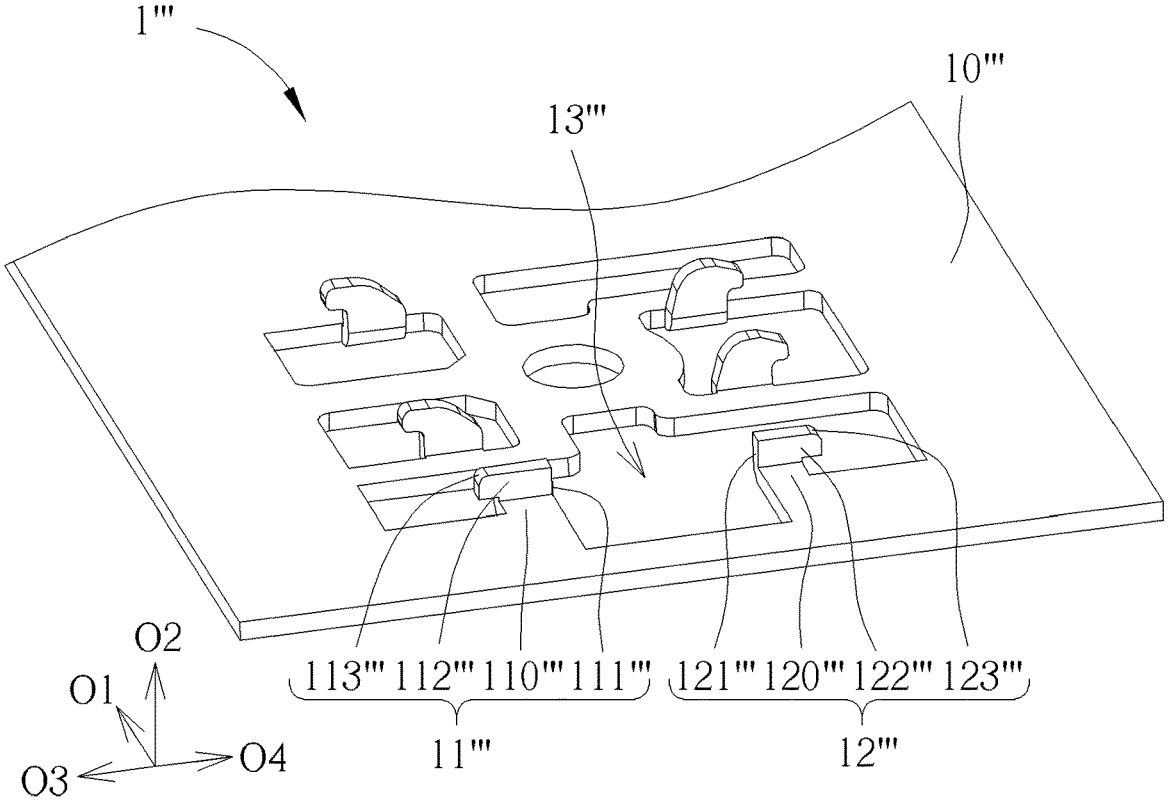

Please refer to FIG. 18 to FIG. 23. FIG. 18 is a partial exploded diagram of a keyboard 4000'" according to a ninth embodiment of the present invention. FIG. 19 is a diagram of a buffer member 5'" at another view according to the ninth embodiment of the present invention. FIG. 20 is a sectional diagram of the keyboard 4000'" along a G-G line shown in FIG. 18 according to the ninth embodiment of the present invention. FIG. 21 is another partial exploded diagram of the keyboard 4000'" according to the ninth embodiment of the present invention. FIG. 22 and FIG. 23 are partial exploded diagrams of a base 1'" according to the ninth embodiment of the present invention. As shown in FIG. 18 to FIG. 23, the keyboard 4000'" of this embodiment includes a key switch including the base 1'", a keycap 2'", a supporting mechanism 3'", a link bar 4'", the buffer member 5'" and a circuit board 7'". The buffer member 5'" and the base 1'" of the keyboard 4000'" are two independent members. The base 1'" includes a base body 10'", a first extending arm 11'", a second extending arm 12'" and an opening structure 13'". The first extending arm 11'" includes a first horizontal extending portion 110'", a first vertical extending portion 111'", a first hook 112'" and a first assembling chamfer angle structure 113'". The first horizontal extending portion 110'" is connected to the base body 10'" and extends along a first direction O1 substantially. The first vertical extending portion 111'" is connected to the first horizontal extending portion 110'" and extends along a second direction O2 perpendicular to the first direction O1 substantially. The first hook 112'" is connected to the first vertical extending portion 111'" and extends along a third direction O3 perpendicular to the first direction O1 and the second direction O2 substantially. The second extending arm 12'" includes a second horizontal extending portion 120'", a second vertical extending portion 121'", a second hook 122'" and a second assembling chamfer angle structure 123'". The second horizontal extending portion 120'" is connected to the base body 10'" and extends along the first direction O1 substantially. The second vertical extending portion 121'" is connected to the second horizontal extending portion 120'" and extends along the second direction O2 substantially. The second hook 122'" is connected to the second vertical extending portion 121'" and extends along a fourth direction O4 opposite to the third direction O3 substantially. The opening structure 13'" is formed between the first extending arm 11'" and the second extending arm 12'". The key cap 2'" is disposed above the base 1'". The supporting mechanism 3'" is disposed between the base 1'" and the key cap 2'". An upper end and a lower end of the supporting mechanism 3'" are connected to the key cap 2'" and the base 1'" respectively for supporting the key cap 2'" for allowing the key cap 2'" to move relative to the base 1'" upwardly and downwardly.

Each link bar 4'" includes an upper linking end 40'" and a lower linking end 41'". The upper linking end 40'" is movably connected to the key cap 2'". For example, the upper linking end 40'" is rotatably pivoted to a connecting structure 20'" of the key cap 2'". The circuit board 7'" includes a lower buffer portion 70'" and a switch 71'". The key cap 2'" can touch the switch 71'" for selectively activating the switch 71'" during upward and downward movement of the key cap 2'". The lower buffer portion 70'" is at least disposed or extended between the first extending arm 11'" and the second extending arm 12'" for supporting the lower linking end 41'" and disposed above the opening structure 13'". The lower buffer portion 70'" can be deformed to partially enter into the opening structure 13'" when the key cap 2'" moves relative to the base 1'" upwardly and downwardly.

The buffer member 5'" includes a buffer longitudinal axis 50'", a recess structure 51'", a first engaging portion 52'", a second engaging portion 53'" and a middle downward protrusion 54'". A first assembling slot 57'" and a second assembling slot 58'" are formed on the buffer member 5'". The first engaging portion 52'" and the second engaging portion 53'" are located at two opposite sides of the buffer longitudinal axis 50'". The buffer longitudinal axis 50'" can be a virtual axis and parallel to the third direction O3 and the fourth direction O4 substantially. The middle downward protrusion 54'" divides the recess structure 51'" into a first accommodating space 55'" and a second accommodating space 56'". The first accommodating space 55'" is located between the middle downward protrusion 54'" and the first engaging portion 52'". The second accommodating space 56'" is located between the middle downward protrusion 54'" and the second engaging portion 53'". That is, the buffer member 5'" has an E-shaped cross section along the buffer longitudinal axis 50'" substantially. The first assembling slot 57'" is communicated with the first engaging portion 52'".

When the first extending arm 11''' enters into the first assembling slot 57''', the first hook 112''' engages with the first engaging portion 52'''. The second assembling slot 58''' is communicated with the second engaging portion 53'''. When the second extending arm 12''' enters into the second assembling slot 58''', the second hook 122''' engages with the second engaging portion 53'''. When the first extending arm 11''' and the second extending arm 12''' enter into the first assembling slot 57''' and the second assembling slot 58''' respectively, an upper surface of the first hook 112''' and an upper surface of the second hook 122''' are hidden by an upper surface of the buffer member 5'''.

Furthermore, when the first engaging portion 52''' and the second engaging portion 53''' engage with the first hook 112''' and the second hook 122''', the base 1''' is adjacent to the first accommodating space 55''' and the second accommodating space 56''' of the recess structure 51''' to form a restraining structure 6'''. The lower linking end 41''' movably passes through the restraining structure 6'''. When the key cap 2''' moves relative to the base 1''' upwardly and downwardly, the lower linking end 41''' moves within the restraining structure 6''' correspondingly. The buffer member 5''' restrains an upper surface of the lower linking end 41''', and the lower buffer portion 70''' restrains a lower surface of the lower linking end 41'''.

Figure 24:
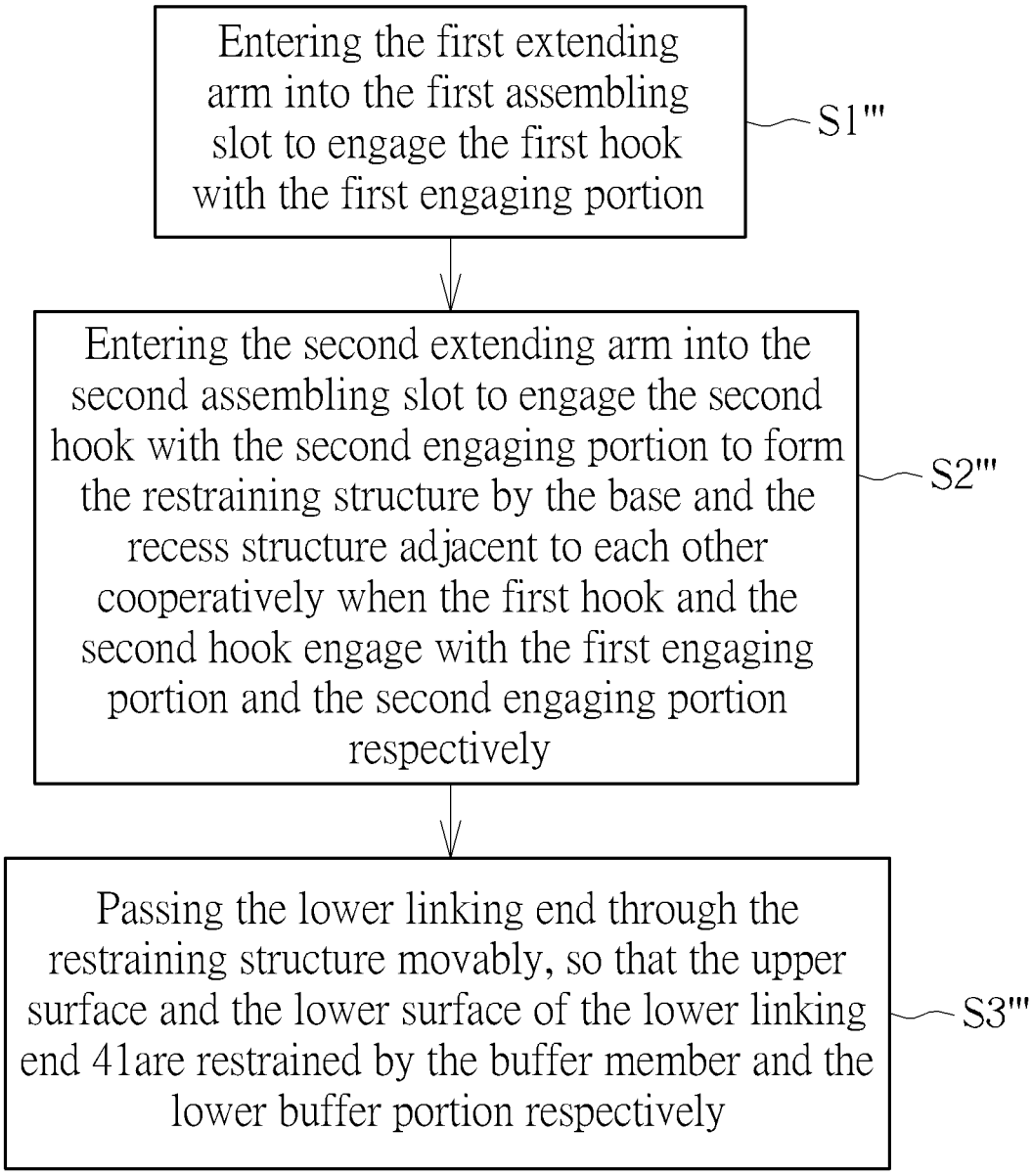
FIG. 24 is a flowchart diagram illustrating an assembly method of a key switch of the keyboard according to the ninth embodiment of the present invention.

Please further refer to FIG. 24. FIG. 24 is a flow chart diagram illustrating an assembly method of the key switch of the keyboard 4000''' according to the ninth embodiment of the present invention. As shown in FIG. 24, the assembly method includes the following steps:

S1''': entering the first extending arm 11''' into the first assembling slot 57''' to engage the first hook 112''' with the first engaging portion 52''';

S2''': entering the second extending arm 12''' into the second assembling slot 58''' to engage the second hook 122''' with the second engaging portion 53''' to form the restraining structure 6''' by the base 1''' and the recess structure 51''' adjacent to each other cooperatively when the first hook 112''' and the second hook 122''' engage with the first engaging portion 52''' and the second engaging portion 53''' respectively; and S3''': passing the lower linking end 41''' through the restraining structure 6''' movably, so that the upper surface and the lower surface of the lower linking end 41''' are restrained by the buffer member 5''' and the lower buffer portion 70''' respectively.

Detailed description of the assembly method the key switch of the keyboard 4000''' and operational principle of the key switch of the keyboard 4000''' is described as follows. During assembly of the key switch of the keyboard 4000''', the lower end of the supporting mechanism 3''' can be connected to the base 1''' firstly. After assembly of the buffer member 5''', the base 1''' and the link bar 4''', which is described as follows, the upper end of the supporting mechanism 3''' can be connected to the key cap 2''', which prevents the key cap 2''' from interfering the assembly of the buffer member 5''', the base 1''' and the link bar 4'''.

Since the buffer member 5''' can be made of soft material, such as rubber material, the buffer member 5''' can be forced to deform to allow the first extending arm 11''' and the second extending arm 12''' to enter the first assembling slot 57''' and the second assembling slot 58''' respectively. The first engaging portion 52''' and the second engaging portion 53''' of the buffer member 5''' can be guided by the first assembling chamfer angle structure 113''' and the second assembling chamfer angle structure 123''' to engage with the first hook 112''' and the second hook 122''' of the base 1''' respectively, so that the base 1''' and the recess structure 51''' are adjacent to form the restraining structure 6''' (steps S1''' and S2'''). Afterwards, the lower linking end 41''' of the link bar 4''' can movably pass through the restraining structure 6''' (step S3'''). In such a way, when the keycap 2''' moves relative to the base 1''' upwardly and downwardly, the lower linking end 41''' moves within the restraining structure 6''' correspondingly. At this moment, the buffer member 5''' restrains the upper surface of the lower linking end 41''', and the lower buffer portion 70''' restrains the lower surface of the lower linking end 41'''. Therefore, it can reduce the noise during movement of the lower linking end 41''' relative to the base 1'''.

Furthermore, in this embodiment, the first hook 112''' and the second hook 122''' extend along two opposite directions for providing restraint indifferent directions. In other words, the first extending arm 11''' includes a first longitudinal axis along a first longitudinal direction, and the second extending arm 12''' includes a second longitudinal axis along a second longitudinal direction substantially opposite to the first longitudinal direction. Such structural design can prevent the first hook 112''' and the second hook 122''' from disengaging from the first engaging portion 52''' and the second engaging portion 53''' when the keyboard 4000''' receives an impact along only one single direction. Besides, the opening structure 13''' can not only allow the lower buffer portion 70''' to be deformed to partially enter for preventing interference between the lower linking end 41''' of the link bar 4''' and the base 1''' when the lower linking end 41''' of the link bar 4''' moves within the restraining structure 6''', but also decrease an overall height of the keyboard 4000'''.

Figure 25:
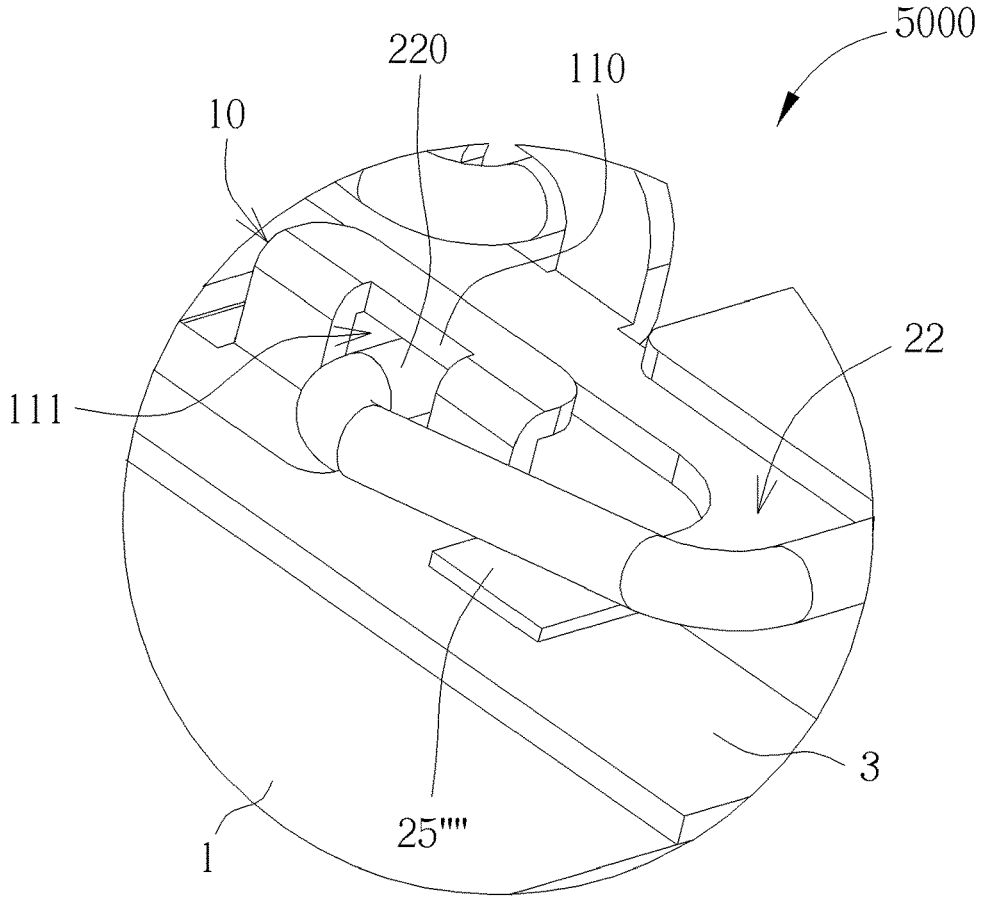
FIG. 25 is a partial enlarged diagram of a keyboard according to a tenth embodiment of the present invention.

Please refer to FIG. 25. FIG. 25 is a partial enlarged diagram of a keyboard 5000 according to a tenth embodiment of the present invention. As show in FIG. 25, different from the aforementioned embodiments, a buffer member 25'''' of the keyboard 5000 is disposed on the circuit board 3 and located at a position corresponding to the lower linking end 220 of the link bar 22. In this embodiment, the buffer member 25'''' can be made of resilient material, such as rubber material, and the buffer member 25'''' can provide a resilient recovering force by deformation for driving the lower linking end 220 to abut against the wall of the engaging hole 11 on the engaging structure 10 of the base 1. In such a way, the buffer member 25'''' can reduce a gap between the lower linking end 220 and the wall of the engaging hole 11, so as to reduce the noise due to collision of the lower linking end 220 and the engaging structure 10. Elements that have the same structures and functions as that illustrated in the aforementioned embodiment are provided with the same item numbers in this embodiment. Detailed description is omitted herein for simplicity.

Figure 26:
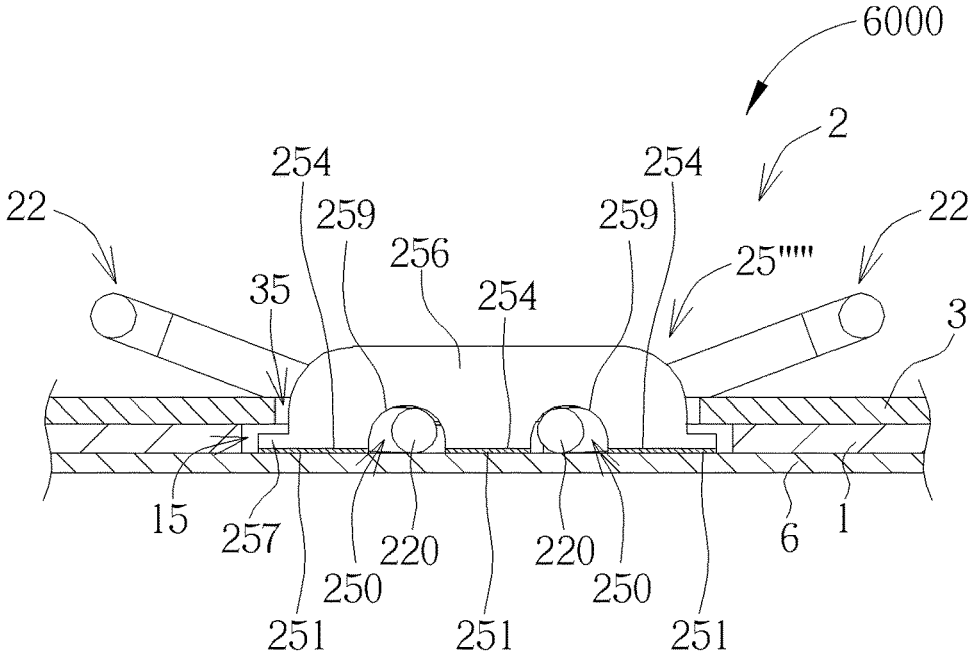
FIG. 26 is a sectional diagram of a keyboard according to an eleventh embodiment of the present invention.

Please refer to FIG. 26. FIG. 26 is a sectional diagram of a keyboard 6000 according to an eleventh embodiment of the present invention. As shown in FIG. 26, different from the aforementioned embodiments, the keyboard 6000 of this embodiment can be a light emitting keyboard. In other words, the keyboard 6000 further includes a backlight module 6. A buffer member 25''''' of the keyboard 6 is disposed on the backlight module 6. Furthermore, an accommodating opening 15 is formed on the base 1. The through slot 35 is formed on the circuit board 3 and located at a position corresponding to the accommodating opening 15. The buffer member 25''''' includes a main body 256 and a combining portion 257. The main body 256 passes through the accommodating opening 15 on the base 1 and the through slot 35 on the circuit board 3 to protrude from the upper surface 34 of the circuit board 3. The restraining hole 250 is formed on the main body 256. The combining portion 257 is connected to the main body 256 and abuts against the base 1. The buffer member 25'''' is attached onto the backlight module 6. When the buffer member 25'''' is fixed on the backlight module 6, the combining portion 257 and a part of the main body 256 are accommodated within the accommodating opening 15. Elements that have the same structures and functions as that illustrated in the aforementioned embodiment are provided with the same item numbers in this embodiment. Detailed description is omitted herein for simplicity.

Figure 27:
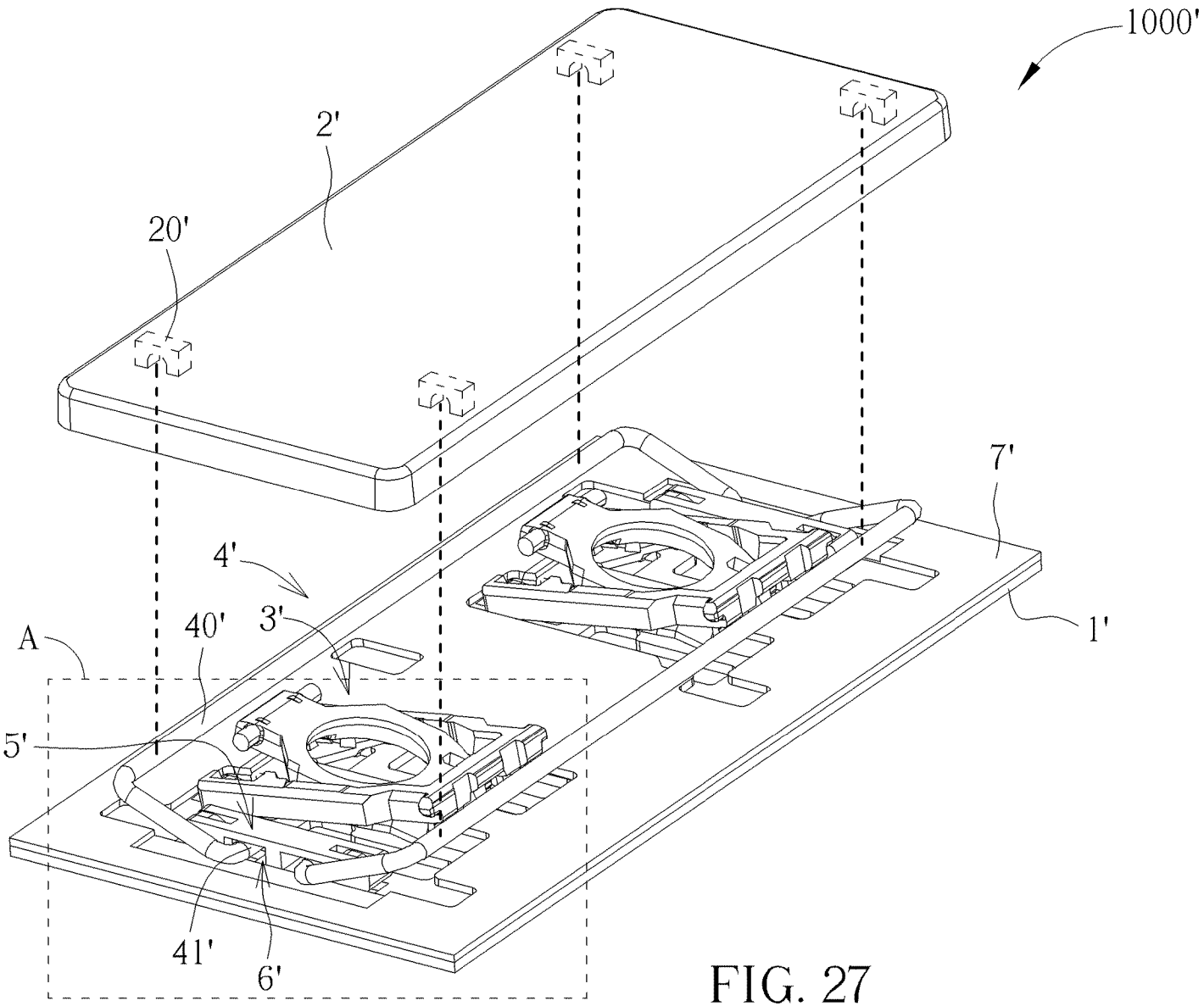
FIG. 27 is a partial exploded diagram of a key switch according to a twelfth embodiment of the present invention.

Please refer to FIG. 27. FIG. 27 is a partial exploded diagram of a key switch 1000' according to a twelfth embodiment of the present invention. As shown in FIG. 27, the key switch 1000' includes a base 1', a key cap 2', a supporting mechanism 3', a link bar 4', a buffer member 5' and a circuit board 7'. The key cap 2' is disposed above the base 1'. The supporting mechanism 3' is disposed between the base 1' and the key cap 2'. An upper end and a lower end of the supporting mechanism 3' are connected to the key cap 2' and the base 1' to allow the key cap 2' to move relative to the base 1' upwardly and downwardly. The circuit board 7' is disposed on the base 1' and includes a switch, which is not shown in the figures. When the key cap 2' is pressed downwardly, the switch can be activated to execute a corresponding input command. The link bar 4' includes an upper linking end 40' and two lower linking ends 41'. The two lower linking ends 41' are located at two opposite sides of the upper linking end 40'. The key cap 2' includes a connecting structure 20'. The upper linking end 40' is rotatably pivoted to the connecting structure 20', so that the link bar 4' is connected to the key cap 2'. The buffer member 5' is disposed on the base 1', so that the buffer member 5' and the base 1' can form a restraining structure 6' cooperatively. The lower linking end 41' is movably disposed within the restraining structure 6'. In this embodiment, the key switch 1000' can be a key switch whose width is much greater than its length, such as a Caps Lock key, a Shift key or an Enter key on a standard keyboard.

Figure 28:
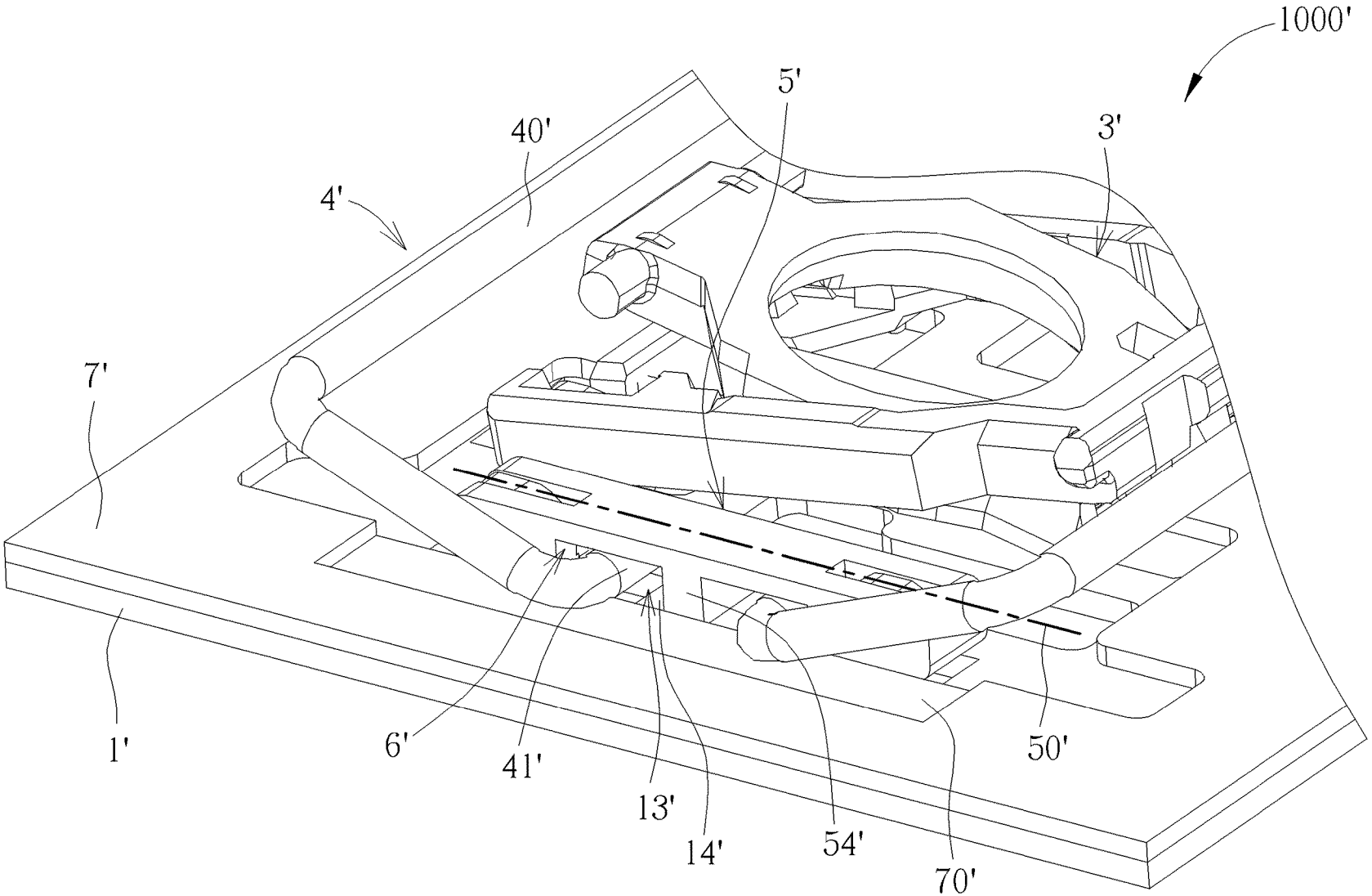
FIG. 28 is a partial enlarged diagram of an A portion of the key switch shown in FIG. 27 according to the twelfth embodiment of the present invention.
Figure 29:
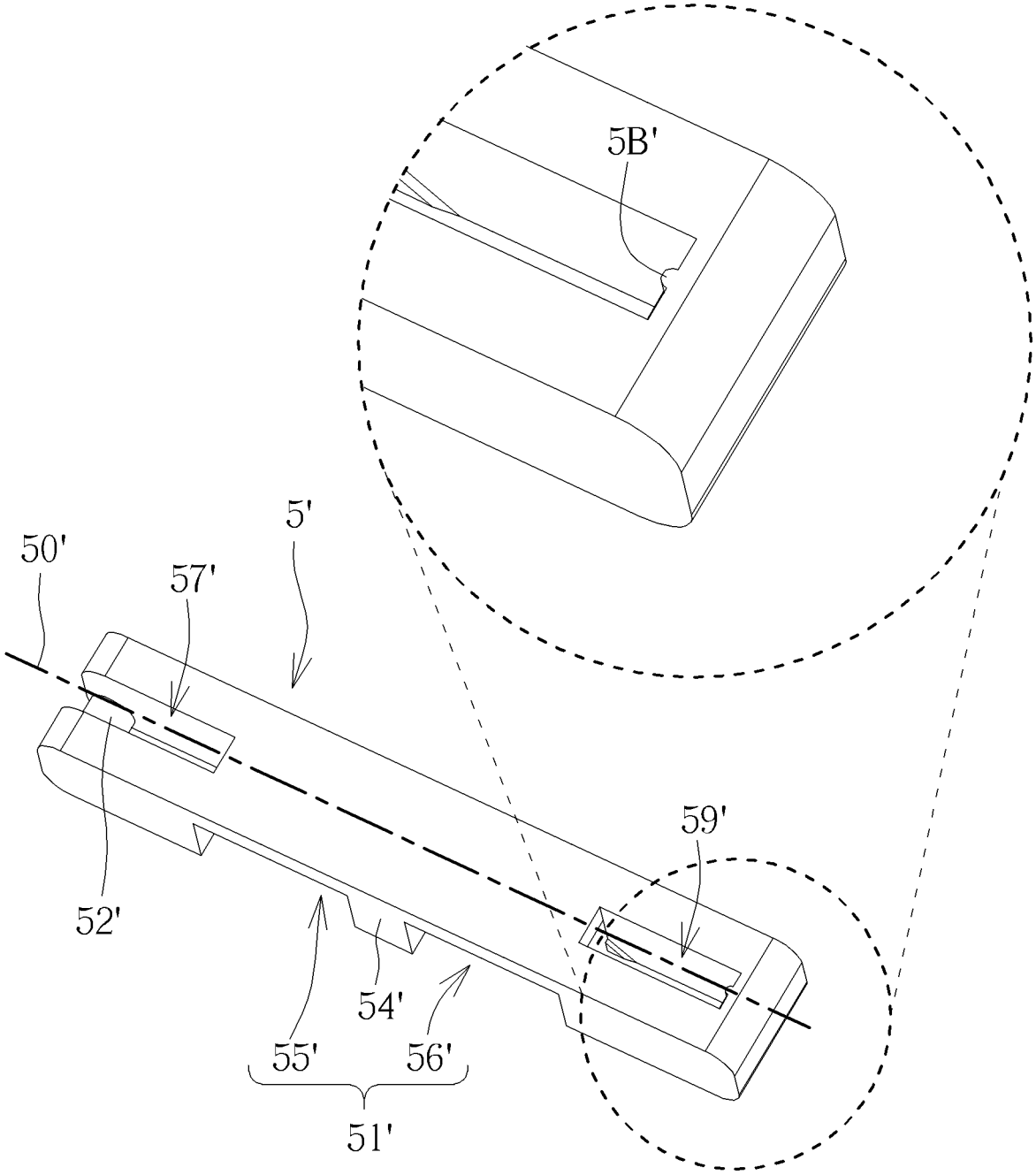
FIG. 29 is a diagram of a buffer member according to the twelfth embodiment of the present invention.
Figure 30:
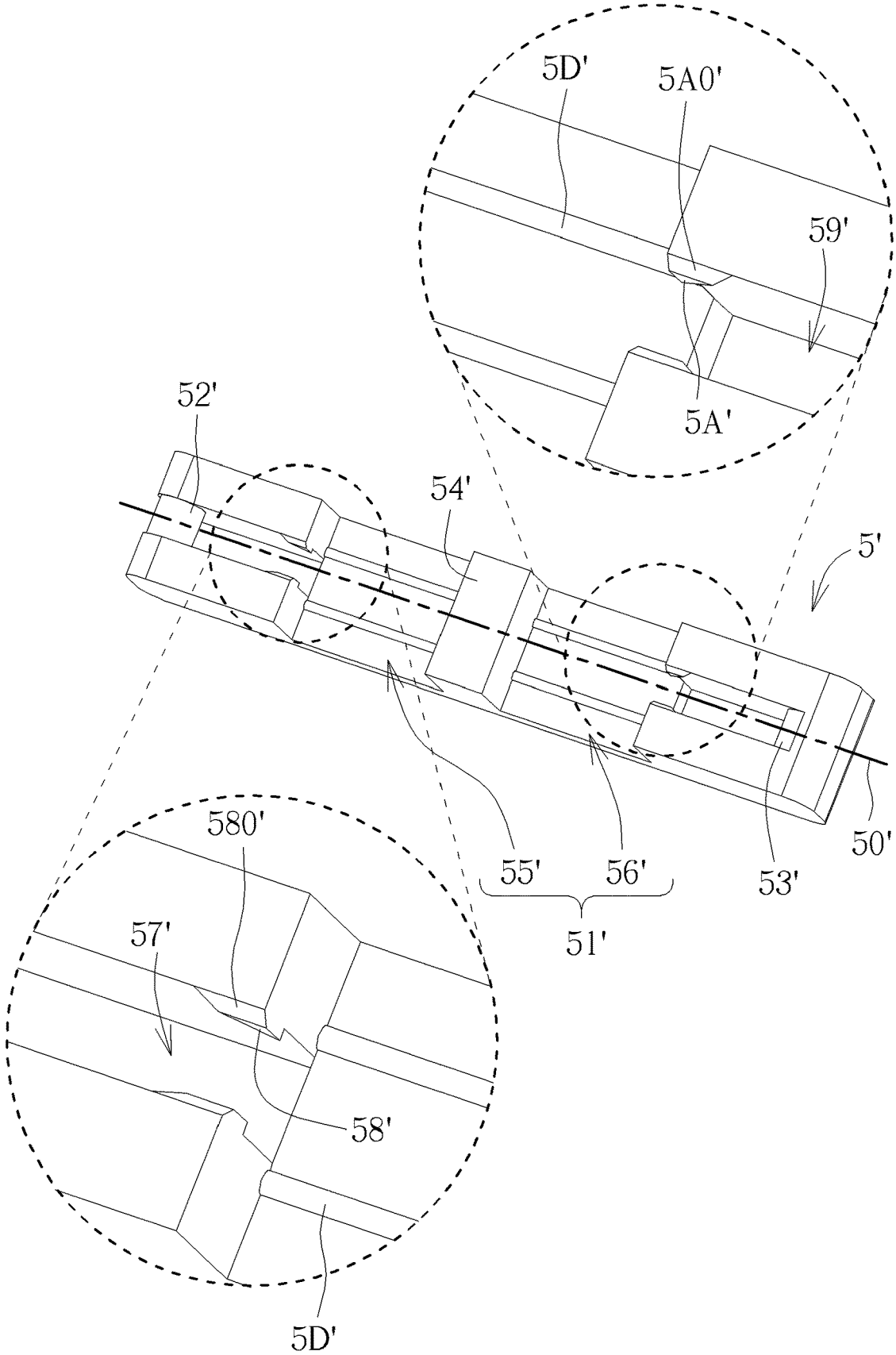
FIG. 30 is a diagram of the buffer member at another view according to the twelfth embodiment of the present invention.
Figure 31:
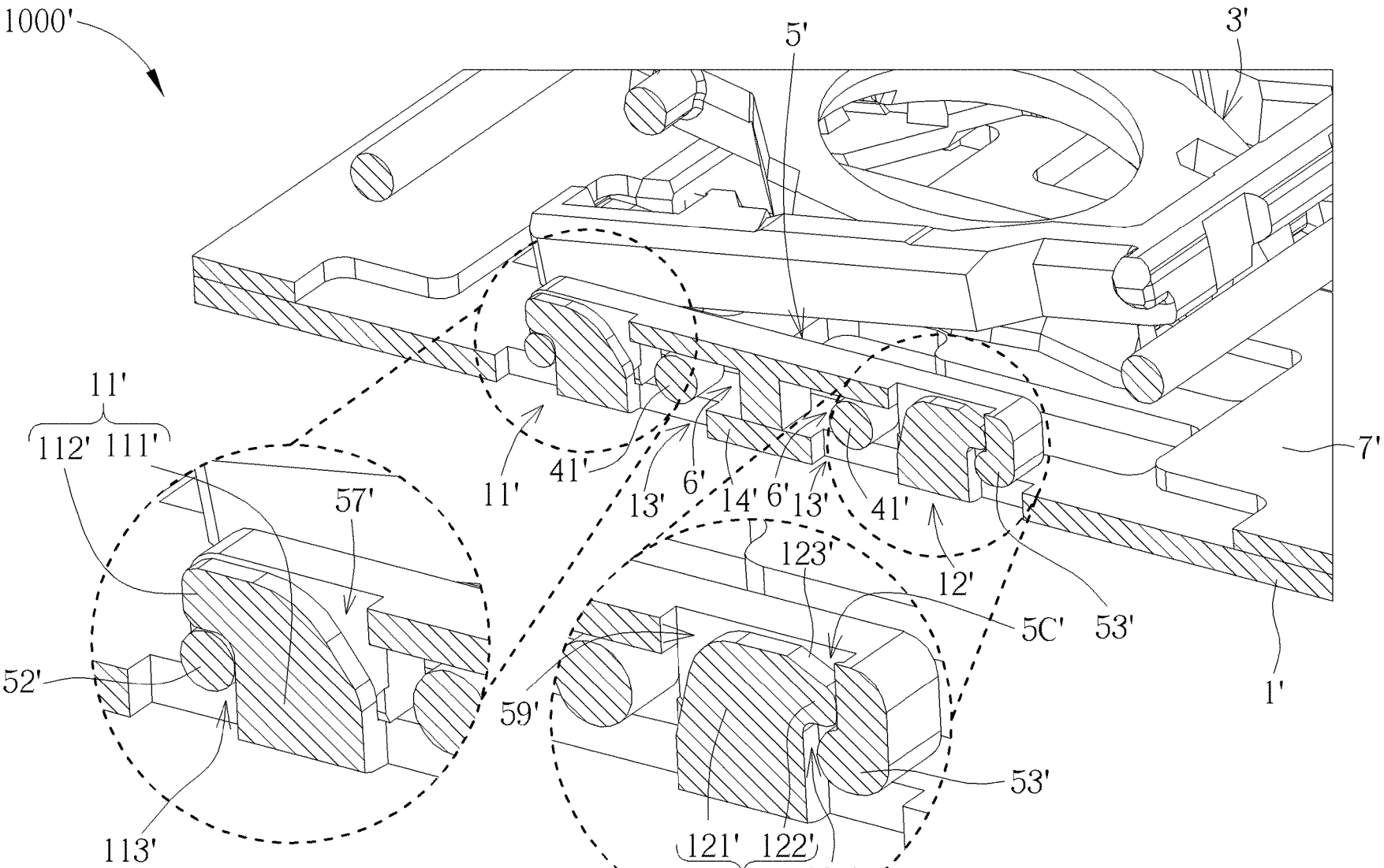
FIG. 31 is a sectional diagram of the key switch shown in FIG. 28 according to the twelfth embodiment of the present invention.
Figure 32:
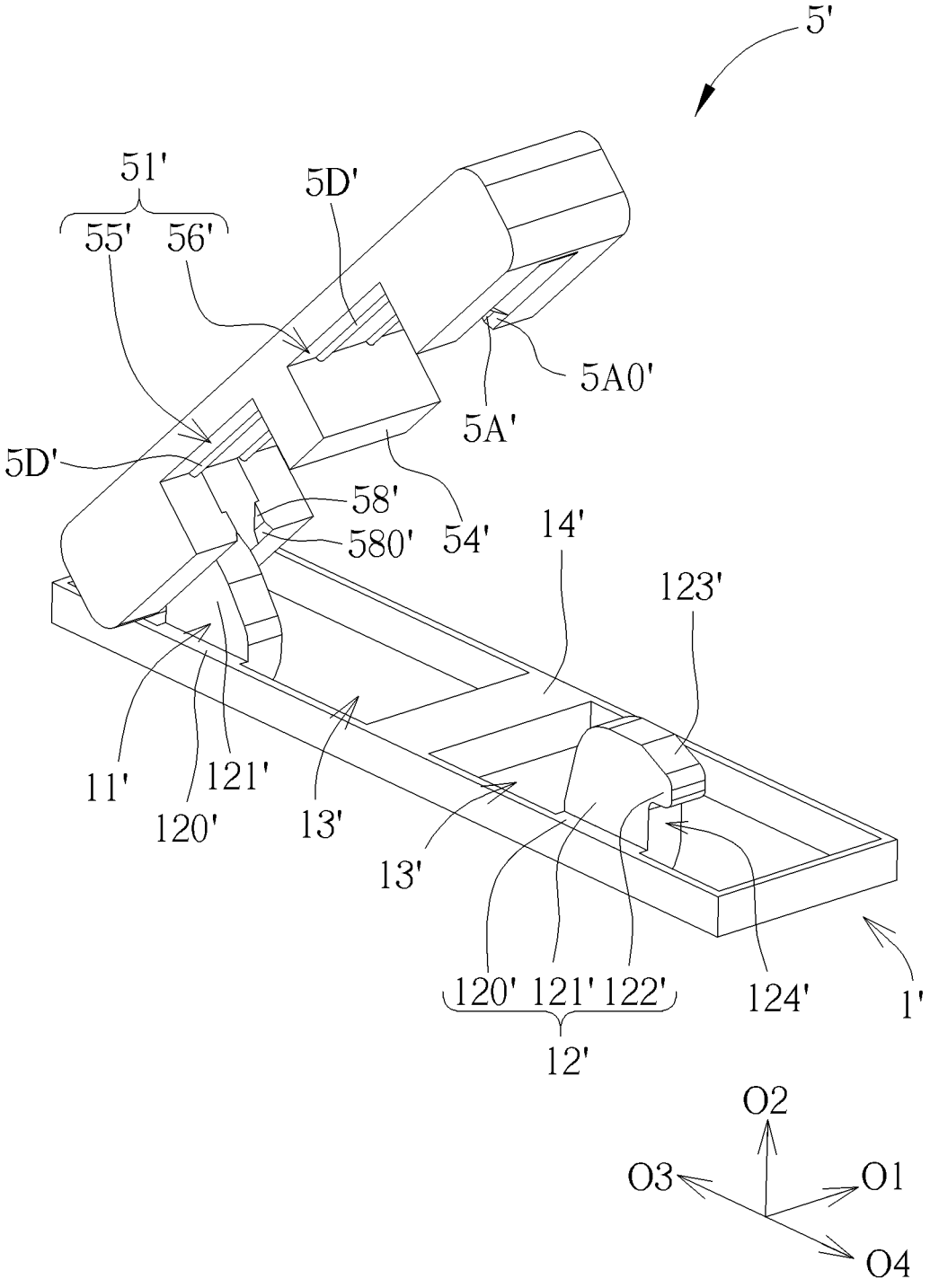
FIG. 32 is a diagram of the buffer member located at a first installation position relative to a base according to the twelfth embodiment of the present invention.

Please refer to FIG. 28 to FIG. 32. FIG. 28 is a partial enlarged diagram of an A portion of the key switch 1000' shown in FIG. 27 according to the twelfth embodiment of the present invention. FIG. 29 is a diagram of the buffer member 5' according to the twelfth embodiment of the present invention. FIG. 30 is a diagram of the buffer member 5' at another view according to the twelfth embodiment of the present invention. FIG. 31 is a sectional diagram of the key switch 1000' shown in FIG. 28 according to the twelfth embodiment of the present invention. FIG. 32 is a diagram of the buffer member 5' located at a first installation position relative to the base 1' according to the twelfth embodiment of the present invention. As shown in FIG. 28 to FIG. 32, the base 1' includes a base body 10', a first extending arm 11' and a second extending arm 12'. The first extending arm 11' includes a first horizontal extending portion 110', a first vertical extending portion 111' and a first hook 112'. The first horizontal extending portion 110' is connected to the base body 10' and extends along the first direction O1 substantially. The first vertical extending portion 111' is connected to the first horizontal extending portion 110' and extends along the second direction O2 substantially. The first hook 112' is connected to the first vertical extending portion 111' and extends along the third direction O3 substantially. The second extending arm 12' includes a second horizontal extending portion 120', a second vertical extending portion 121' and a second hook 122'. The second horizontal extending portion 120' is connected to the base body 10' and extends along the first direction O1 substantially. The second vertical extending portion 121' is connected to the second horizontal extending portion 120' and extends along the second direction O2 substantially. The second hook 122' is connected to the second vertical extending portion 121' and extends along the fourth direction O4 opposite to the third direction O3.

The buffer member 5' includes a buffer longitudinal axis 50', a recess structure 51', a first engaging portion 52' and a second engaging portion 53'. The buffer longitudinal axis 50' can be a virtual axis. The first engaging portion 52' and the second engaging portion 53' are located at two opposite ends of the buffer longitudinal axis 50'. In this embodiment, the buffer member 5' is made of material softer than material of the base 1'. For example, the base 1' can be made of metal material, and the buffer member 5' can be made of rubber material.

Furthermore, the buffer member 5' further includes a middle downward protrusion 54'. The middle downward protrusion 54' divides the recess structure 51' into a first accommodating space 55' and a second accommodating space 56'. The first accommodating space 55' is located between the middle downward protrusion 54' and the first engaging portion 52'. The second accommodating space 56' is located between the middle downward protrusion 54' and the second engaging portion 53'. Therefore, the buffer member 5' has an E-shaped cross section along the buffer longitudinal axis 50' substantially. Furthermore, the base 1' further includes an opening structure 13' and a central extending portion 14'. The opening structure 13' is formed between the first extending arm 11' and the second extending arm 12' and aligned with the recess structure 51'. The central extending portion 14' is located in a middle portion of the opening structure 13' and aligned with the middle downward protrusion 54'. In this embodiment, the opening structure 13' is divided by the central extending portion 14' into two partitions aligned with the first accommodating space 55' and the second accommodating space 56' of the recess structure 51'. The circuit board 7' further includes a lower buffer portion 70'. The lower buffer portion 70' is at least disposed or extended between the first extending arm 11' and the second extending arm 12' for providing support for the lower linking end 41' and disposed above the opening structure 13'. In such a way, when the buffer member 5' is disposed on the base 1' to form the restraining structure 6' by the first accommodating space 55' and the second accommodating space 56' of the recess structure 51' and the base 1' adjacent to each other. The opening structure 13' can prevent interference between the lower linking end 41' of the link bar 4' and the base 1' when the lower linking end 41' moves within the restraining structure 6'. When the key cap 2' moves relative to the base 1' upwardly and downwardly, the lower buffer portion 70' is deformed to partially enter into the opening structure 13'. Furthermore, the central extending portion 14' abuts against the middle downward protrusion 54', so that the buffer member 5' can be supported by the base 1'.

Besides, a first assembling slot 57' and a second assembling slot 59' are formed on the buffer member 5'. The first assembling slot 57' and the second assembling slot 59' vertically penetrate through the buffer member 5'' substantially. A pivoting space 113' is formed between the first hook 112' and the first vertical extending portion 111'. When the first extending arm 11' enters into the first assembling slot 57', the first engaging portion 52' enters into the pivoting space 113' to rotatably engage with the first hook 112'. At this moment, the first engaging portion 52' abuts against a lower surface of the first hook 112'. An engaging space 124' is formed between the second hook 122' and the second vertical extending portion 121'. When the second extending arm 12' enters into the second assembling slot 59', the second engaging portion 53' enters into the engaging space 124' to engage with the second hook 122'. At this moment, the second engaging portion 53' abuts against a lower surface of the second hook 122'. Furthermore, the second extending arm 12' further includes an assembling chamfer angle structure 123' for guiding the second engaging portion 53' to engage with the second hook 122', which is convenient in assembly.

Figure 37:
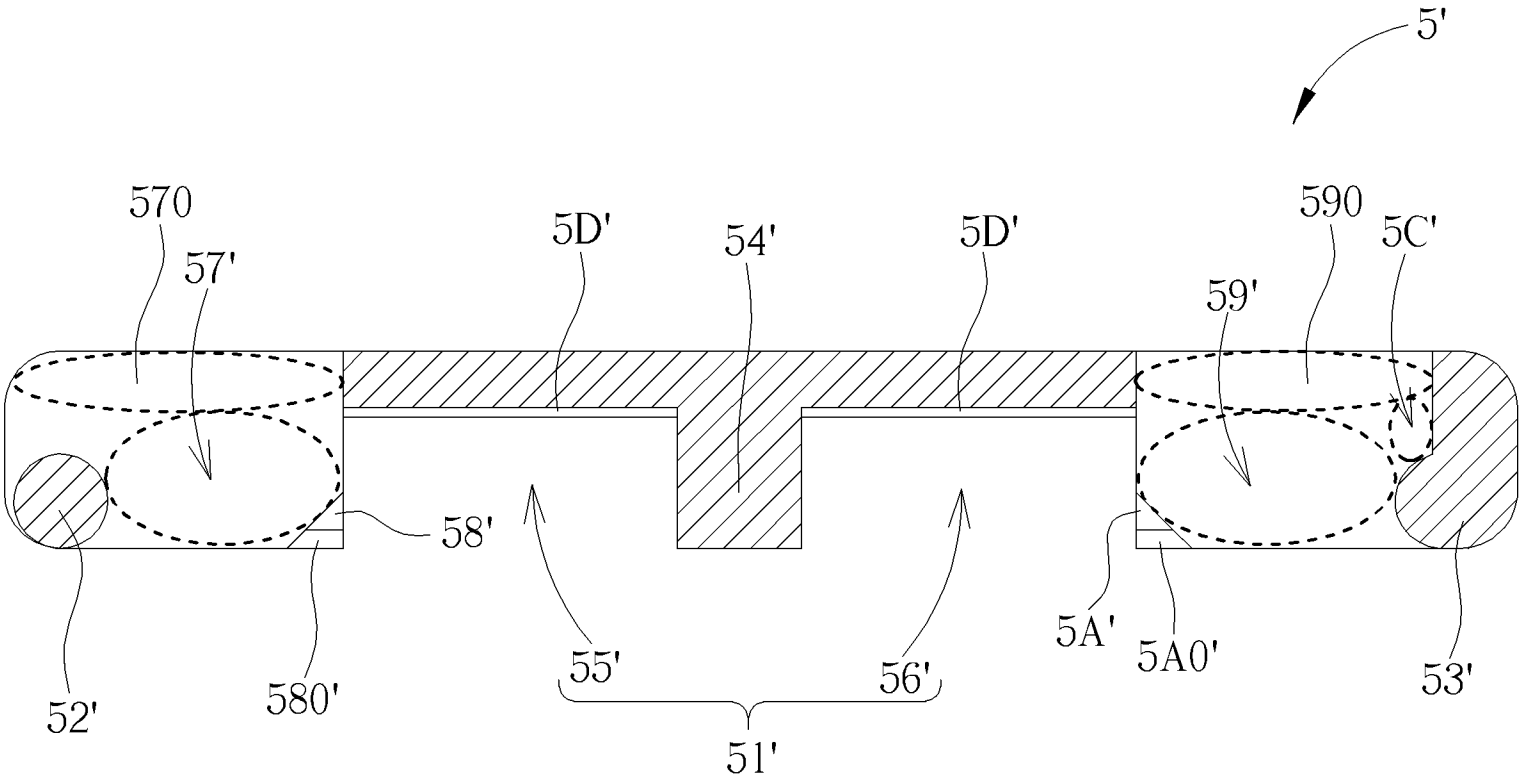
FIG. 37 is a sectional diagram of the buffer member according to the twelfth embodiment of the present invention.

Please refer to FIG. 28 to FIG. 31 and FIG. 37. FIG. 37 is a sectional diagram of the buffer member 5' according to the twelfth embodiment of the present invention. As shown in FIG. 28 to FIG. 31 and FIG. 37, an accommodating slot 5C' is formed on the buffer member 5'. The buffer member 5' further includes a buffer rib 5D', a first restraining protrusion 58', a second restraining protrusion 5A' and a restraining rib 5B'. The first restraining protrusion 58' protrudes from a wall of the first assembling slot 57' and includes a first chamfer angle structure 580'. The second restraining protrusion 5A' protrudes from a wall of the second assembling slot 59' and includes a second chamfer angle structure 5A0'. The accommodating slot 5C' is communicated with the second assembling slot 59'. It should be noticed that, as shown in FIG. 37, the first assembling slot 57' and the second assembling slot 59' vertically penetrate the buffer member 5' substantially. That is, the first assembling slot 57' and the second assembling slot 59' respectively have a first assembling opening 570 and a second assembling opening 590 formed on an upper surface of the buffer member 5' for allowing an upper surface of the first hook 112' and an upper surface of the second hook 122' to be exposed out of the upper surface of the buffer member 5' for reducing a height of the buffer member 5 when the buffer member 5' is combined with the first extending arm 11' and the second extending arm 12'. The restraining rib 5B' is disposed inside the accommodating slot 5C'. When the second hook 122' enters into the accommodating slot 5C' to engage with the second engaging portion 53', the restraining rib 5B' abuts against the second hook 122'. The buffer rib 5D' is disposed inside the restraining structure 6'. The buffer rib 5D' restrains the lower linking end 41' to reduce the noise during movement of the lower linking end 41' relative to the base 1'.

Figure 33:
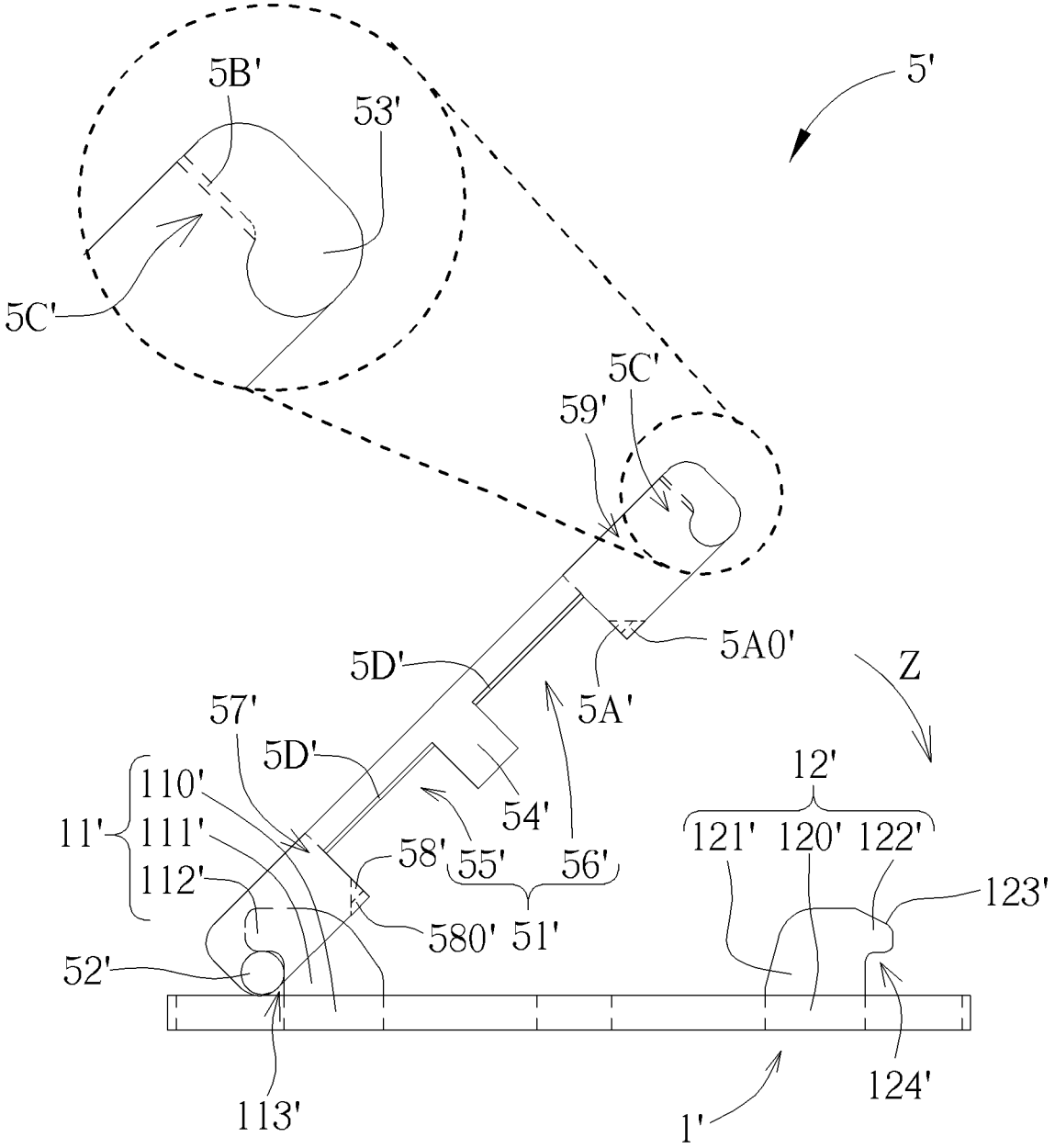
FIG. 33 is a side view diagram of the buffer member located at the first installation position relative to the base according to the twelfth embodiment of the present invention.
Figure 34:
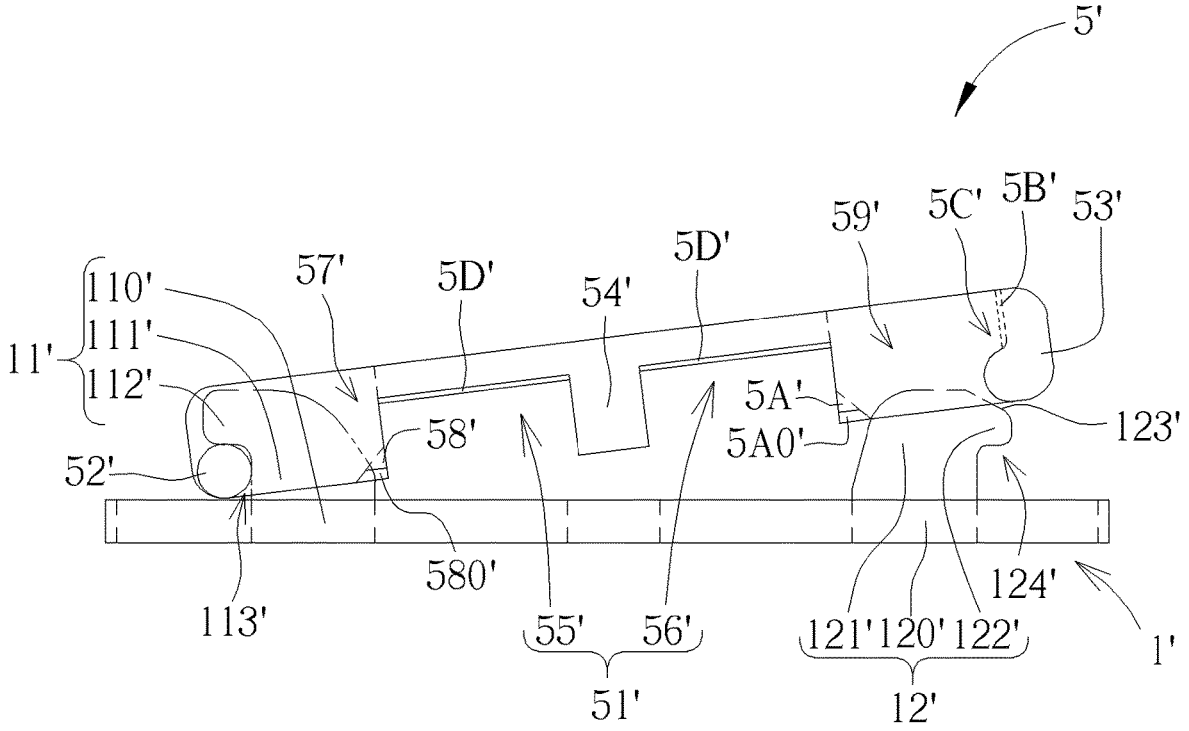
FIG. 34 is a side view diagram of the buffer member located at a second installation position relative to the base according to the twelfth embodiment of the present invention.
Figure 35:
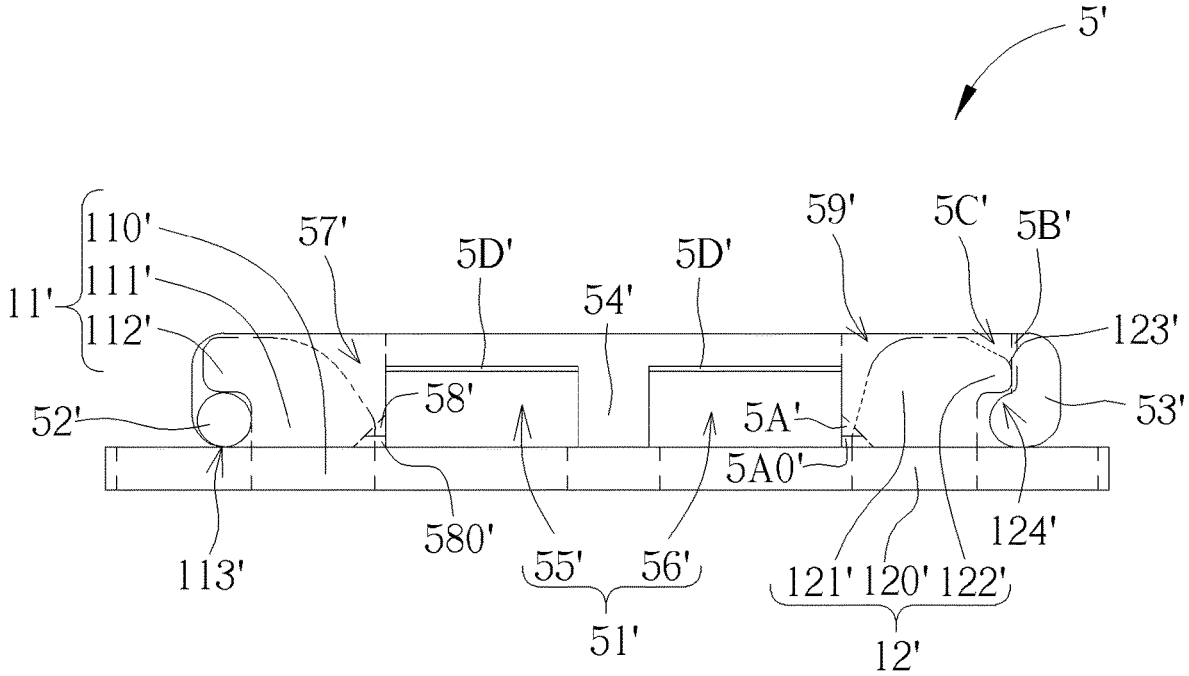
FIG. 35 is a side view diagram of the buffer member located at a third installation position relative to the base according to the twelfth embodiment of the present invention.
Figure 36:
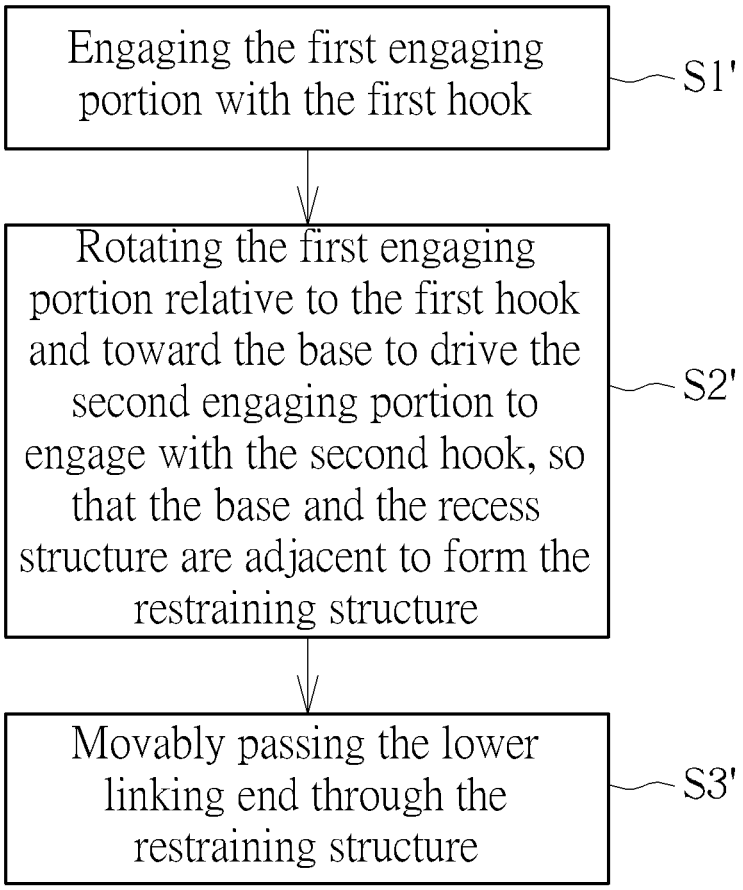
FIG. 36 is a flow chart diagram illustrating an assembly method of the key switch according to the twelfth embodiment of the present invention.

Please refer to FIG. 32 to FIG. 36. FIG. 33 is a side view diagram of the buffer member 5' located at the first installation position relative to the base 1' according to the twelfth embodiment of the present invention. FIG. 34 is a side view diagram of the buffer member 5' located at a second installation position relative to the base 1' according to the twelfth embodiment of the present invention. FIG. 35 is a side view diagram of the buffer member 5' located at a third installation position relative to the base 1' according to the twelfth embodiment of the present invention. FIG. 36 is a flow chart diagram of an assembly method of the key switch 1000' according to the twelfth embodiment of the present invention. As shown in FIG. 36, the assembly method of the key switch 1000' includes the following steps:

S1': engaging the first engaging portion 52' with the first hook 112';

S2': rotating the first engaging portion 52' relative to the first hook 112' and toward the base 1' to drive the second engaging portion 53' to engage with the second hook 122', so that the base 1' and the recess structure 51' are adjacent to form the restraining structure 6'; and S3': movably passing the lower linking end 41' through the restraining structure 6'.

Detailed description of the assembly method and operational principle of the present invention is described as follows. The lower end of the supporting mechanism 3' is connected to the base 1' firstly. After assembly of the buffer member 5', base 1' and the link bar 4', which is described as follows, the upper end of the supporting mechanism 3' can be connected to the key cap 2', which prevents the key cap 2' from interfering assembly of the following operation.

As shown in FIG. 32 and FIG. 33, the first extending arm 11' enters into the first assembling slot 57' to engage the first engaging portion 52' of the buffer member 5' with the first hook 112' of the base 1' (step S1'). During the aforementioned process, the first engaging portion 52' enters into the pivoting space 113' to abut against the lower surface of the first hook 112' to rotatably engage with the first hook 112', as shown in FIG. 33. In this embodiment, the first engaging portion 52' can be a circular column substantially, and an outline of the first extending arm 11' matches with the circular column substantially. Therefore, when the first hook 112' engages the first engaging portion 52', such design facilitates to rotate the buffer member 5' relative to the base 1' around the first engaging portion 52'.

Afterwards, when the buffer member 5' rotates relative to the base 1' around the first engaging portion 52' from a position as shown in FIG. 33 to a position as shown in FIG. 34 along an assembling direction Z, the second extending arm 12' of the base 1' enters into the second assembling slot 59' on the buffer member 5'. The first chamfer angle structure 580' of the first restraining protrusion 58' guides the first vertical extending portion 111' of the first extending arm 11' to abut against the first restraining protrusion 58'. It should be noticed that as shown in FIG. 32, the first chamfer angle structure 580' can be an inclined surface. During the rotation of the buffer member 5' toward the base 1', the inclined surface, i.e., the first chamfer angle structure 580', facilitates to guide the first vertical extending portion 111' to move from a larger opening area to a smaller opening area defined between the two first restraining protrusion 58'. In other words, the first chamfer angle structure 580' can be used for guiding the first vertical extending portion 111' to abut against the first restraining protrusion 58'.

When the buffer member 5' continues to rotate toward the base 1' around the first engaging portion 52' from the position as shown in FIG. 34 to a position as shown in FIG. 35, the second engaging portion 53' of the buffer member 5' enters into the engaging space 124', so that the second engaging portion 53' abuts against the lower surface of the second hook 122' to engage with the second hook 122', so as to form the restraining structure 6' by the base 1' and the recess structure 51' of the buffer member 5' adjacent to each other. (step S2'). At last, the lower linking end 41' of the link bar 4' movably passes through the restraining structure (step S3'). In such a way, when the key cap 2' moves relative to the base 1' upwardly and downwardly, the lower linking end 41' moves within the restraining structure 6' correspondingly. Since the buffer member 5' is made of material softer than material of the base 1', the buffer member 5' can provide a better buffer effect to reduce the noise during movement of the lower linking end 41' relative to the base 1'.

Furthermore, during the aforementioned process, the second chamfer angle structure 5A0' of the second restraining protrusion 5A' guides the second vertical extending portion 121' of the second extending arm 12' to abut against the second restraining protrusion 5A'. It should be noticed that as shown in FIG. 32, the second chamfer angle structure 5A0' can be an inclined surface. During rotation of the buffer member 5' toward the base 1', the inclined surface, i.e., the second chamfer angle structure 5A0', facilitates to guide the second vertical extending portion 121' to move from a larger opening area to a smaller opening area defined between the two second restraining protrusion 5A'. In other words, the second chamfer angle structure 5A0' can be used for guiding the second vertical extending portion 121' to abut against the second restraining protrusion 5A'.

It should be noticed that when the buffer member 5' is located at the position as shown in FIG. 35, the first extending arm 11' and the second extending arm 12' are installed inside the first assembling slot 57' and the second assembling slot 59', and the second hook 122' engages with the second engaging portion 53'. At this moment, the first restraining protrusion 58' abuts against the first vertical extending portion 111' of the first extending arm 11' for restraining the buffer member 5' from moving relative to the first extending arm 11' along a direction perpendicular to the buffer longitudinal axis 50'. The second restraining protrusion 5A' abuts against the second vertical extending portion 121' of the second extending arm 12' for restraining the buffer member 5' from moving relative to the second extending arm 12' along the direction perpendicular to the buffer longitudinal axis 50'. Furthermore, the restraining rib 5B' abuts against the second hook 122'. The restraining rib 5B' and the first engaging portion 52' restrain the buffer member 5' cooperatively from moving along a direction parallel to the buffer longitudinal axis 50'. In such a way, the buffer member 5' is restrained from moving relative to the base 1' in an up-down direction, a left-right direction and a front-back direction. Therefore, the buffer member 5' can be fixed firmly on the base 1'.

Besides, when the buffer member 5' is located at the position as shown in FIG. 35, the upper surface of the first hook 112' is exposed out of the upper surface of the buffer member 5', and a height of the upper surface of the first hook 112' is substantially equal to a height of the upper surface of the buffer member 5'. the upper surface of the second hook 122' is exposed out of the upper surface of the buffer member 5', and a height of the upper surface of the second hook 122' is substantially equal to a height of the upper surface of the buffer member 5'. That is, the second hook 122' is accommodated inside the accommodating slot 5C' and does not protrude from the upper surface of the buffer member 5'.

Figure 38:
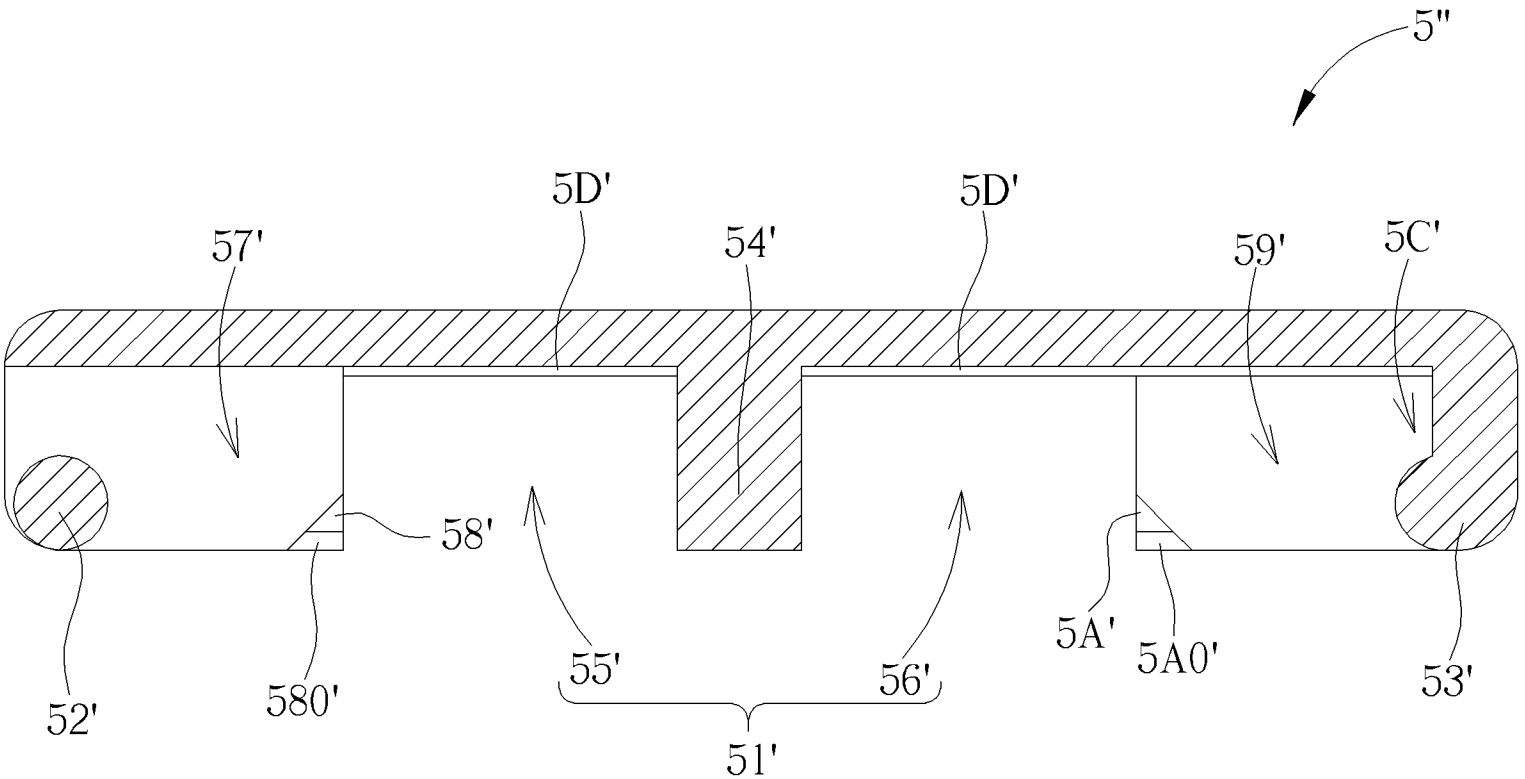
FIG. 38 is a sectional diagram of a buffer member according to a thirteenth embodiment of the present invention.

In this embodiment, the first assembling slot 57' and the second assembling slot 59' vertically penetrate the buffer member 5' substantially to has a first assembling opening 570 and a second assembling opening 590 on the upper surface of the buffer member 5'. However, the first assembling opening and the second assembling opening can be omitted. Please refer to FIG. 38. FIG. 38 is a sectional diagram of a buffer member 5" according to a thirteenth embodiment of the present invention. As shown in FIG. 38, the first assembling opening 570 and the second assembling opening 590 can be sealed, so that the upper surface of the buffer member 5" has no opening. However, in order to prevent the interference between the first hook 112' and the buffer member 5" and between the second hook 122' and the buffer member 5", the height of the buffer member 5" has to be increased, so that the first assembling slot 57' and the second assembling slot 59' has enough mechanical space to accommodate the first hook 112' and the second hook 122'. Therefore, the first hook 112' and the second hook 122' do not interfere with a wall of the buffer member 5".

Figure 39:
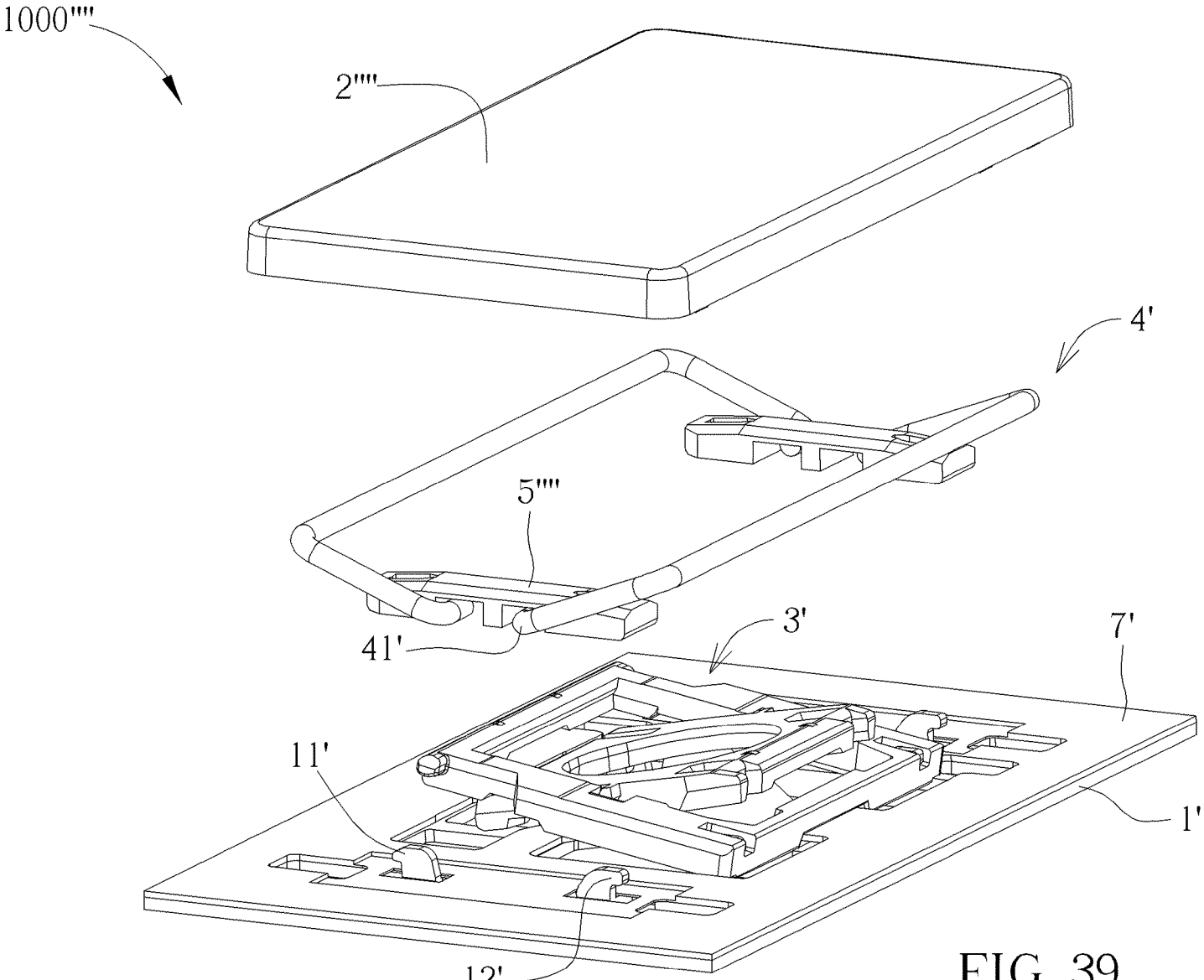
FIG. 39 and FIG. 40 are partial exploded diagrams of a key switch at different views according to a fourteenth embodiment of the present invention.
Figure 40:
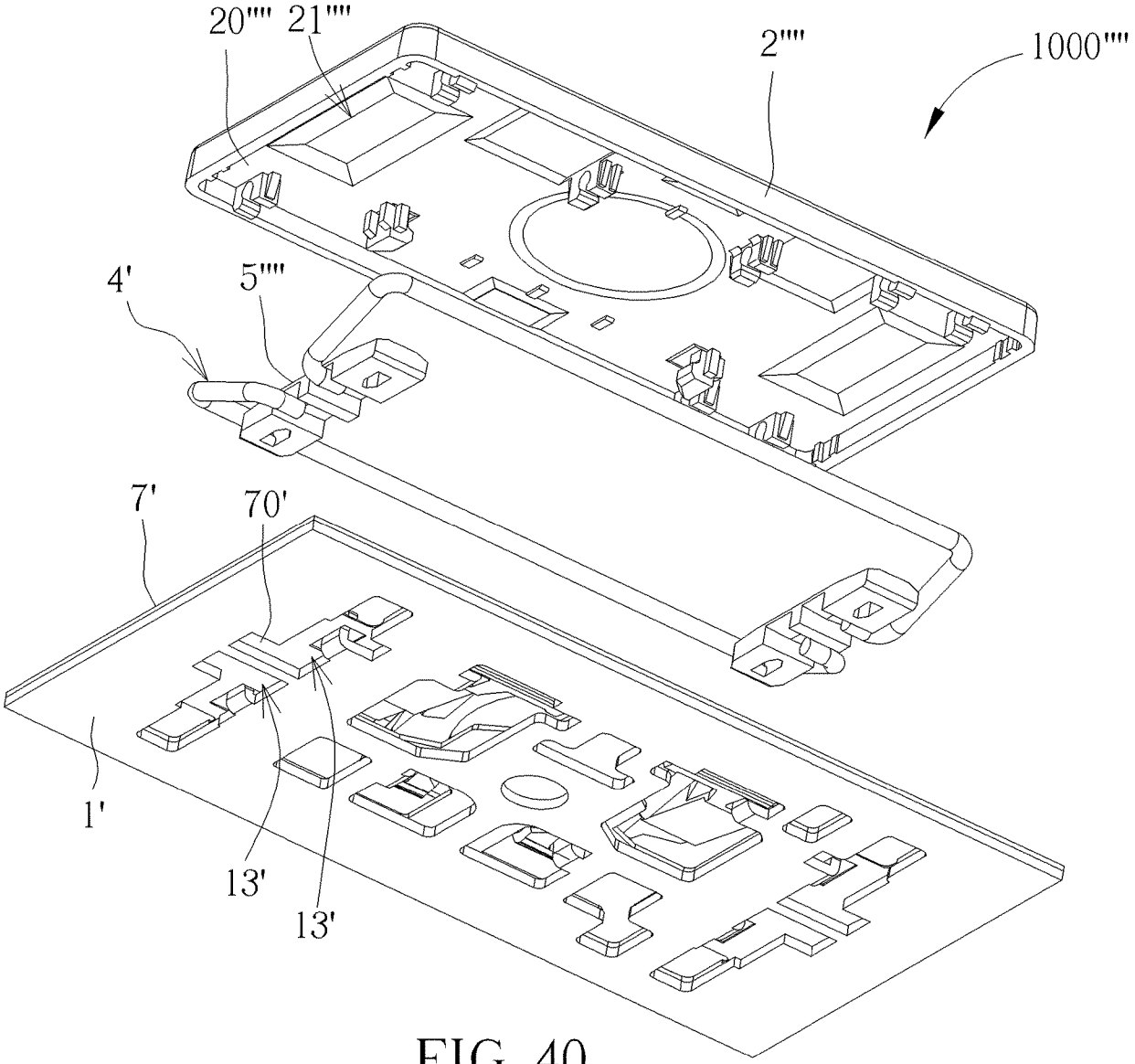
Figure 41:
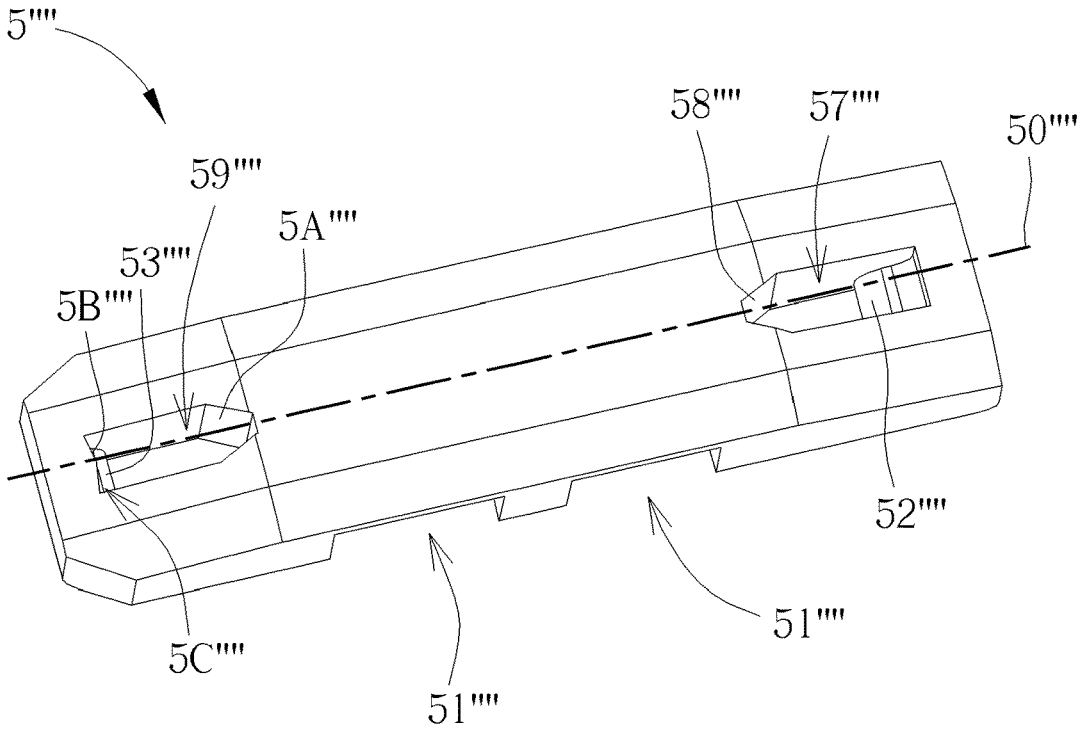
FIG. 41 and FIG. 42 are diagrams of a buffer member at different views according to the fourteenth embodiment of the present invention.
Figure 42:
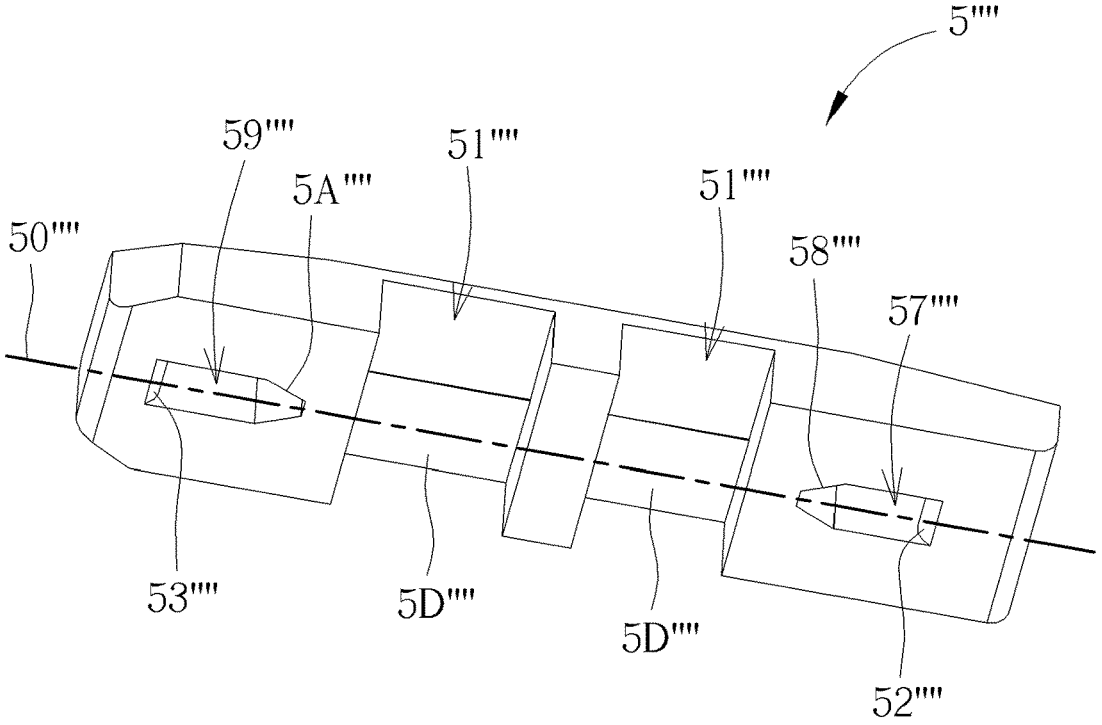
Figure 43:
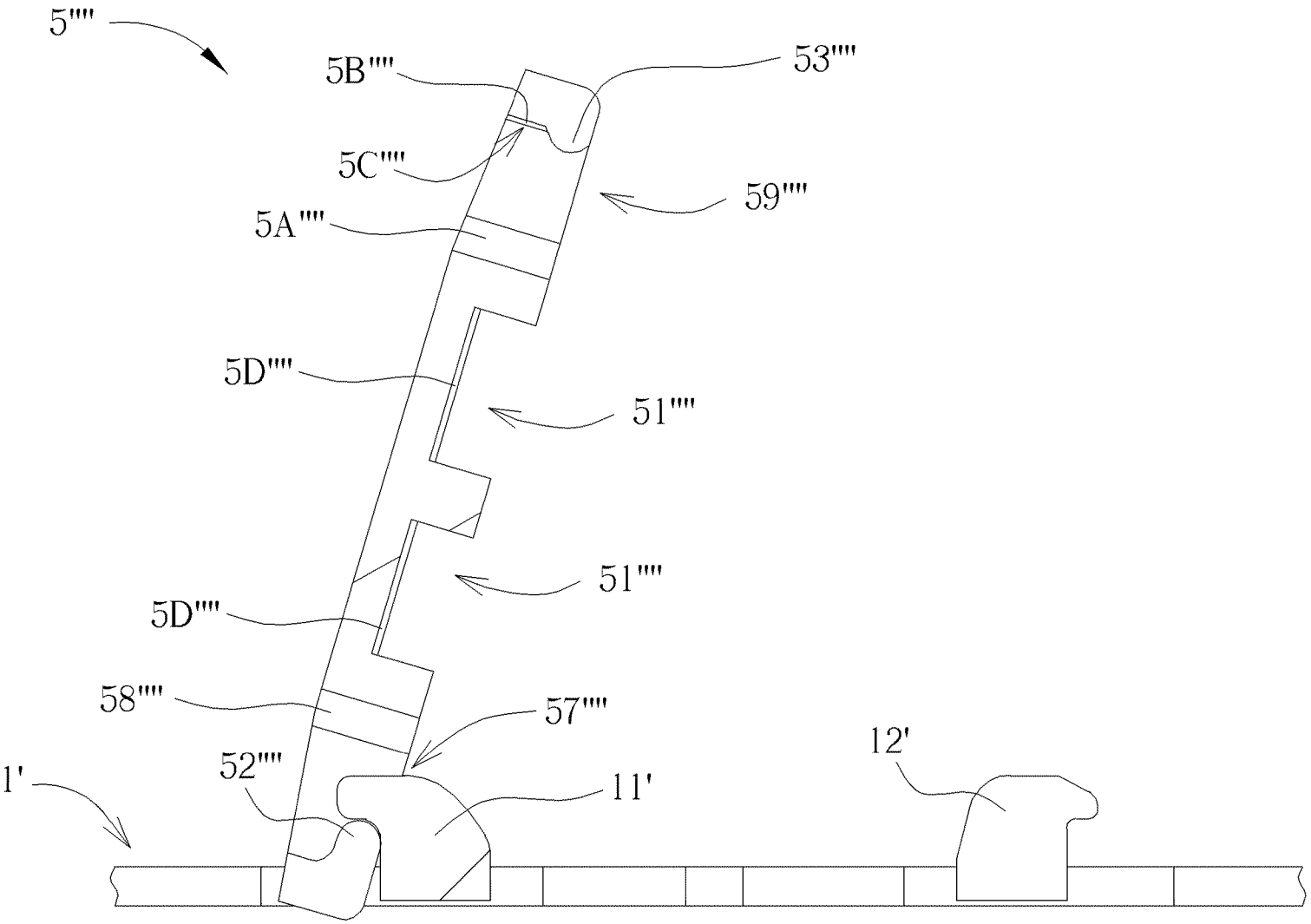
FIG. 43 and FIG. 44 are partial diagrams of the buffer member located at different installation positions relative to a base according to the fourteenth embodiment of the present invention.
Figure 44:
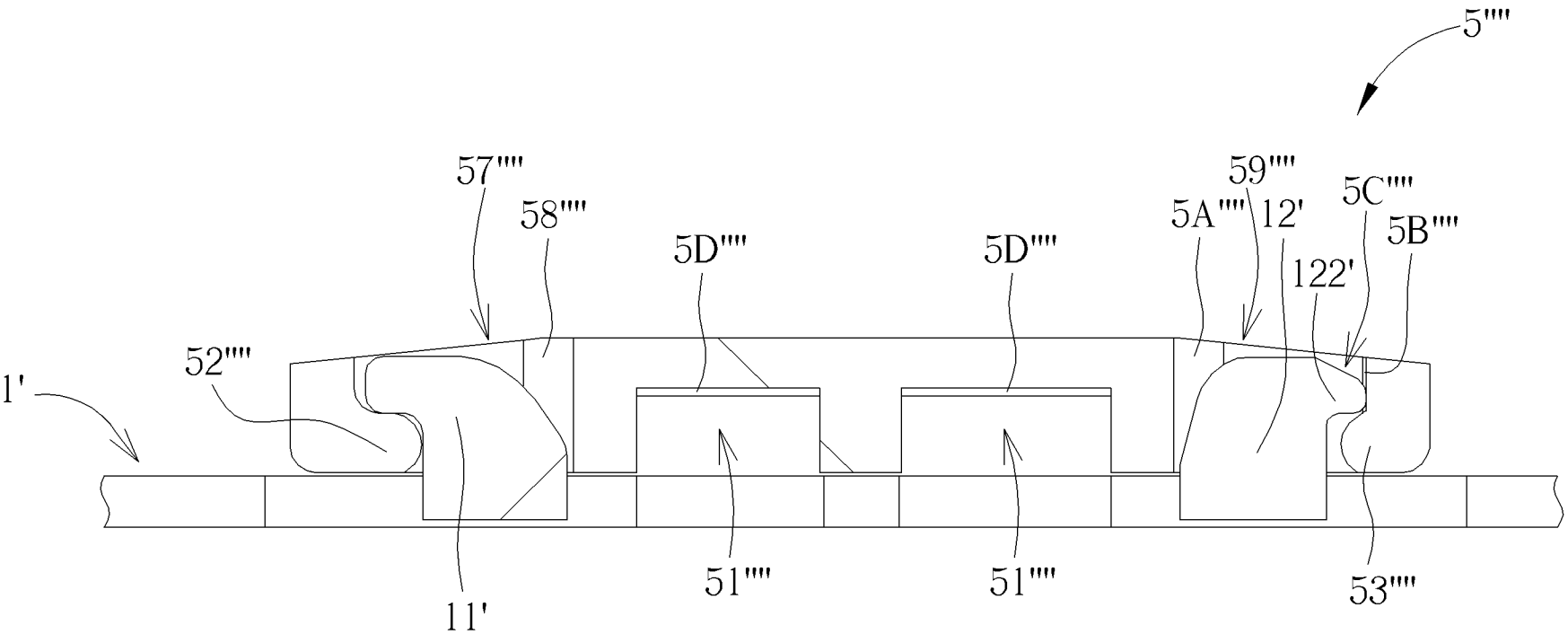

Furthermore, the first assembling slot, the second assembling slot, the first restraining protrusion, the second restraining protrusion, the restraining rib and the buffer rib of the buffer member are not limited to those illustrated in the aforementioned embodiments. For example, please refer to FIG. 39 to FIG. 44. FIG. 39 and FIG. 40 are partial exploded diagrams of a key switch 1000"" at different views according to a fourteenth embodiment of the present invention. FIG. 41 and FIG. 42 are diagrams of a buffer member 5"" at different views according to the fourteenth embodiment of the present invention. FIG. 43 and FIG. 44 are partial diagrams of the buffer member 5"" located at different installation positions relative to the base 1' according to the fourteenth embodiment of the present invention. As shown in FIG. 39 to FIG. 44, the key switch 1000"" includes the base 1', a key cap 2"", the supporting mechanism 3', the link bar 4', the buffer member 5"" and the circuit board 7'. The buffer member 5"" includes a buffer longitudinal axis 50"", a recess structure 51"", a first engaging portion 52"", a second engaging portion 53"", a first restraining protrusion 58"", a second restraining protrusion 5A"", a restraining rib 5B"" and a buffer rib 5D"". A first assembling slot 57"", a second assembling slot 59"" and an accommodating slot 5C"" communicated with the second assembling slot 59"" are formed on the buffer member 5"". The first restraining protrusion 58"" and the second restraining protrusion 5A"" protrude from a wall of the first assembling slot 57"" and the second assembling slot 59"" respectively for restraining the buffer member 5"" from moving relative to the first extending arm 11' and the second extending arm 12' along a direction perpendicular to the buffer longitudinal axis 50"". The restraining rib 5B"" is disposed inside the accommodating slot 5C"". When the second hook 122' of the second extending arm 12' enters into the accommodating slot 5C"", the restraining rib 5B"" abuts against the second hook 122'. An opening of the recess structure 51"" faces downwardly to form an accommodating space. The buffer rib 5D"" is located at a position adjacent to the accommodating space and extends along the buffer longitudinal axis 50"". When the lower linking end 41' of the link bar 4' moves within the accommodating space, the lower linking end 41' abuts against the buffer rib 5D"", so as to reduce a contacting area of the linking end 41' and the buffer member 5"" and prevent the lower linking end 41' from colliding with a main body portion of the buffer member 5"", which reduces the noise of the movement of the lower linking end 41' of the link bar 4' relative to the base 1'. In this embodiment, the first engaging portion 52"" can be a semicircular column, and an outline of the first extending arm 11' can match with the semicircular column substantially. Therefore, when the first extending arm 11' engages with the first engaging portion 52"", such structure facilitates the buffer member 5"" to rotate relative to the base 1' around the first engaging portion 52"". Furthermore, in this embodiment, a notch 21"" is formed on a bottom surface 20"" of the key cap 2"". When the key cap 2"" moves toward the base 1' downwardly, the buffer member 5"" at least partially enters into the notch 21"", so as to increase a travelling distance of the key switch 1000"", i.e., upward and downward moving distances of the key cap 2"" relative to the base 1'. For simplicity, elements that have the same structures and functions as those illustrated in the aforementioned embodiment are provided with the same item numbers in this embodiment.

Figure 45:
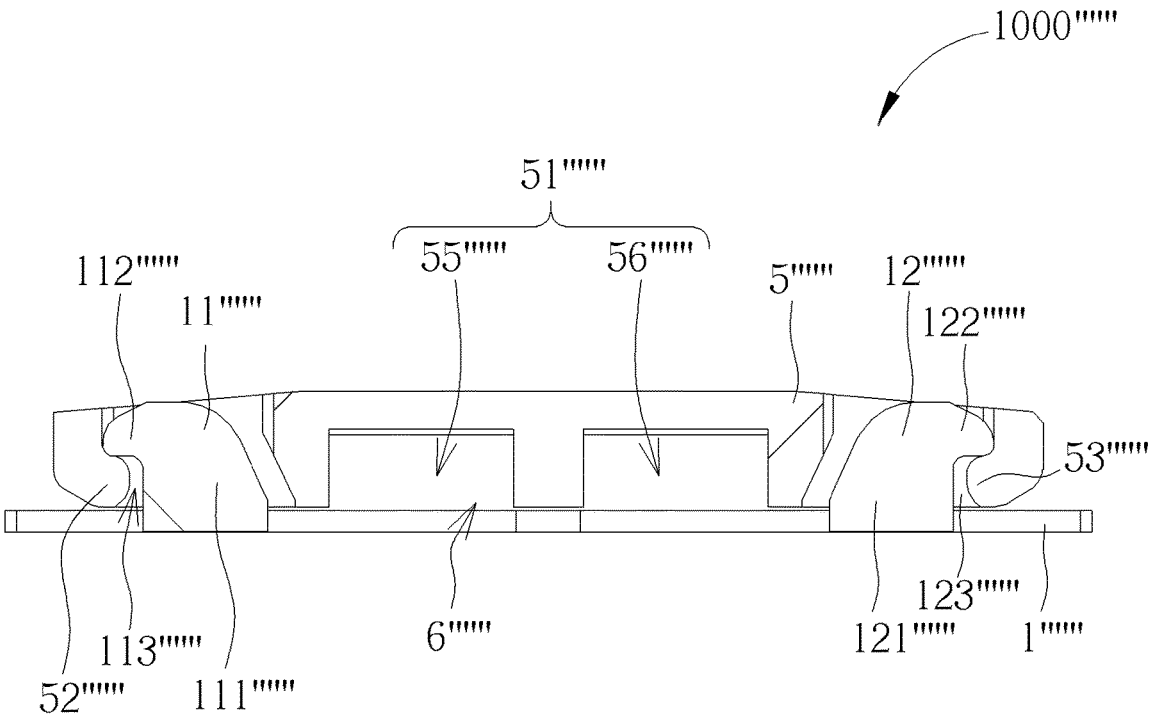
FIG. 45 is a partial sectional diagram of a key switch according to a fifteenth embodiment of the present invention.
Figure 46:
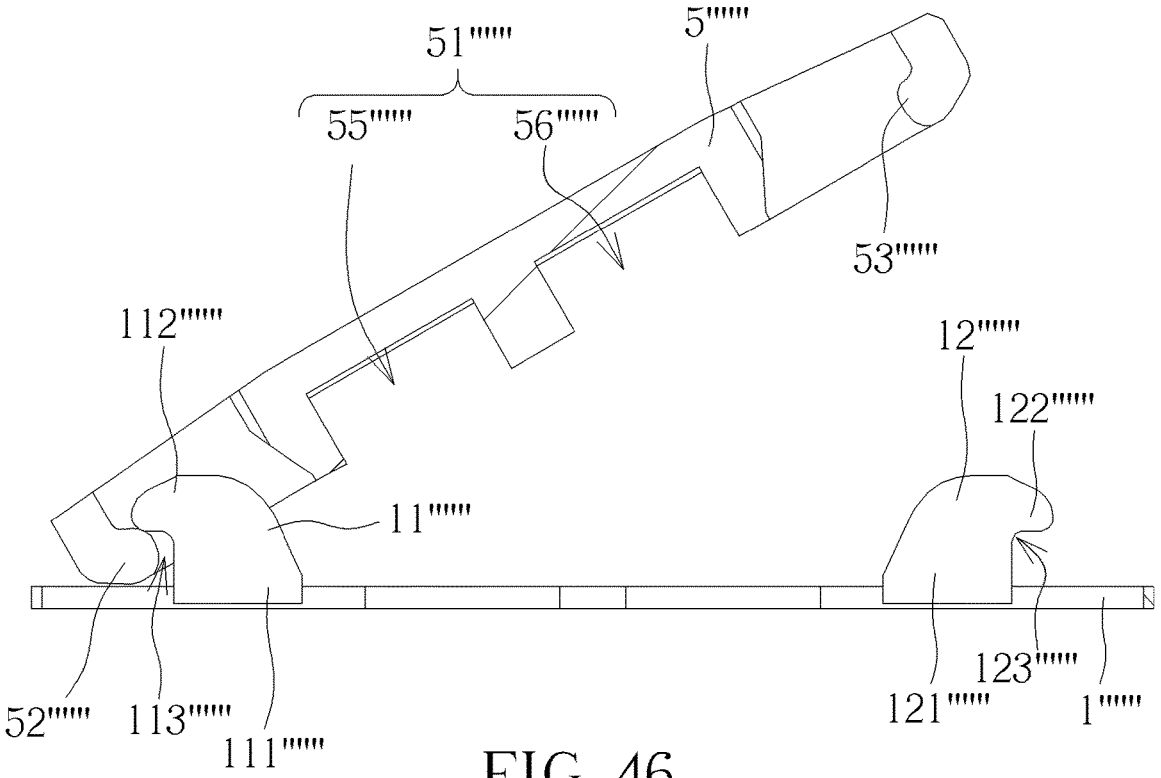
FIG. 46 and FIG. 47 are diagrams of a buffer member located at different positions relative to a base according to the fifteenth embodiment of the present invention.
Figure 47:
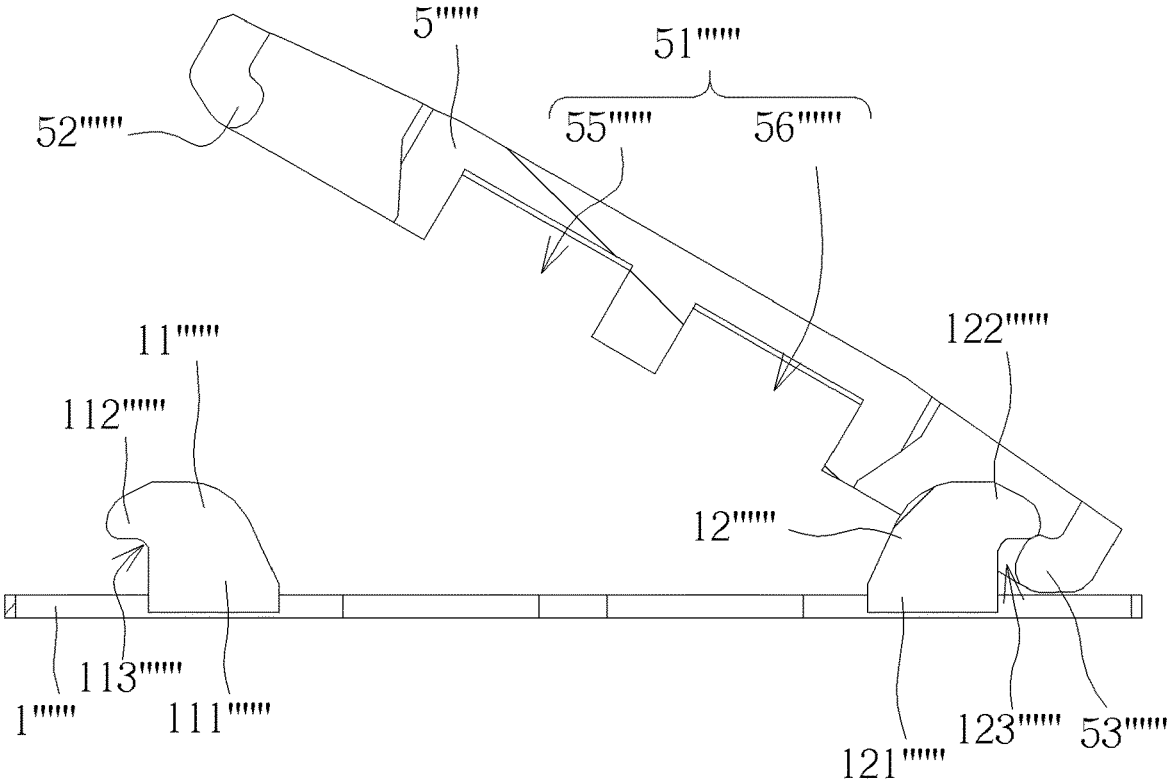

Furthermore, in another embodiment, the first extending arm and the second extending arm can be configured to rotatably engage with the first engaging portion and the second engaging portion respectively, so that the buffer member can be rotated relative to the base by rotating engagement of the first extending arm and the first engaging portion or rotating engagement of the second extending arm and the second engaging portion. Please refer to FIG. 45 to FIG. 47. FIG. 45 is a partial sectional diagram of a key switch 1000'''' according to a fifteenth embodiment of the present invention. FIG. 46 and FIG. 47 are diagrams of a buffer member 5'''' located at different positions relative to a base 1'''' according to the fifteenth embodiment of the present invention. As shown in FIG. 45 to FIG. 47, in this embodiment, a second engaging portion 53'''' and a second extending arm 12'''' can be substantially symmetrical to a first engaging portion 52'''' and a first extending arm 11'''' respectively. A first pivoting space 113'''' is formed between a first hook 112'''' and a first vertical extending portion 111'''' of the first extending arm 11''''. A second pivoting space 123'''' is formed between a second hook 122'''' and a second vertical extending portion 121'''' of the second extending arm 12''''. As shown in FIG. 46, the first engaging portion 52'''' enters into the first pivoting space 113'''' to rotatably engage with the first hook 112'''' and to abut against a lower surface of the first hook 112'''' when the first extending arm 11'''' enters into a first assembling slot 57'''' on the buffer member 5''''. As shown in FIG. 47, the second engaging portion 53'''' enters into the second pivoting space 123'''' to rotatably engage with the second hook 122'''' and to abut against a lower surface of the second hook 122'''' when the second extending arm 12'''' enters into a second assembling slot 59'''' on the buffer member 5''''.

Therefore, when it is desired to assemble the buffer member 5'''', the buffer member 5'''' can be rotated relative to the base 1'''' by rotating engagement of the first engaging portion 52'''' and the first extending arm 11'''' to drive the second engaging portion 53'''' to engage with the second extending arm 12'''', as shown in FIG. 46, or by rotating engagement of the second engaging portion 53'''' and the second extending arm 12'''' to drive the first engaging portion 52'''' to engage with the first extending arm 11'''', as shown in FIG. 47, so as to form a restraining structure 6'''' by a first accommodating space 55'''' and a second accommodating space 56'''' of a recess structure 51'''' of the buffer member 5'''' and the base 1'''' adjacent to each other.

In this embodiment, each of the first engaging portion 52'''' and the second engaging portion 53'''' can be a semicircular column substantially, and an outline of each of the first extending arm 11'''' and the second extending arm 12'''' matches with the semicircular column substantially. However, it is not limited thereto. Any configuration allows the first engaging portion and the second engaging portion to rotatably engage with the first extending arm and the second extending arm respectively can be included within the scope of the present invention. For example, each of the first engaging portion and the second engaging portion can be substantially an arc-shaped structure such as a circular column and the semicircular column, and an outline of each of the first extending arm and the second extending arm matches with the arc-shaped structure substantially.

Figure 48:
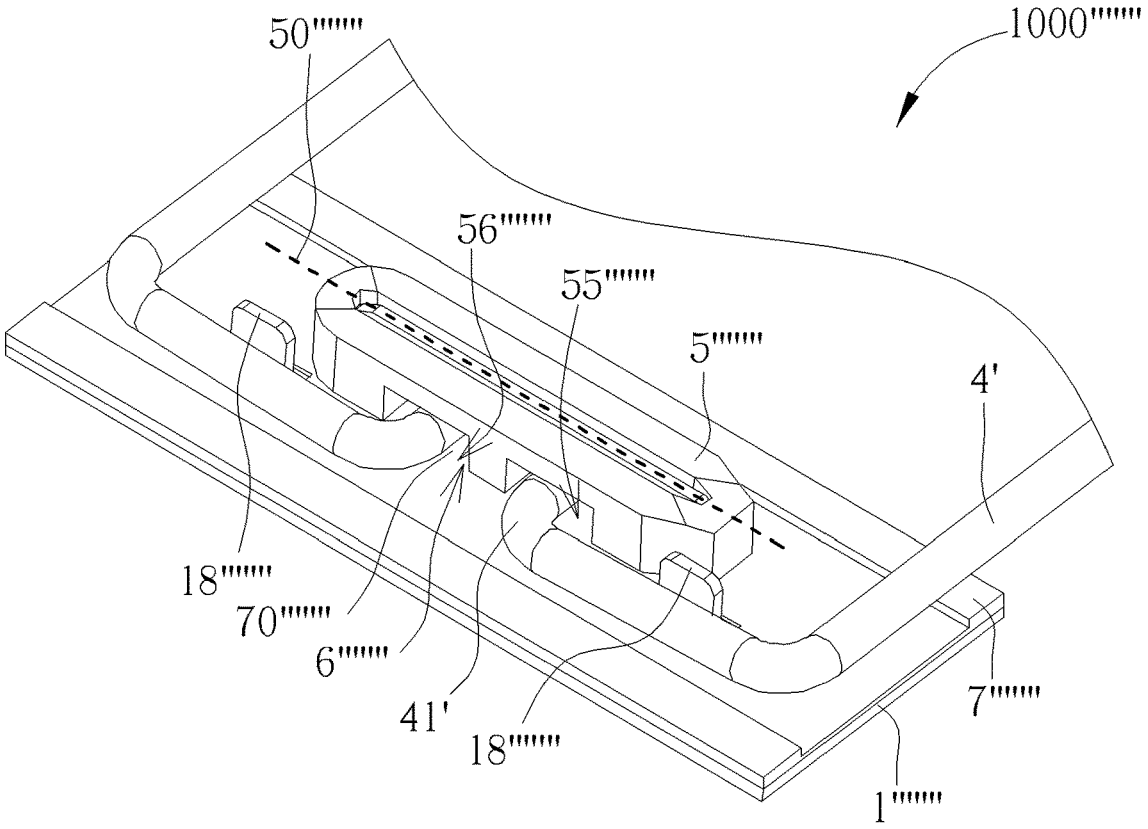
FIG. 48 and FIG. 49 are partial diagrams of a key switch at different views according to a sixteenth embodiment of the present invention.
Figure 49:
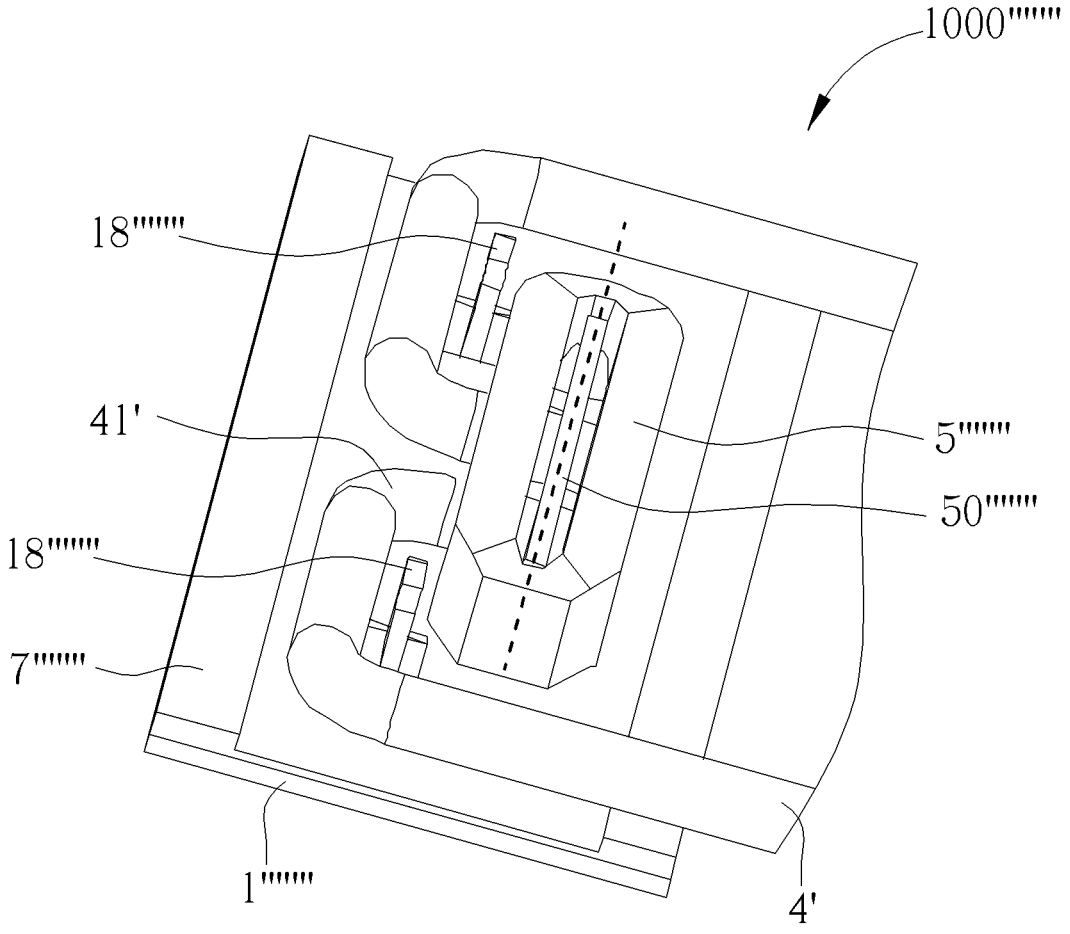
Figure 50:
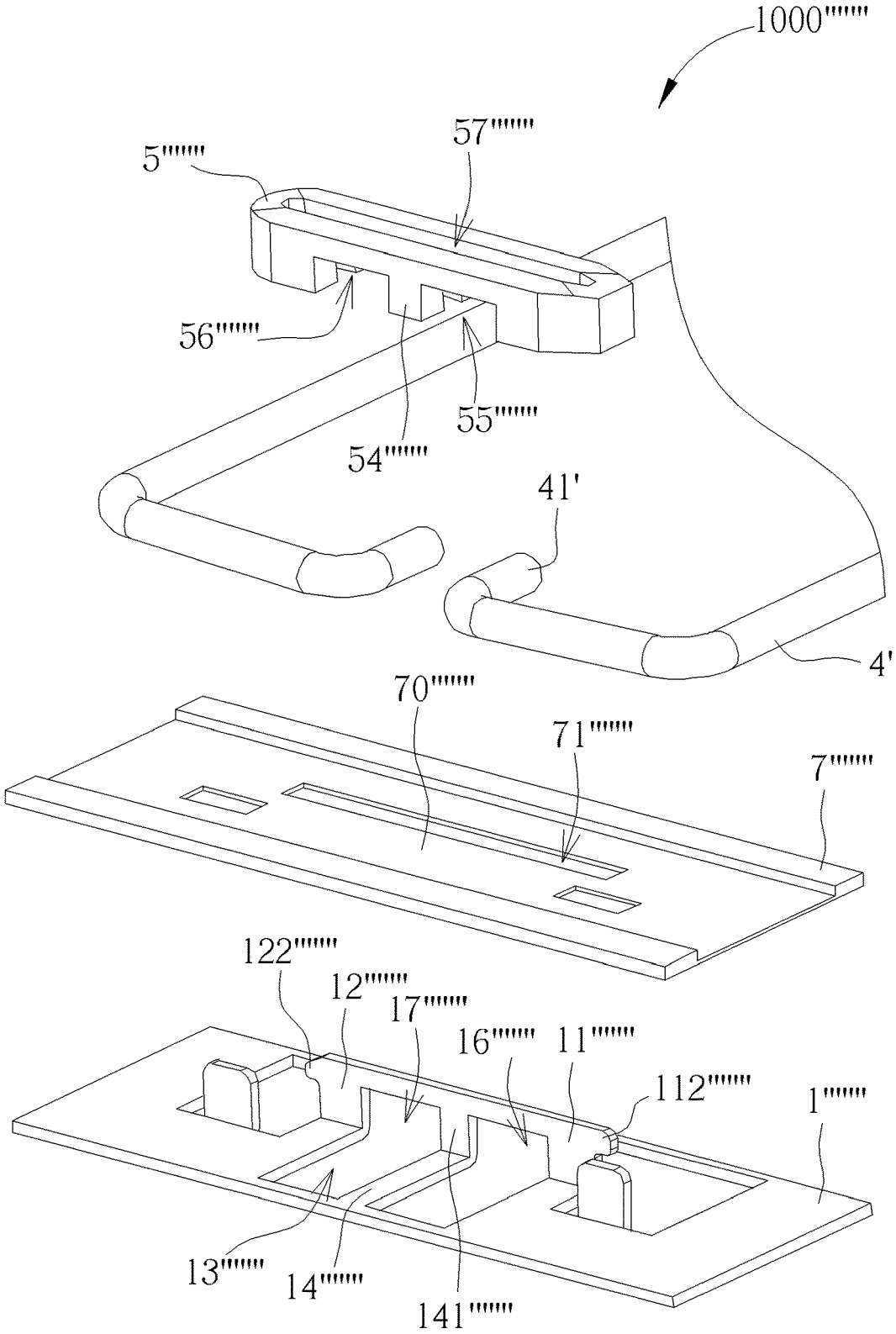
FIG. 50 is a partial exploded diagram of the key switch according to the sixteenth embodiment of the present invention.
Figure 51:
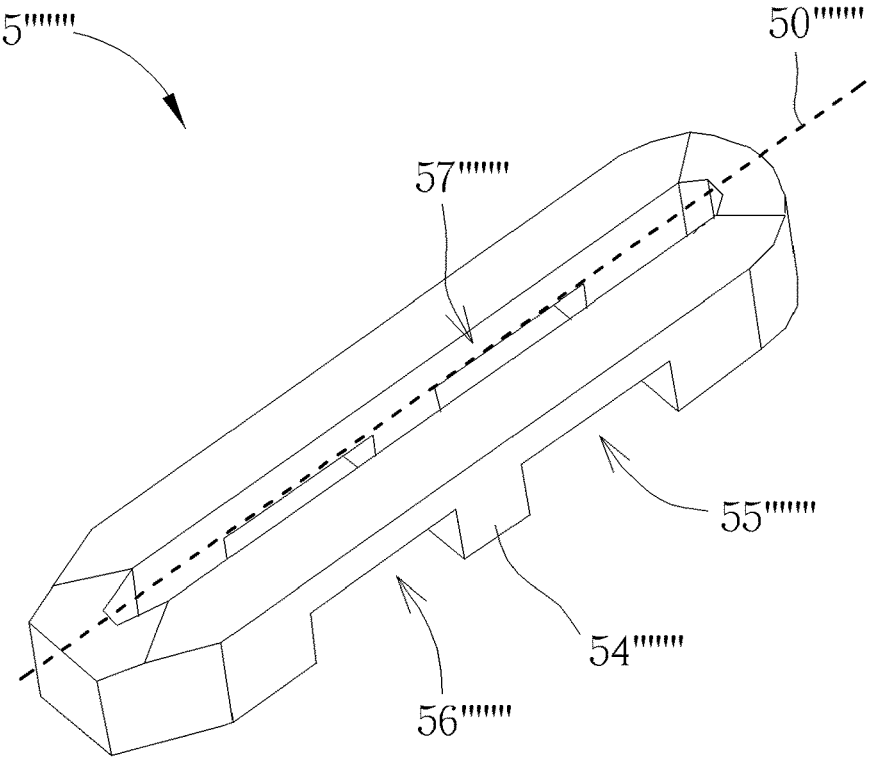
FIG. 51 and FIG. 52 are diagrams of a buffer member at different views according to the sixteenth embodiment of the present invention.
Figure 52:
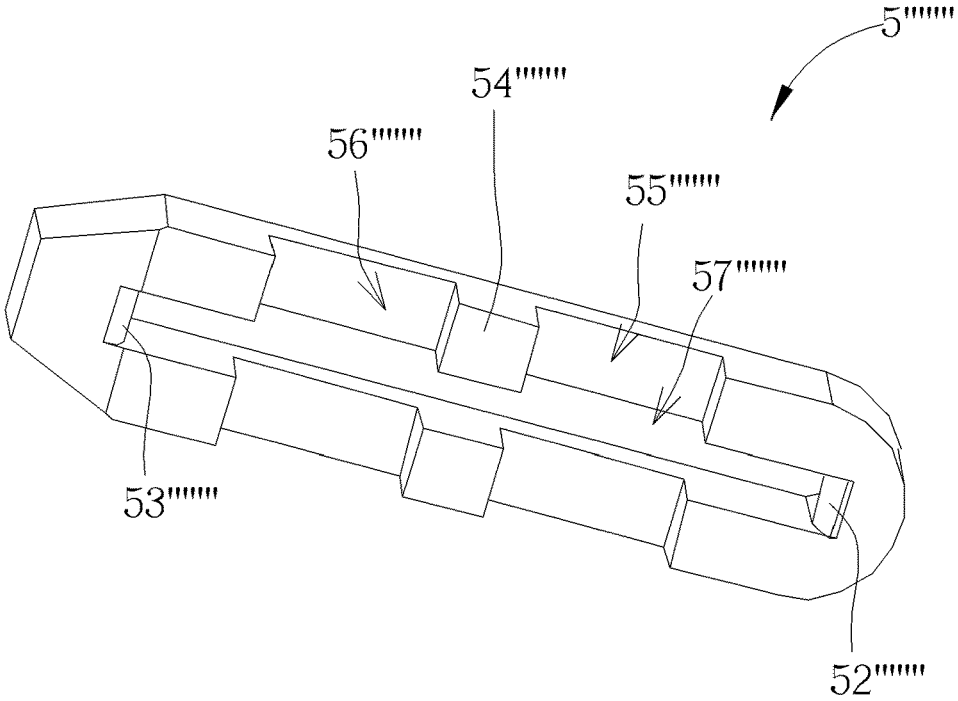
Figure 53:
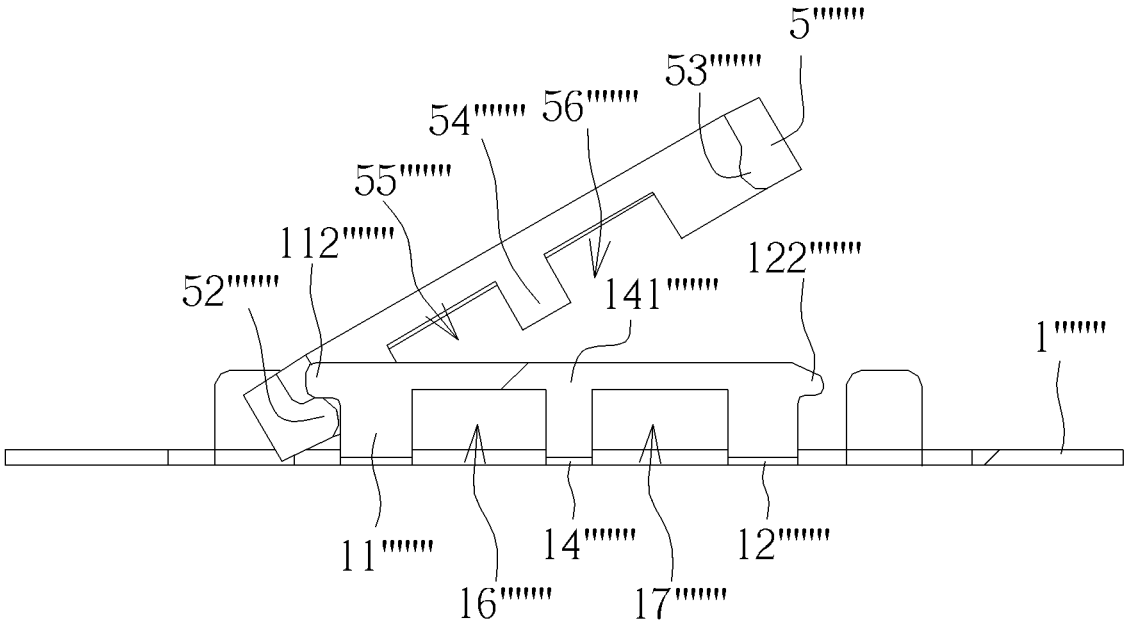
FIG. 53 and FIG. 54 are diagrams of the buffer member located at different installation positions relative to a base according to the sixteenth embodiment of the present invention.
Figure 54:
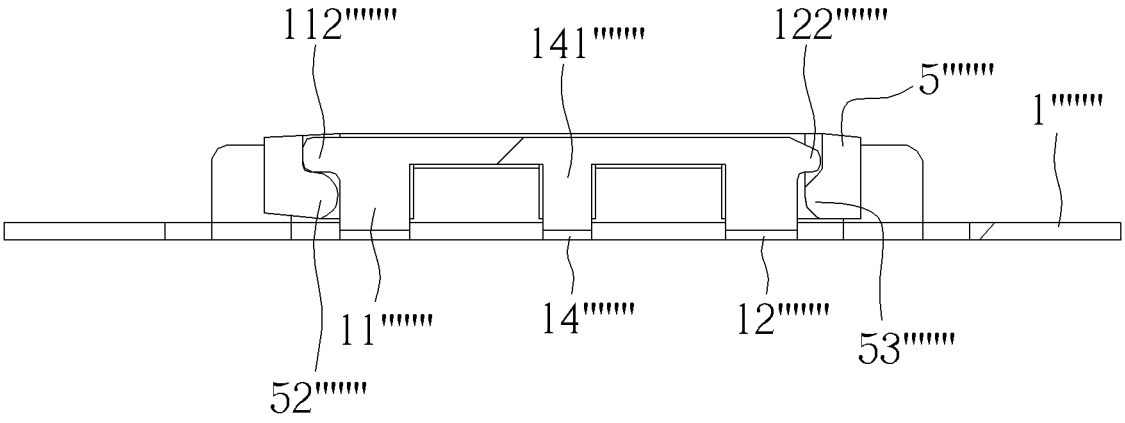

Please refer to FIG. 48 to FIG. 54. FIG. 48 and FIG. 49 are partial diagrams of a key switch 1000''''' at different views according to a sixteenth embodiment of the present invention. FIG. 50 is a partial exploded diagram of the key switch 1000''''' according to the sixteenth embodiment of the present invention. FIG. 51 and FIG. 52 are diagrams of a buffer member 5''''' at different views according to the sixteenth embodiment of the present invention. FIG. 53 and FIG. 54 are diagrams of the buffer member 5''''' located at different installation positions relative to a base 1''''' according to the sixteenth embodiment of the present invention. As shown in FIG. 48 to FIG. 54, the key switch 1000''''' includes the base 1''''', a key cap which is not shown in the figures, a supporting mechanism which is not shown in the figures, the link bar 4', the buffer member 5''''' and a circuit board 7'''''. The base 1''''' includes an opening structure 13''''' and a central extending portion 14'''''. The central extending portion 14''''' is located in a middle portion of the opening structure 13''''' and includes a substantially T-shaped portion 141'''''. The circuit board 7''''' includes a lower buffer portion 70''''' extended above the opening structure 13'''''. A through slot 71''''' is formed on the circuit board 7'''''. The substantially T-shaped portion 141''''' is upwardly extended through the through slot 71''''' and connected to a first extending arm 11''''' and a second extending arm 12''''' of the base 1'''''. A first receiving space 16''''' is formed between the substantially T-shaped portion 141''''' and the first extending arm 11''''' and is greater than a first accommodating space 55''''' located between a middle downward protrusion 54''''' and a first engaging portion 52''''' of the buffer member 5'''''. A second receiving space 17''''' is formed between the substantially T-shaped portion 141''''' and the second extending arm 12''''' and is greater than a second accommodating space 56''''' located between the middle downward protrusion 54''''' and a second engaging portion 53''''' of the buffer member 5'''''. Furthermore, an assembling slot 57''''' is formed on the buffer member 5'''''', and the first extending arm 11''''', the second extending arm 12''''' and the substantially T-shaped portion 141''''' are at least partially accommodated inside the assembling slot 57''''' when a first hook 112''''' of the first extending arm 11''''' and a second hook 122''''' of the second extending arm 12''''' respectively engage with the first engaging portion 52''''' and the second engaging portion 53'''''. Such configuration provides two options for a user to assemble the link bar 4'. Firstly, the link bar 4' can be assembled on the base 1''''' without the buffer member 5''''' by passing the lower linking end 41' of the link bar 4' through the first receiving space 16''''' or the second receiving space 17'''''. Secondly, the link bar 4' can be assembled by passing the lower linking end 41' of the link bar 4' through the first accommodating space 55''''' or the second accommodating space 56''''' after the buffer member 5''''' is assembled on the base 1''''' for preventing collision of the lower linking end 41' of the link bar 4' and the base 1''''' to reduce the noise of the movement of the lower linking end 41' of the link bar 4' relative to the base 1'''''.

Furthermore, the base 1''''' further includes a restraining component 18'''''. The restraining component 18''''' is configured to abut against the link bar 4' to restrain movement of the link bar 4' along a direction substantially perpendicular to a buffer longitudinal axis 50''''' of the buffer member 5''''''', to prevent the lower linking end 41' at the other side from being removed from a restraining structure 6''''' formed by the first accommodating space 55''''' and the second accommodating space 56''''' of the buffer member 5''''' at the other side and the base 1''''' adjacent to each other, or one of the first receiving space 16''''' and the second receiving space 17''''' at the other side when the buffer member 5''''' is not installed.

Figure 55:
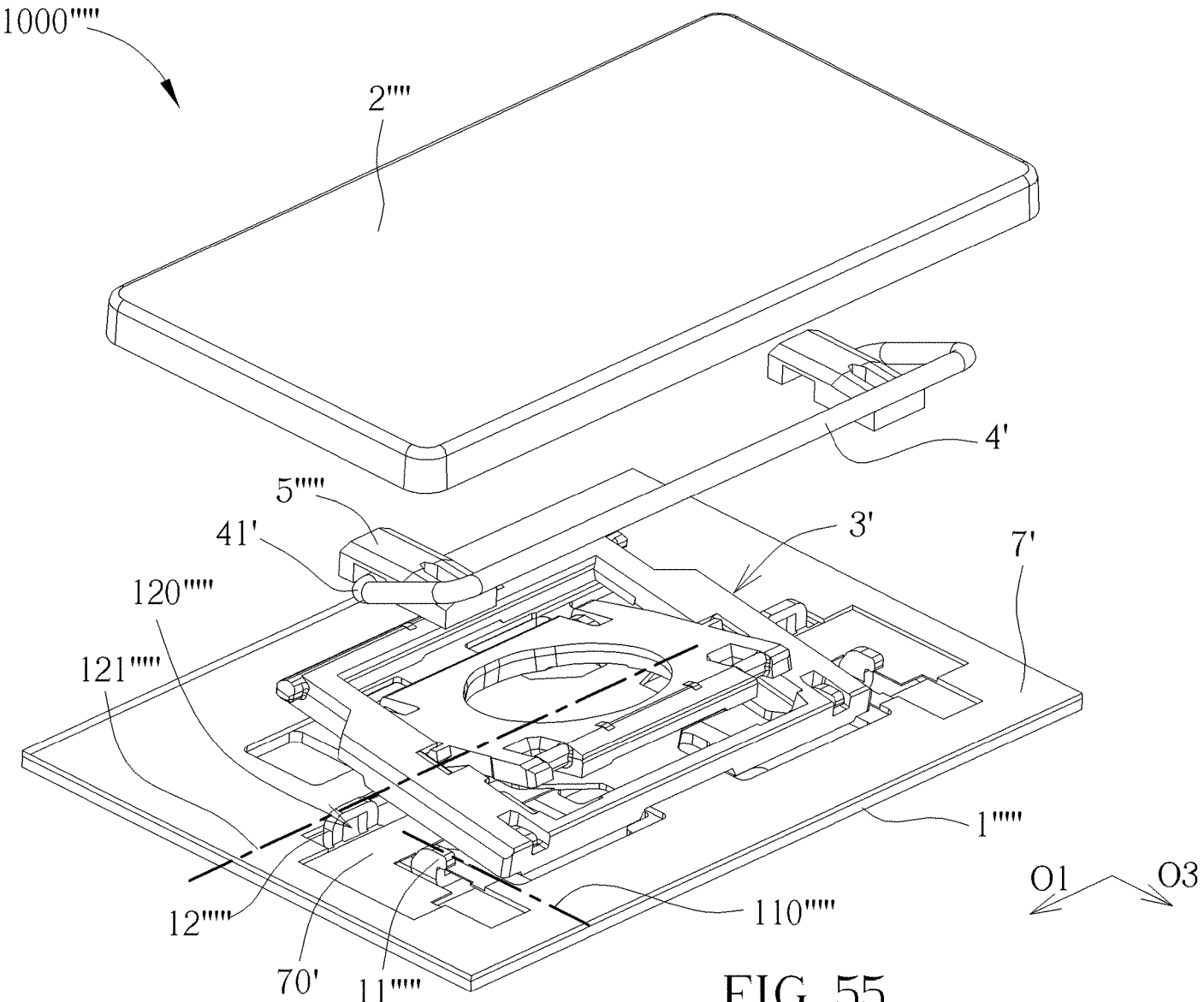
FIG. 55 and FIG. 56 are partial exploded diagrams of a key switch at different views according to a seventeenth embodiment of the present invention.
Figure 56:
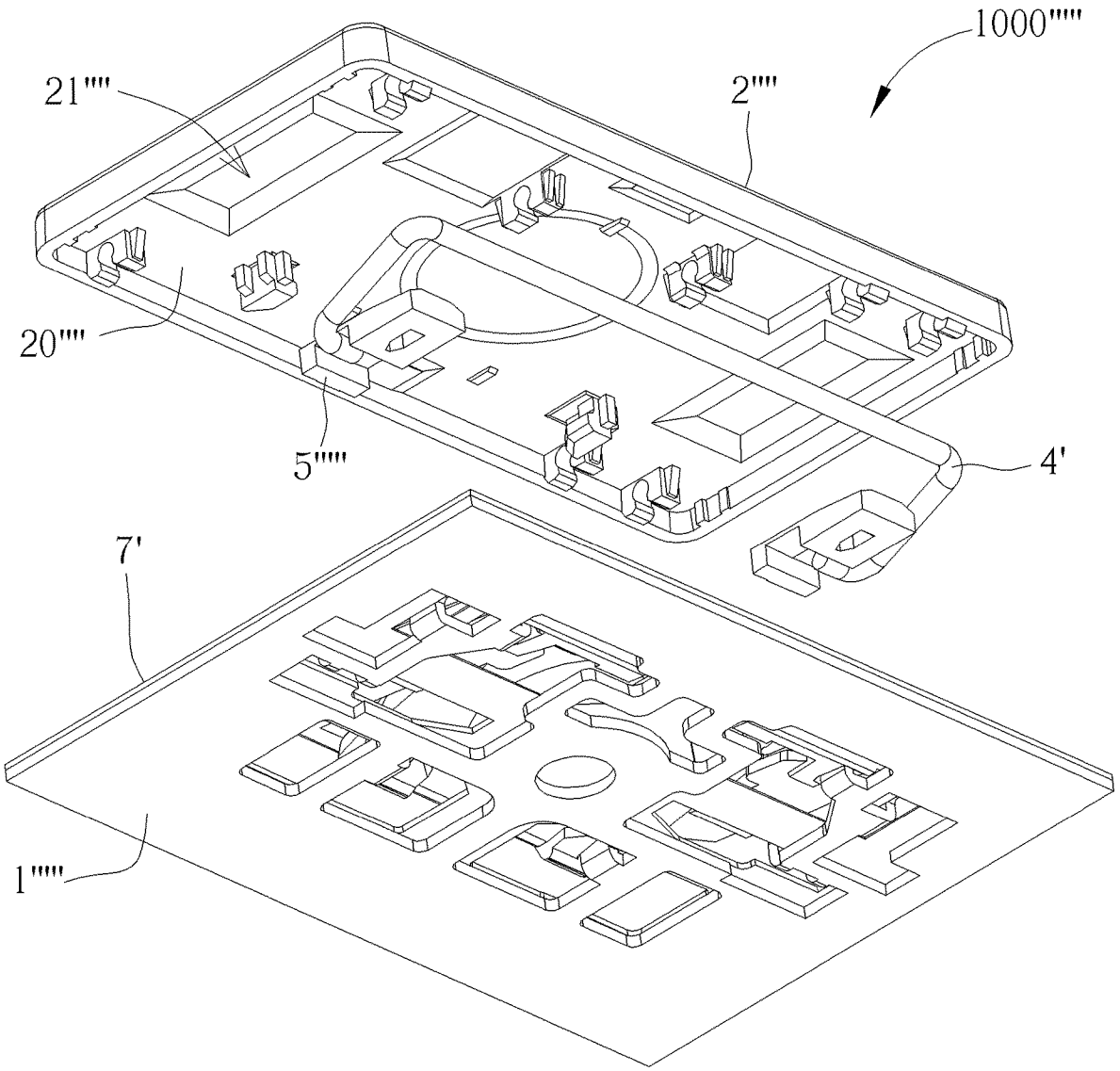
Figure 57:
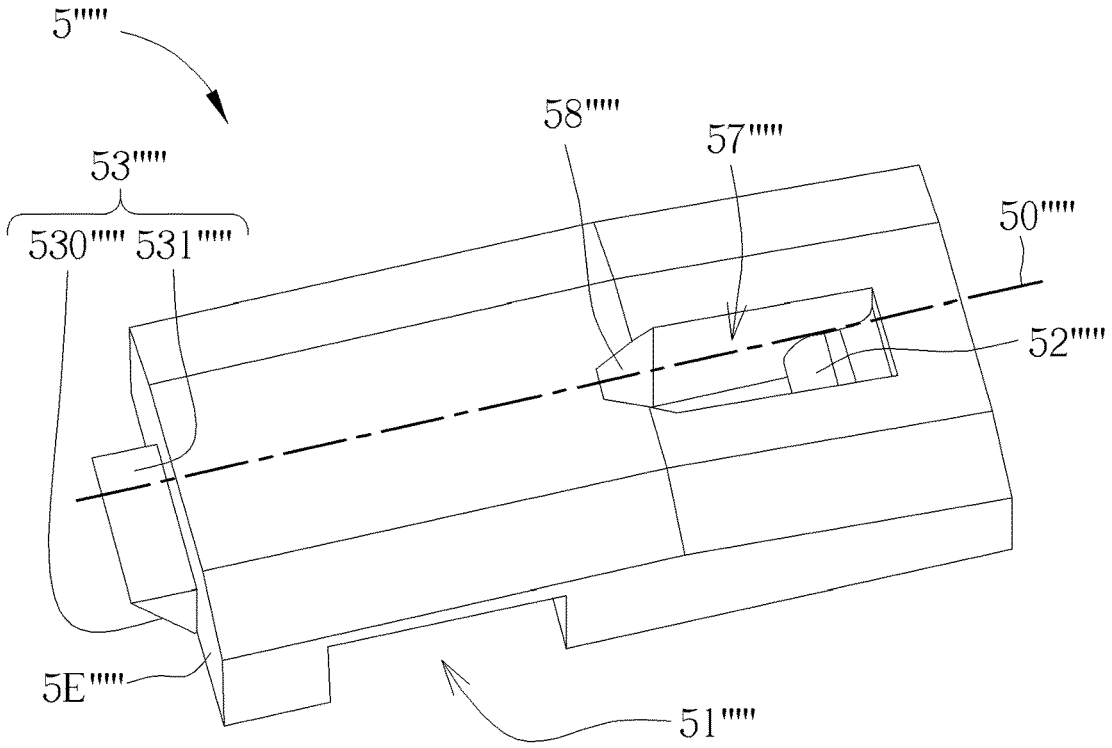
FIG. 57 and FIG. 58 are diagrams of a buffer member at different views according to the seventeenth embodiment of the present invention.
Figure 58:
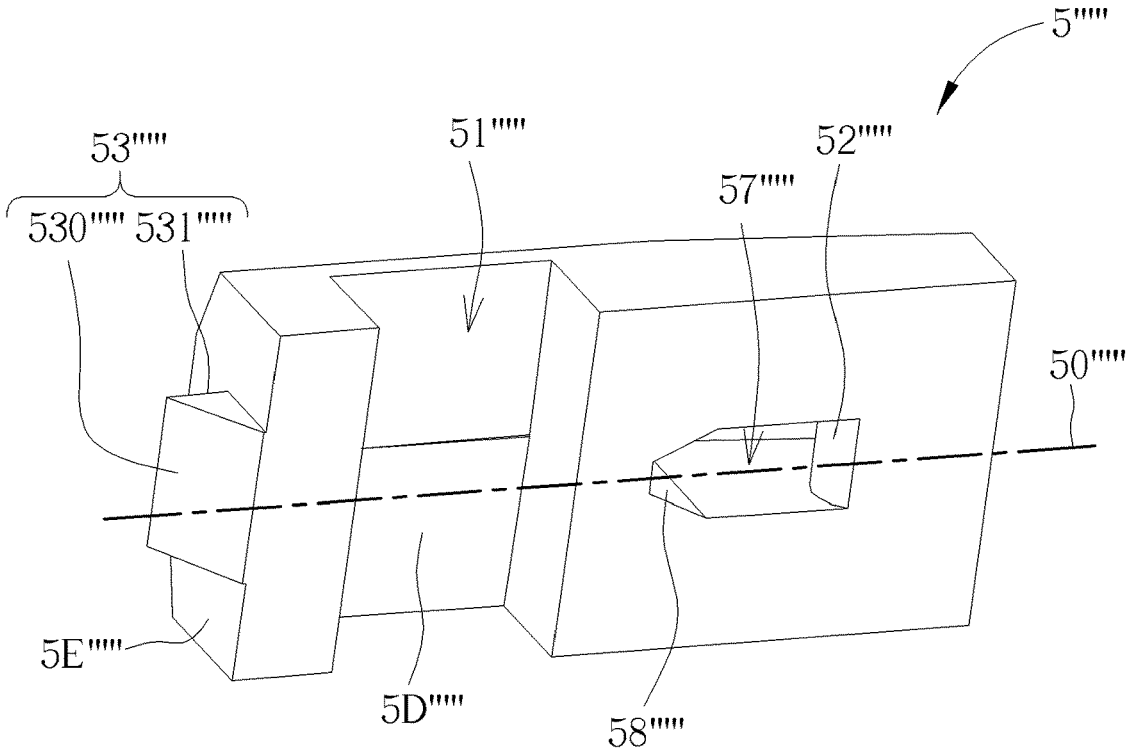
Figure 59:
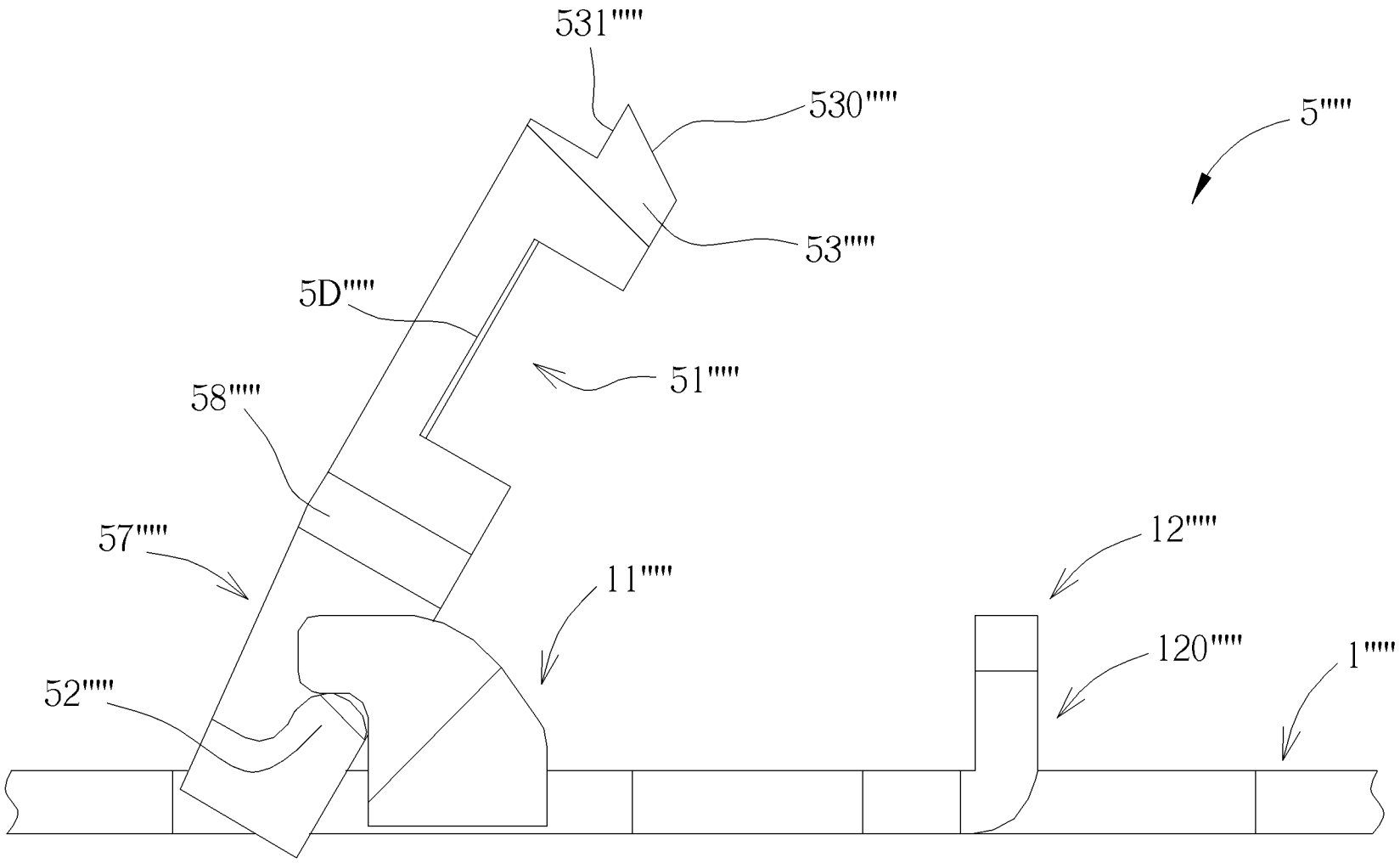
FIG. 59 and FIG. 60 are partial diagrams of the buffer member located at different installation positions relative to a base according to the seventeenth embodiment of the present invention.
Figure 60:
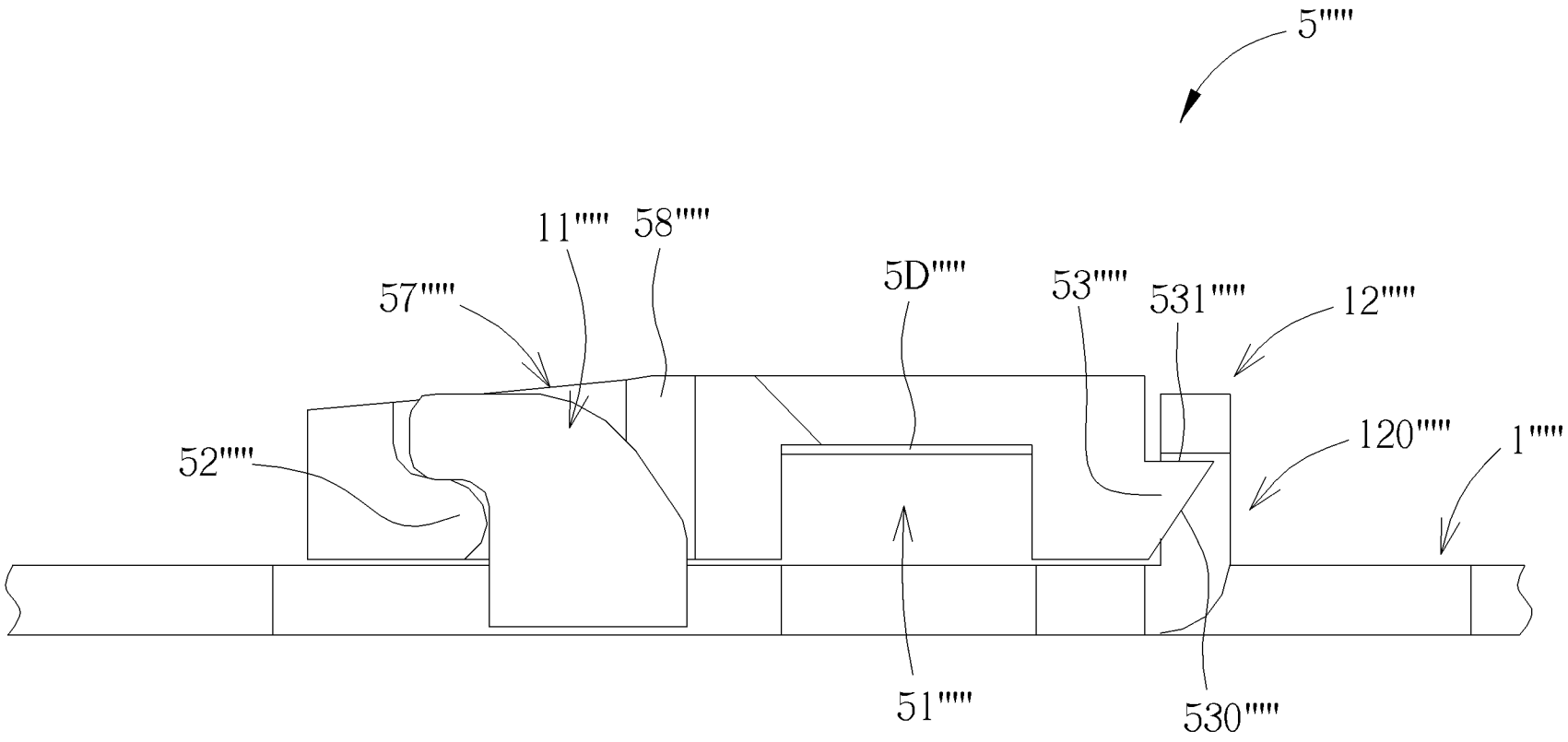

Besides, please refer to FIG. 55 to FIG. 60. FIG. 55 and FIG. 56 are partial exploded diagrams of a key switch 1000'''' at different views according to a seventeenth embodiment of the present invention. FIG. 57 and FIG. 58 are diagrams of a buffer member 5'''' at different views according to the seventeenth embodiment of the present invention. FIG. 59 and FIG. 60 are partial diagrams of the buffer member 5'''' located at different installation positions relative to a base 1'''' according to the seventeenth embodiment of the present invention. As shown in FIG. 55 to FIG. 60, the key switch 1000'''' includes the base 1'''', the key cap 2'''', the supporting mechanism 3', the link bar 4', the buffer member 5'''' and the circuit board 7'. The base 1'''' includes a first extending arm and a second extending arm. In this embodiment, the first extending arm can be an engaging hook 11'''', and the second extending arm can be an engaging portion 12'''' formed with an engaging hole 120'∝''. The first extending arm includes a first longitudinal axis 110'''' along a first longitudinal direction, e.g., the third direction O3. The second extending arm includes a second longitudinal axis 121'''' along a second longitudinal direction, e.g., the first direction O1, substantially perpendicular to the first longitudinal axis 110''''. The buffer member 5'''' includes a buffer longitudinal axis 50'''', a recess structure 51'''', a first engaging portion 52'''', a second engaging portion 53'''', a first restraining protrusion 58'''' and a buffer rib 5D''''. A first assembling slot 57'''' is formed on the buffer member 5''''. The first restraining protrusion 58'''' protrudes from a wall of the first assembling slot 57'''' for restraining the buffer member 5'''' from moving relative to the first extending arm and the second extending arm of the base 1'''' along a direction perpendicular to the buffer longitudinal axis 50''''. An opening of the recess structure 51'''' faces downwardly to form an accommodating space. The buffer rib 5D'''' is located at a position adjacent to the accommodating space and extends along the buffer longitudinal axis 50''''. When the lower linking end 41' of the link bar 4' moves within the accommodating space, the lower linking end 41' abuts against the buffer rib 5D'''', so as to reduce a contacting area of the linking end 41' and the buffer member 5'''' and prevent the lower linking end 41' from colliding with a main body portion of the buffer member 5'''', which reduces the noise of the movement of the lower linking end 41' of the link bar 4' relative to the base 1''''. Furthermore, in this embodiment, the first engaging portion 52'''' can be a semicircular column, and an outline of the engaging hook 11'''' can match with the semicircular column substantially. Therefore, when the engaging hook 11'''' engages with the first engaging portion 52'''', such structure facilitates the buffer member 5'''' to rotate relative to the base 1'''' around the first engaging portion 52''''. The buffer member 5'''' includes a buffer end 5E'''' located a position away from the first engaging portion 52''''. The recess structure 51'''' is located between the buffer end 5E'''' and the first engaging portion 52''''. The second engaging portion 53'''' protrudes from the buffer end 5E'''' and includes an inclined structure 530'''' and an abutting structure 531''''. When the first engaging portion 52''''0 rotates relative to the base 1'''', the inclined structure 530'''' contacts with the second extending arm for guiding the second engaging portion 53'''' to enter into the engaging hole 120''''. The abutting structure 531'''' abuts against a wall of the engaging hole 120'''' when the second engaging portion 53'''' enters into the engaging hole 120' for preventing the second engaging portion 53'' from disengaging from the engaging hole 120''''. For simplicity, elements that have the same structures and functions as those illustrated in the aforementioned embodiment are provided with the same item numbers in this embodiment.

Figure 61:
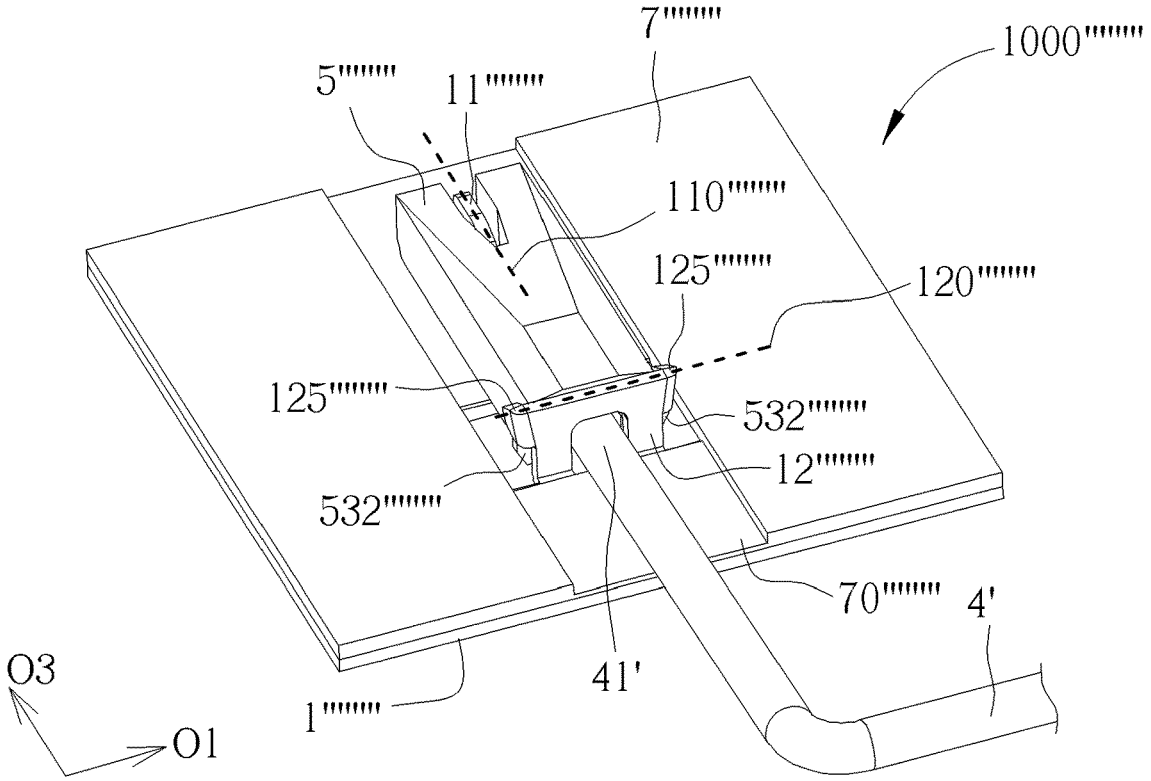
FIG. 61 and FIG. 62 are partial diagrams of a key switch at different views according to an eighteenth embodiment of the present invention.
Figure 62:
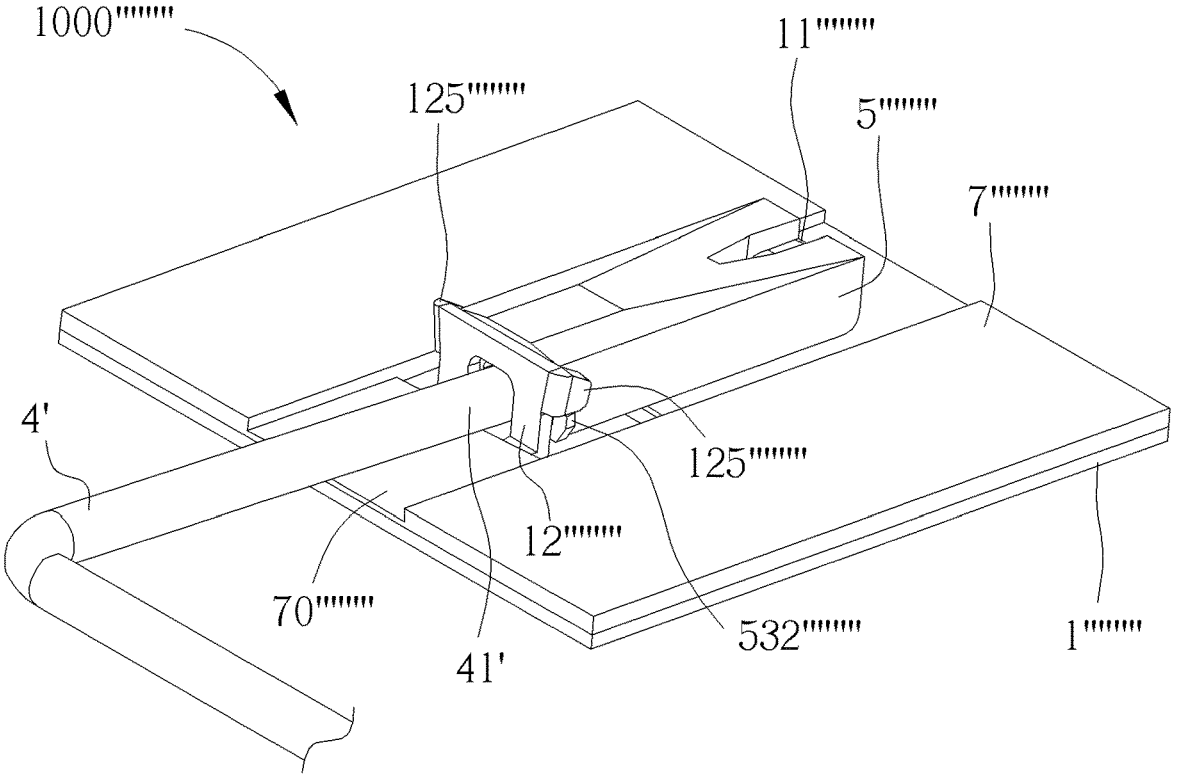
Figure 63:
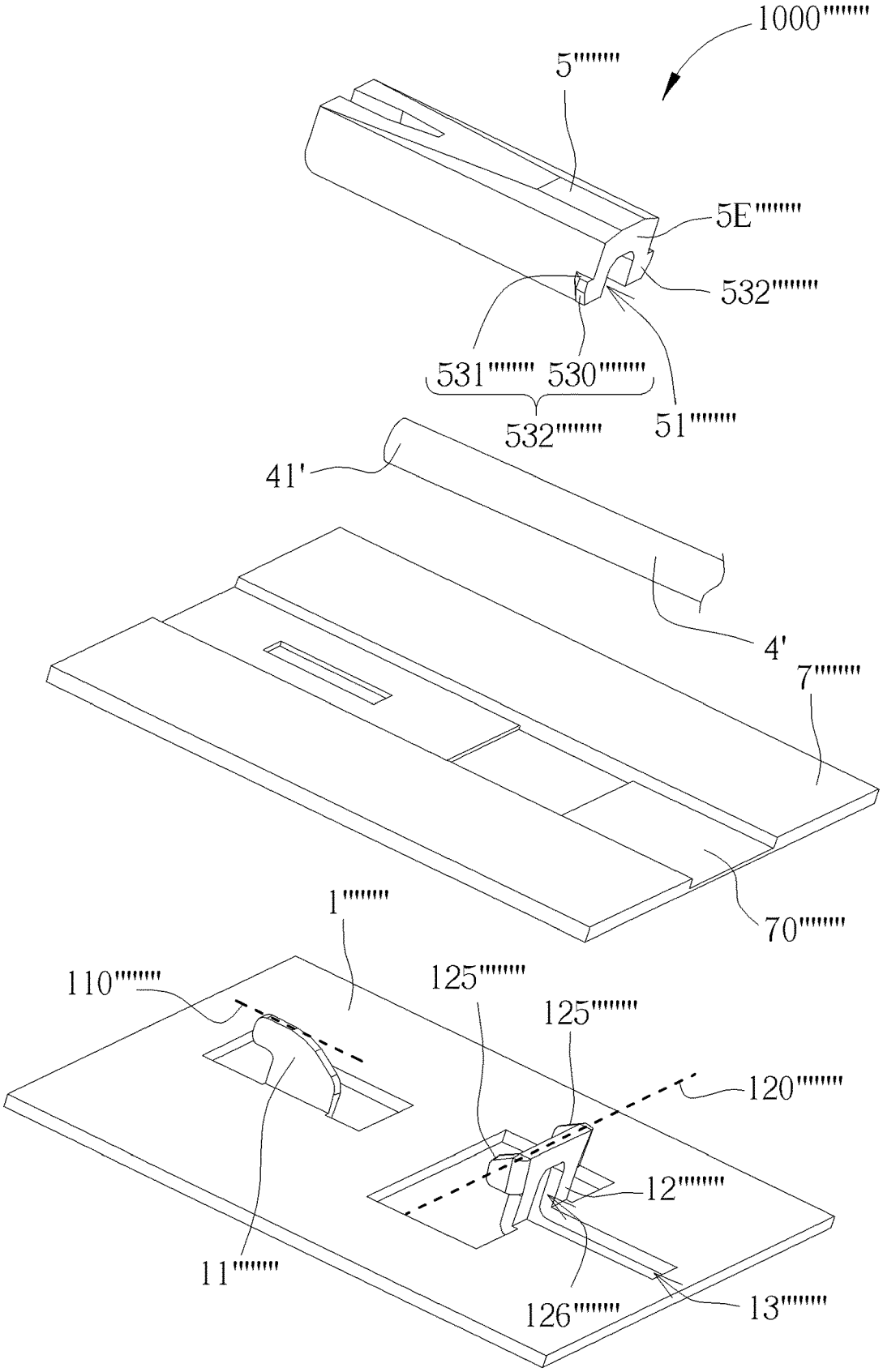
FIG. 63 is a partial exploded diagram of the key switch according to the eighteenth embodiment of the present invention.
Figure 64:
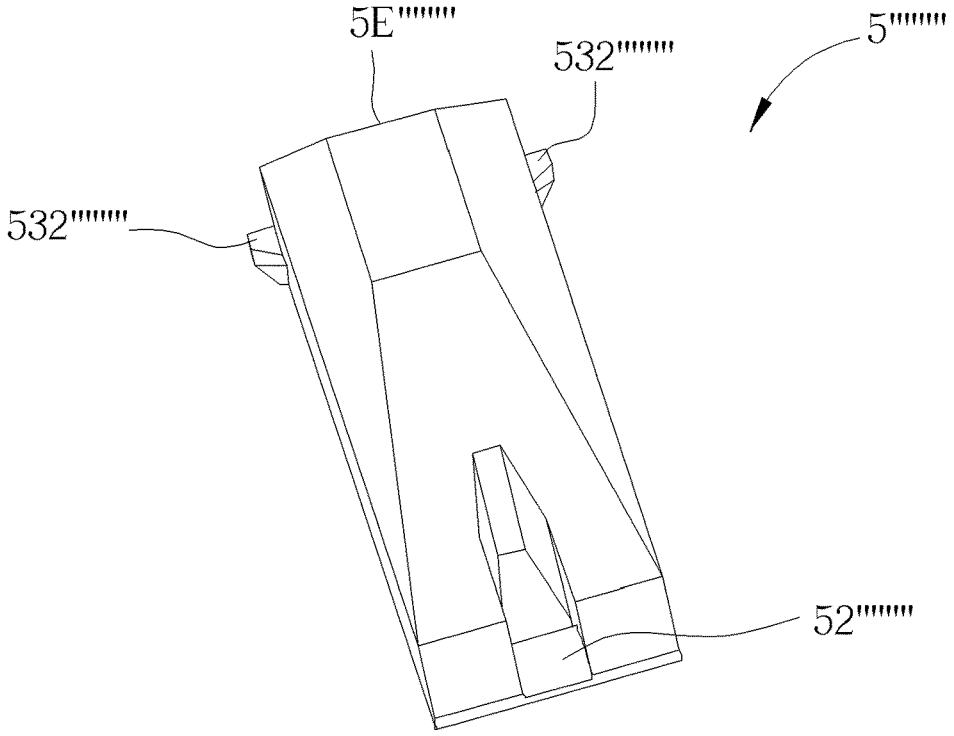
FIG. 64 and FIG. 65 are diagrams of a buffer member at different views according to the eighteenth embodiment of the present invention.
Figure 65:
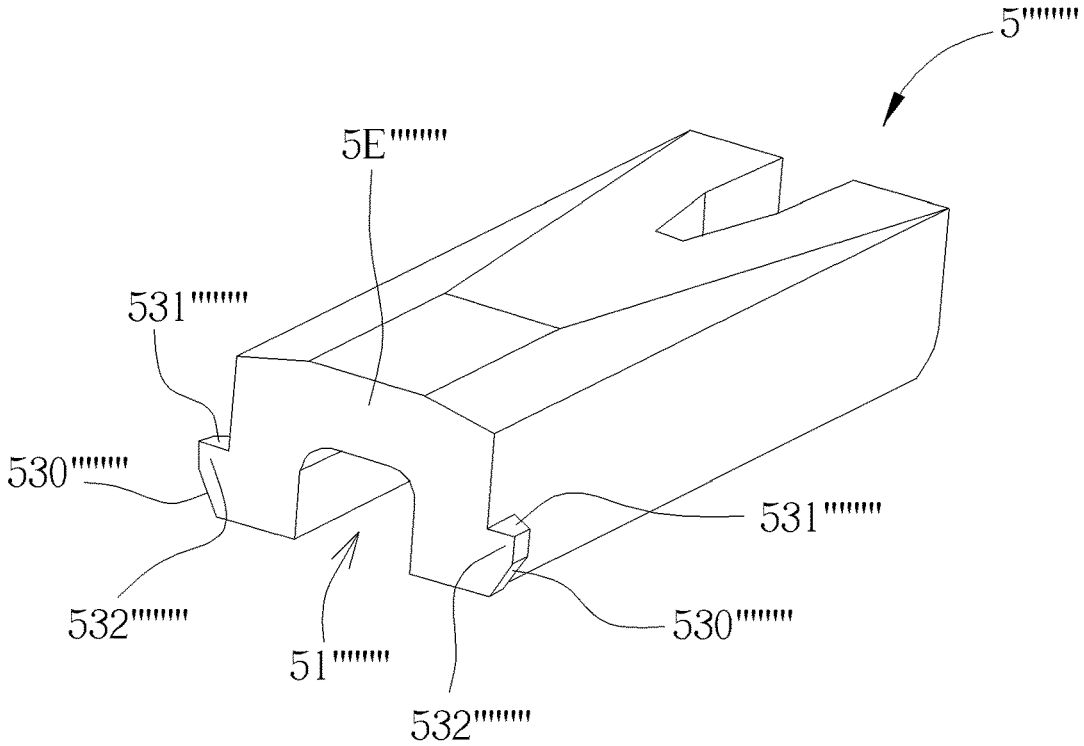
Figure 66:
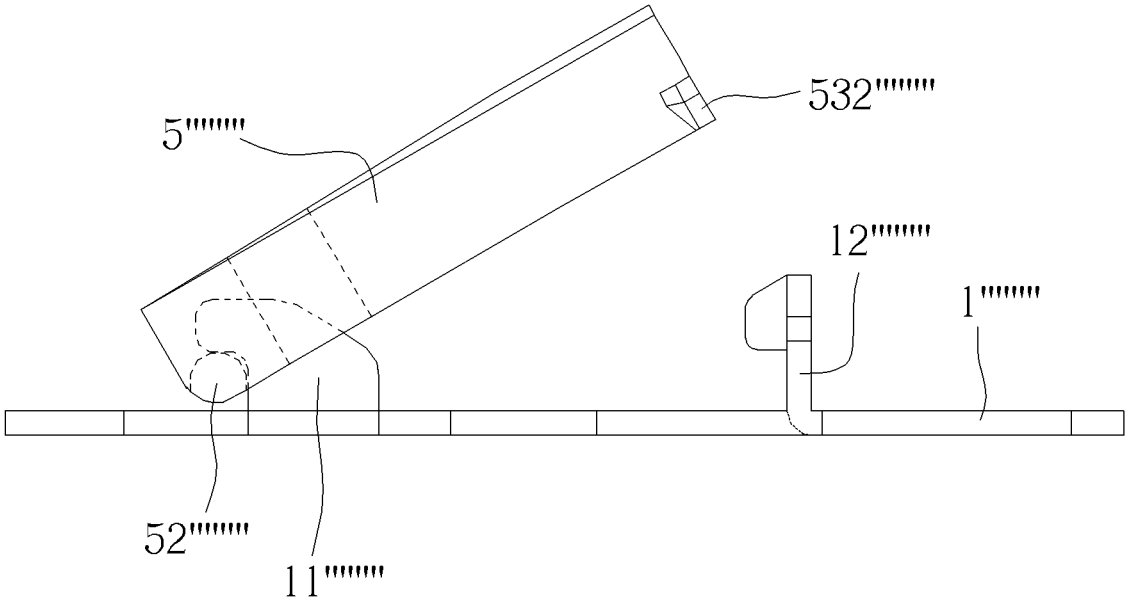
FIG. 66 and FIG. 67 are diagrams of the buffer member located at different installation positions relative to a base according to the eighteenth embodiment of the present invention.
Figure 67:
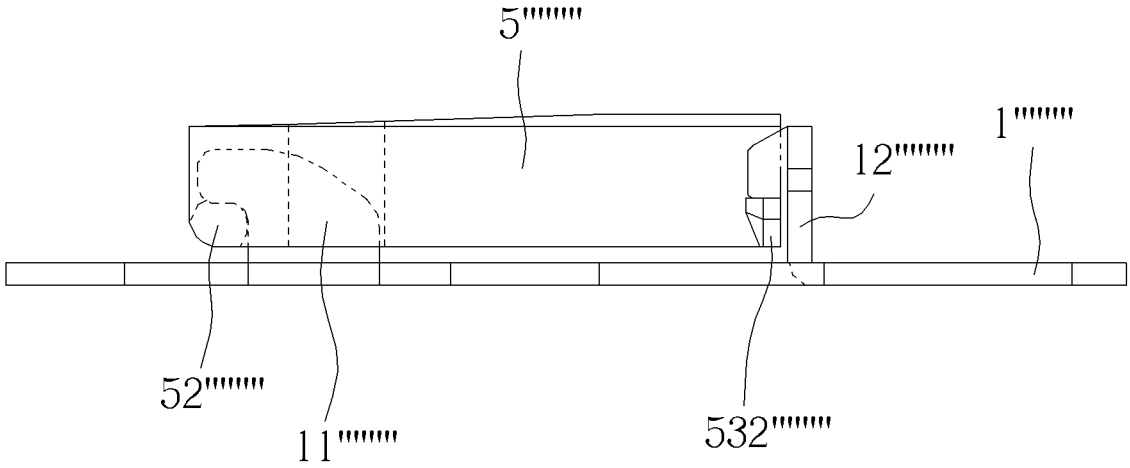

Please refer to FIG. 61 to FIG. 67. FIG. 61 and FIG. 62 are partial diagrams of a key switch 1000'''''' at different views according to an eighteenth embodiment of the present invention. FIG. 63 is a partial exploded diagram of the key switch 1000'''''' according to the eighteenth embodiment of the present invention. FIG. 64 and FIG. 65 are diagrams of a buffer member 5'''''' at different views according to the eighteenth embodiment of the present invention. FIG. 66 and FIG. 67 are diagrams of the buffer member 5'''''' located at different installation positions relative to a base 1'''''' according to the eighteenth embodiment of the present invention. As shown in FIG. 61 to FIG. 67, the key switch 1000'''''' includes the base 1'''''', a key cap which is not shown in the figures, a supporting mechanism which is not shown in the figures, the link bar 4', the buffer member 5'''''' and a circuit board 7''''''. The base 1'''''' includes a first extending arm 11'''''', a second extending arm 12'''''' and an opening structure 13''''''. The first extending arm 11'''''' includes a first longitudinal axis 110'''''' along a first longitudinal direction, e.g., the third direction O3, and the second extending arm 12'''''' includes a second longitudinal axis 120'''''' along a second longitudinal direction, e.g., the first direction O1, substantially perpendicular to the first longitudinal direction. The opening structure 13'''''' is located at a side of the second extending arm 12'''''' away from the first extending arm 11''''''. The circuit board 7'''''' includes a lower buffer portion 70'''''' extended above the opening structure 13'''''' for supporting the lower linking end 41' of the link bar 4'. A buffer end 5E'''''' of the buffer member 5'''''' is located at a position away from a first engaging portion 52'''''' of the buffer member 5''''''. A recess structure 51'''''' is formed on the buffer end 5E''''''. A second engaging portion 53'''''' of the buffer member 5'''''' includes two protrusions 532'''''' located at two opposite sides of the buffer end 5E''''''. The second extending arm 12'''''' includes two engaging protruding portions 125'''''' and a hole structure 126''''''. The corresponding protrusion 532'''''' engages with the corresponding engaging protruding portion 125'''''' respectively. The hole structure 126'''''' is aligned with the recess structure 51'''''' and has an opening larger than an opening of the recess structure 51''''''. The lower linking end 41' of the link bar 4' passes through the hole structure 126'''''' into the recess structure 51''''''.

Specifically, each protrusion 532'''''' includes an inclined structure 530'''''' and an abutting structure 531''''''. Each inclined structure 530'''''' is configured to cooperate with the corresponding engaging protruding portion 125'''''' to guide the corresponding protrusion 532'''''' to engage with the corresponding engaging protruding portion 125'''''' when the buffer member 5'''''' rotates relative to the base 1'''''' by rotating engagement of the first extending arm 11'''''' and the first engaging portion 52''''''. Each abutting structure 531'''''' is configured to abut against a wall of the corresponding engaging protruding portion 125'''''' when the corresponding protrusion 532'''''' engages with the corresponding engaging protruding portion 125''''''.

In contrast to the prior art, the present invention utilizes the buffer member for reducing the operational noise of the key switch. In the present invention, the lower linking end of the link bar is driven to move within the restraining structure formed on the buffer member when the key cap moves relative to the base upwardly and downwardly. Since the buffer member is made of the material softer than the material of the base, the buffer member of the present invention facilitates to reduce the noise of the movement of the lower linking end of the link bar relative to the base.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A key switch with noise reduction capability, the key switch comprising:

a base comprising a first extending arm, the first extending arm comprising a first vertical extending portion and a first hook, a pivoting space being formed between the first hook and the first vertical extending portion;

a circuit board disposed on the base;

a key cap disposed above the base;

a supporting mechanism disposed between the base and the key cap, an upper end and a lower end of the supporting mechanism being connected to the key cap and the base respectively to allow the key cap to move relative to the base upwardly and downwardly;

a link bar comprising a lower linking end; and a buffer member disposed on the base, the buffer member and the base being two independent components, the buffer member comprising a recess structure having an opening facing toward the base, the base and the recess structure being adjacent to form the restraining structure cooperatively, the lower linking end movably passing through the restraining structure, the buffer member being made of material softer than material of the base, the buffer member comprising a first engaging portion, the first engaging portion being configured to rotatably engage with the first extending arm, a first assembling slot being formed on the buffer member, the first engaging portion entering into the pivoting space to rotatably engage with the first hook and to abut against a lower surface of the first hook when the first extending arm enters into the first assembling slot;

wherein when the key cap moves relative to the base upwardly and downwardly, the lower linking end is driven to move within the restraining structure correspondingly, so as to reduce noise during movement of the lower linking end relative to the base.

2. The key switch of claim 1, wherein the base comprises at least one extending arm, at least one assembling slot is formed on the buffer member, and the at least one extending arm detachably engages with the at least one assembling slot.

3. The key switch of claim 1, wherein the base further comprises a second extending arm, the buffer member further comprises a buffer longitudinal axis and a second engaging portion, the first engaging portion and the second engaging portion are located at two opposite ends of the buffer longitudinal axis, the first engaging portion and the second engaging portion are respectively configured to rotatably engage with the first extending arm and the second extending arm, the base and the recess structure are adjacent to form the restraining structure when the buffer member rotates toward the base by rotating engagement of the first engaging portion and the first extending arm to drive the second engaging portion to engage with the second extending arm or when the buffer member rotates toward the base by rotating engagement of the second engaging portion and the second extending arm to drive the first engaging portion to engage with the first extending arm.

4. The key switch of claim 3, wherein a second assembling slot is formed on the buffer member, the second extending arm comprises a second vertical extending portion and a second hook, a second pivoting space is formed between the second hook and the second vertical extending portion, and the second engaging portion enters into the second pivoting space to rotatably engage with the second hook and to abut against a lower surface of the second hook when the second extending arm enters into the second assembling slot.

5. The key switch of claim 3, wherein each of the first engaging portion and the second engaging portion is substantially an arc-shaped structure selected from a group consisting of a circular column and a semicircular column, and an outline of each of the first extending arm and the second extending arm matches with the arc-shaped structure substantially.

6. The key switch of claim 1, wherein the base further comprises a base body and a second extending arm, the first extending arm extends from the base body and has a first longitudinal axis along a third direction, the second extending arm extends from the base body and has a second longitudinal axis along a first direction different from the third direction, the buffer member further comprises a buffer longitudinal axis along the third direction and a second engaging portion, the first engaging portion and the second engaging portion are located at two opposite ends of the buffer longitudinal axis, the circuit board comprises a switch, the switch is activated selectively according to upward and downward movement of the key cap relative to the base, the base and the recess structure are adjacent to form the restraining structure when the first engaging portion and the second engaging portion engage with the first extending arm and the second extending arm respectively, the lower linking end movably passes through the restraining structure, and when the key cap moves relative to the base upwardly and downwardly to drive the lower linking end to move within the restraining structure correspondingly, the buffer member restrains an upper surface of the lower linking end, so as to reduce noise during movement of the lower linking end relative to the base.

7. The key switch of claim 6, wherein the first extending arm further comprises a first horizontal extending portion, the first horizontal extending portion is connected to the base body and substantially extends along the first direction, the first vertical extending portion is connected to the first horizontal extending portion and substantially extends along a second direction perpendicular to the first direction and the third direction, and the first hook is connected to the first vertical extending portion and substantially extends along the third direction, the second extending arm comprises a second horizontal extending portion, a second vertical extending portion and a second hook, the second horizontal extending portion is connected to the base body and substantially extends along the first direction, the second vertical extending portion is connected to the second horizontal extending portion and substantially extends along the second direction, the second hook is connected to the second vertical extending portion and substantially extends along a fourth direction opposite to the third direction.

8. The key switch of claim 6, wherein the first extending arm further comprises a first horizontal extending portion, the first horizontal extending portion is connected to the base body and substantially extends along the first direction, the first vertical extending portion is connected to the first horizontal extending portion and substantially extends along a second direction perpendicular to the first direction and the third direction, the first hook is connected to the first vertical extending portion and substantially extends along the third direction, the second extending arm comprises a second horizontal portion and a second vertical extending portion, the second horizontal extending portion is connected to the base body and substantially extends along the third direction, the second vertical extending portion is connected to the second horizontal extending portion and substantially extends along the second direction.

9. The key switch of claim 1, wherein the base further comprises a second extending arm, the buffer member further comprises a buffer longitudinal axis and a second engaging portion, the first engaging portion and the second engaging portion are located at two opposite ends of the buffer longitudinal axis, the base and the recess structure are adjacent to form the restraining structure when the first engaging portion and the second engaging portion respectively engage with the first extending arm and the second extending arm.

10. The key switch of claim 9, wherein the circuit board further comprises a lower buffer portion at least extended between the first extending arm and the second extending arm for supporting the lower linking end, and the lower buffer portion restrains a lower surface of the lower linking end when the key cap moves relative to the base upwardly and downwardly to drive the lower linking end to move within the restraining structure correspondingly.

11. The key switch of claim 9, wherein the recess structure has an downward opening to form an accommodating space, the buffer member further comprises a buffer rib adjacent to the accommodating space and extending along the buffer longitudinal axis, when the lower linking end moves within the accommodating space, the lower linking end abut against the buffer rib, so as to reduce a contacting area of the lower linking end and the buffer member.

12. The key switch of claim 9, wherein a second assembling slot is formed on the buffer member, the buffer member further comprises a restraining rib, the first extending arm is configured to allow the first extending arm to enter therein, the second extending arm is configured to allow the second extending arm to enter therein, the restraining rib protrudes from a wall of the second assembling slot, and the restraining rib abuts against the second extending arm, so that the restraining rib and the first engaging portion cooperatively restrain the buffer member from moving along a direction parallel to the buffer longitudinal axis.

13. The key switch of claim 9, wherein the first engaging portion is substantially an arc-shaped structure selected from a group consisting of a circular column and a semicircular column, and an outline of the first extending arm matches with the arc-shaped structure substantially.

14. The key switch of claim 9, wherein the first extending arm comprises a first longitudinal axis along a third direction, the second extending arm comprises a second longitudinal axis along a first direction, the third direction is substantially perpendicular to the first direction, the buffer member further comprises a buffer end located at a position away from the first engaging portion, the recess structure is formed on the buffer end, the second engaging portion comprises two protrusions located at two opposite sides of the buffer end, the second extending arm comprises two engaging protruding portions, and the corresponding protrusion engages with the corresponding engaging protruding portion respectively.

15. The key switch of claim 14, wherein each protrusion comprises an inclined structure and an abutting structure, each inclined structure is configured to cooperate with the corresponding engaging protruding portion to guide the corresponding protrusion to engage with the corresponding engaging protruding portion, each abutting structure is configured to abut against a wall of the corresponding engaging protruding portion when the corresponding protrusion engages with the corresponding engaging protruding portion.

16. The key switch of claim 9, wherein the base and the recess structure are adjacent to form the restraining structure when the buffer member rotates toward the base by rotating engagement of the first engaging portion and the first extending arm to drive the second engaging portion to engage with the second extending arm.

17. The key switch of claim 16, wherein a second assembling slot is formed on the buffer member, the second extending arm comprises a second vertical extending portion and a second hook, an engaging space is formed between the second hook and the second vertical extending portion, and the second engaging portion enters into the engaging space to engage with the second hook and to abut against a lower surface of the second hook when the second extending arm enters into the second assembling slot.

18. The key switch of claim 16, wherein an engaging hole is formed on the second extending arm, the first extending arm comprises a first longitudinal axis along a third direction, the second extending arm comprises a second longitudinal axis along a first direction, the third direction is substantially perpendicular to the first direction, the buffer member further comprises a buffer end located at a position away from the first engaging portion, the recess structure is located between the buffer end and the first engaging portion, the second engaging portion protrudes from the buffer end, and the second engaging portion enters into the engaging hole when the second engaging portion engages with second extending arm.

19. The key switch of claim 18, wherein the second engaging portion comprises an inclined structure and an abutting structure, the inclined structure is configured to cooperate with the second extending arm for guiding the second engaging portion to enter into the engaging hole when the buffer member rotates toward the base by the rotating engagement of the first engaging portion and the first extending arm, and the abutting structure is configured to abut against a wall of the engaging hole when the second engaging portion enters into the engaging hole.

20. The key switch of claim 9, wherein the buffer member further comprises a middle downward protrusion dividing the recess structure into a first accommodating space and a second accommodating space, and the first accommodating space is located between the middle downward protrusion and the first engaging portion, and the second accommodating space is located between the middle downward protrusion and the second engaging portion, so that the buffer member has an E-shaped cross section along the buffer longitudinal axis.

21. The key switch of claim 20, wherein the base further comprises an opening structure and a central extending portion located in a middle portion of the opening structure, the opening structure is aligned with the recess structure, and the central extending portion is aligned with the middle downward protrusion.

22. The key switch of claim 21, wherein the base further comprises a restraining component, the restraining component is configured to abut against the link bar to restrain movement of the link bar, to prevent the lower linking end to be removed from the restraining structure.

23. The key switch of claim 21, wherein the central extending portion comprises a substantially T-shaped portion, the substantially T-shaped portion is upwardly extended and connected to the first extending arm and the second extending arm, a first receiving space is formed between the substantially T-shaped portion and the first extending arm and is greater than the first accommodating space, a second receiving space is formed between the substantially T-shaped portion and the second extending arm and is greater than the second accommodating space, an assembling slot is formed on the buffer member, and the first extending arm, the second extending arm and the substantially T-shaped portion are at least partially accommodated inside the assembling slot when the first hook and the second hook respectively engage with the first engaging portion and the second engaging portion.

24. A key switch with noise reduction capability, the key switch comprising:

a base comprising a first extending arm and a second extending arm, an engaging hole being formed on the second extending arm, the first extending arm comprising a first longitudinal axis along a third direction, the second extending arm comprising a second longitudinal axis along a first direction, the third direction being substantially perpendicular to the first direction;

a circuit board disposed on the base;

a key cap disposed above the base;

a supporting mechanism disposed between the base and the key cap, an upper end and a lower end of the supporting mechanism being connected to the key cap and the base respectively to allow the key cap to move relative to the base upwardly and downwardly;

a link bar comprising a lower linking end; and a buffer member disposed on the base, the buffer member and the base being two independent components, a restraining structure being formed on the buffer member, the lower linking end movably passing through the restraining structure, the buffer member being made of material softer than material of the base, the buffer member comprising a buffer longitudinal axis, a recess structure, a first engaging portion, a second engaging portion and a buffer end, the buffer end being located at a position away from the first engaging portion, the recess structure being located between the buffer end and the first engaging portion, the second engaging portion protrudes from the buffer end, the first engaging portion and the second engaging portion being located at two opposite ends of the buffer longitudinal axis, the base and the recess structure being adjacent to form the restraining structure when the first engaging portion and the second engaging portion respectively engage with the first extending arm and the second extending arm, the first engaging portion being configured to rotatably engage with the first extending arm, the base and the recess structure are adjacent to form the restraining structure when the buffer member rotates toward the base by rotating engagement of the first engaging portion and the first extending arm to drive the second engaging portion to engage with the second extending arm, the second engaging portion entering into the engaging hole when the second engaging portion engages with second extending arm;

wherein when the key cap moves relative to the base upwardly and downwardly, the lower linking end is driven to move within the restraining structure correspondingly, so as to reduce noise during movement of the lower linking end relative to the base.

25. The key switch of claim 24, wherein the first extending arm comprises a first horizontal extending portion, a first vertical extending portion and a first hook, the first horizontal extending portion is connected to the base body and substantially extends along the first direction, the first vertical extending portion is connected to the first horizontal extending portion and substantially extends along a second direction perpendicular to the first direction and the third direction, the first hook is connected to the first vertical extending portion and substantially extends along the third direction, the second extending arm comprises a second horizontal portion and a second vertical extending portion, the second horizontal extending portion is connected to the base body and substantially extends along the third direction, the second vertical extending portion is connected to the second horizontal extending portion and substantially extends along the second direction.

26. A key switch with noise reduction capability, the key switch comprising:

a base comprising a first extending arm and a second extending arm, the first extending arm comprising a first longitudinal axis along a third direction, the second extending arm comprising a second longitudinal axis along a first direction, the third direction being substantially perpendicular to the first direction, the second extending arm comprising two engaging protruding portions,;

a circuit board disposed on the base;

a key cap disposed above the base;

a supporting mechanism disposed between the base and the key cap, an upper end and a lower end of the supporting mechanism being connected to the key cap and the base respectively to allow the key cap to move relative to the base upwardly and downwardly;

a link bar comprising a lower linking end; and a buffer member disposed on the base, the buffer member and the base being two independent components, a restraining structure being formed on the buffer member, the lower linking end movably passing through the restraining structure, the buffer member being made of material softer than material of the base, the buffer member comprising a buffer longitudinal axis, a recess structure, a first engaging portion, a second engaging portion and a buffer end, the buffer end being located at a position away from the first engaging portion, the recess structure being formed on the buffer end, the second engaging portion comprising two protrusions located at two opposite sides of the buffer end, the first engaging portion and the second engaging portion being located at two opposite ends of the buffer longitudinal axis, the base and the recess structure being adjacent to form the restraining structure when the first engaging portion and the second engaging portion respectively engage with the first extending arm and the second extending arm, the first engaging portion being configured to rotatably engage with the first extending arm, the base and the recess structure being adjacent to form the restraining structure when the buffer member rotates toward the base by rotating engagement of the first engaging portion and the first extending arm to drive the second engaging portion to engage with the second extending arm, the corresponding protrusion engaging with the corresponding engaging protruding portion respectively when the second engaging portion engages with the second extending arm;

wherein when the key cap moves relative to the base upwardly and downwardly, the lower linking end is driven to move within the restraining structure correspondingly, so as to reduce noise during movement of the lower linking end relative to the base.

27. The key switch of claim 26, wherein the first extending arm comprises a first horizontal extending portion, a first vertical extending portion and a first hook, the first horizontal extending portion is connected to the base body and substantially extends along the first direction, the first vertical extending portion is connected to the first horizontal extending portion and substantially extends along a second direction perpendicular to the first direction and the third direction, the first hook is connected to the first vertical extending portion and substantially extends along the third direction, the second extending arm comprises a second horizontal portion and a second vertical extending portion, the second horizontal extending portion is connected to the base body and substantially extends along the third direction, the second vertical extending portion is connected to the second horizontal extending portion and substantially extends along the second direction.

* * * * *